US012251594B2

(12) United States Patent
McGhee

(10) Patent No.: US 12,251,594 B2
(45) Date of Patent: Mar. 18, 2025

(54) PORTABLE EXERCISE APPARATUS

(71) Applicant: James McGhee, Willow Grove, PA (US)

(72) Inventor: James McGhee, Willow Grove, PA (US)

( * ) Notice: Subject to any disclaimer, the term of this patent is extended or adjusted under 35 U.S.C. 154(b) by 0 days.

(21) Appl. No.: 16/517,562

(22) Filed: Jul. 20, 2019

(65) Prior Publication Data

US 2020/0114194 A1 Apr. 16, 2020

Related U.S. Application Data

(63) Continuation-in-part of application No. 15/417,188, filed on Jan. 26, 2017, now Pat. No. 10,456,612.

(60) Provisional application No. 62/450,560, filed on Jan. 25, 2017.

(51) Int. Cl.
*A63B 21/00* (2006.01)
*A63B 21/16* (2006.01)

(52) U.S. Cl.
CPC ..... *A63B 21/154* (2013.01); *A63B 21/169* (2015.10); *A63B 21/4031* (2015.10); *A63B 21/4035* (2015.10); *A63B 21/4043* (2015.10); *A63B 2209/00* (2013.01)

(58) Field of Classification Search
CPC ..... A63B 17/00; A63B 17/02; A63B 17/04; A63B 21/00058; A63B 21/00061; A63B 21/00065; A63B 21/00069; A63B 21/00076; A63B 21/00178; A63B 21/00185; A63B 21/002; A63B 21/0023; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/15; A63B 21/151; A63B 21/154; A63B 21/156; A63B 21/16; A63B 21/169; A63B 21/4027; A63B 21/4029; A63B 21/4031; A63B 21/4033; A63B 21/4035; A63B 21/4043; A63B 71/0036; A63B 2208/0228; A63B 2208/0233; A63B 2210/00; A63B 2210/50; A63B 2225/09; A63B 2225/093; A63B 2225/10; A63B 2225/102
See application file for complete search history.

(56) References Cited

U.S. PATENT DOCUMENTS 3,874,657 A * 4/1975 Niebojewski ..... A63B 21/16 482/142
4,275,882 A * 6/1981 Grosser ..... A63B 21/4035 482/112
4,456,246 A * 6/1984 Szabo ..... A63B 21/06 482/99

(Continued)

*Primary Examiner* — Gary D Urbiel Goldner
(74) *Attorney, Agent, or Firm* — Muskin and Farmer LLC

(57) ABSTRACT

A portable exercise apparatus intended for indoor use. A vertical spine is constructed and mounted to a plurality of wall braces. The spine has a series of pairs of hooks aligned vertically. The user can then place either a pulley plate or a body into a desired hook. Hooks are configured such that when the pulley plate or body is placed therein, force in a downward or straight direction would not remove the pulley plate or body. A bench can be attached to the pulley plate or body which then allows a user to set or lie on and perform exercises using a resistance cord which can be connected to the body, pulley plate, and or braces.

11 Claims, 68 Drawing Sheets

(56) References Cited

U.S. PATENT DOCUMENTS 4,564,194 A * 1/1986 Dawson ..... A63B 21/0626 482/102
4,618,140 A * 10/1986 Brown ..... A63B 21/169 482/73
6,319,179 B1 * 11/2001 Hinds ..... A63B 21/0552 482/121
9,314,658 B2 * 4/2016 Kaye ..... A63B 23/03508
D772,356 S * 11/2016 Gregory ..... A63B 21/0552 D21/686
D788,234 S * 5/2017 Gregory ..... A63B 21/4047 D21/686
D806,808 S * 1/2018 Gregory ..... A63B 21/0626 D21/686
10,456,612 B2 * 10/2019 McGhee ..... A63B 1/00
2001/0018387 A1 * 8/2001 Webber ..... A63B 21/078 482/145
2002/0137604 A1 * 9/2002 Chen ..... A63B 21/4047 482/142
2010/0048368 A1 * 2/2010 Donofrio ..... A63B 21/0552 482/130
2011/0195822 A1 * 8/2011 Donofrio ..... A63B 1/00 482/129
2011/0237410 A1 * 9/2011 Perez ..... A63B 21/16 482/129
2014/0018215 A1 * 1/2014 Donofrio ..... A63B 21/169 482/129
2014/0031182 A1 * 1/2014 Donofrio ..... A63B 21/0552 482/129
2015/0238799 A1 * 8/2015 Arline ..... A63B 21/0442 482/129
2015/0352395 A1 * 12/2015 Gregory ..... A63B 23/1218 482/123
2016/0236025 A1 * 8/2016 Henan ..... A63B 23/0355
2017/0239505 A1 * 8/2017 Shchipsky ..... A63B 23/0205
2017/0239512 A1 * 8/2017 Brasch ..... A63B 21/4029
2019/0083840 A1 * 3/2019 Guidicipietro ..... A63B 21/0726
2020/0353312 A1 * 11/2020 Smith ..... A61B 5/7405
2020/0384337 A1 * 12/2020 Brasch ..... A63B 21/078

* cited by examiner

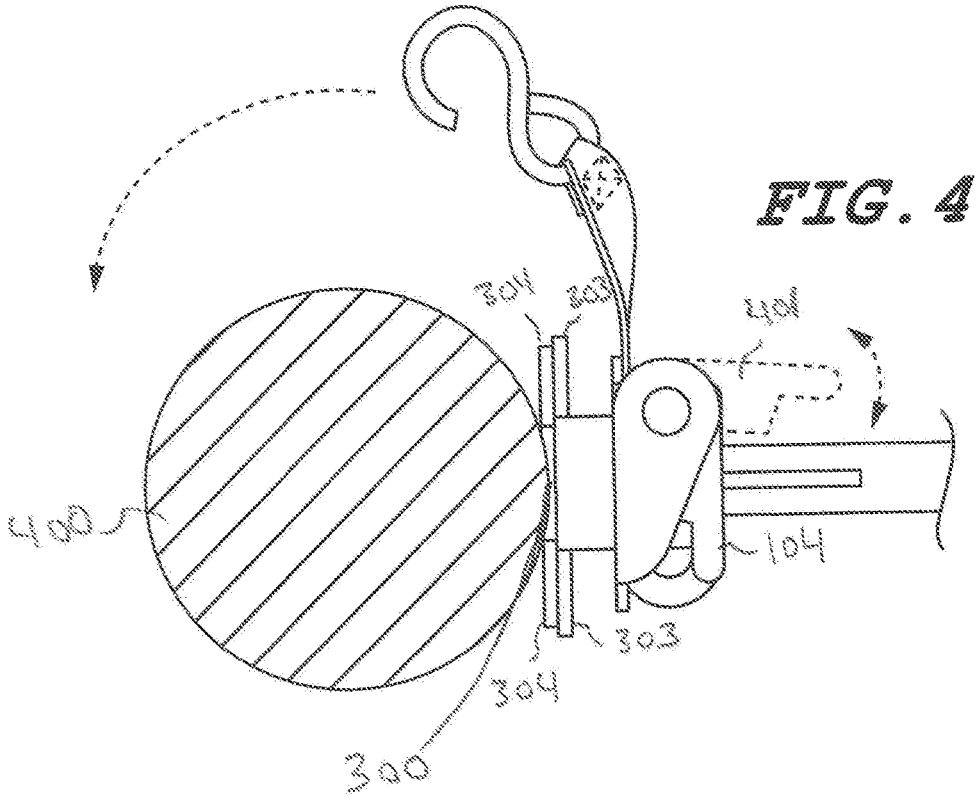
FIG. 4
FIG. 5
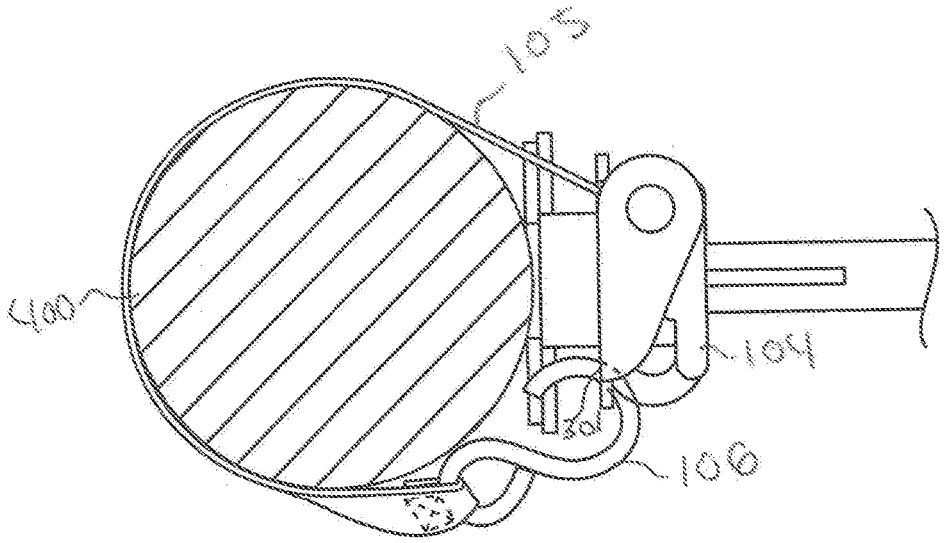

FIG. 67
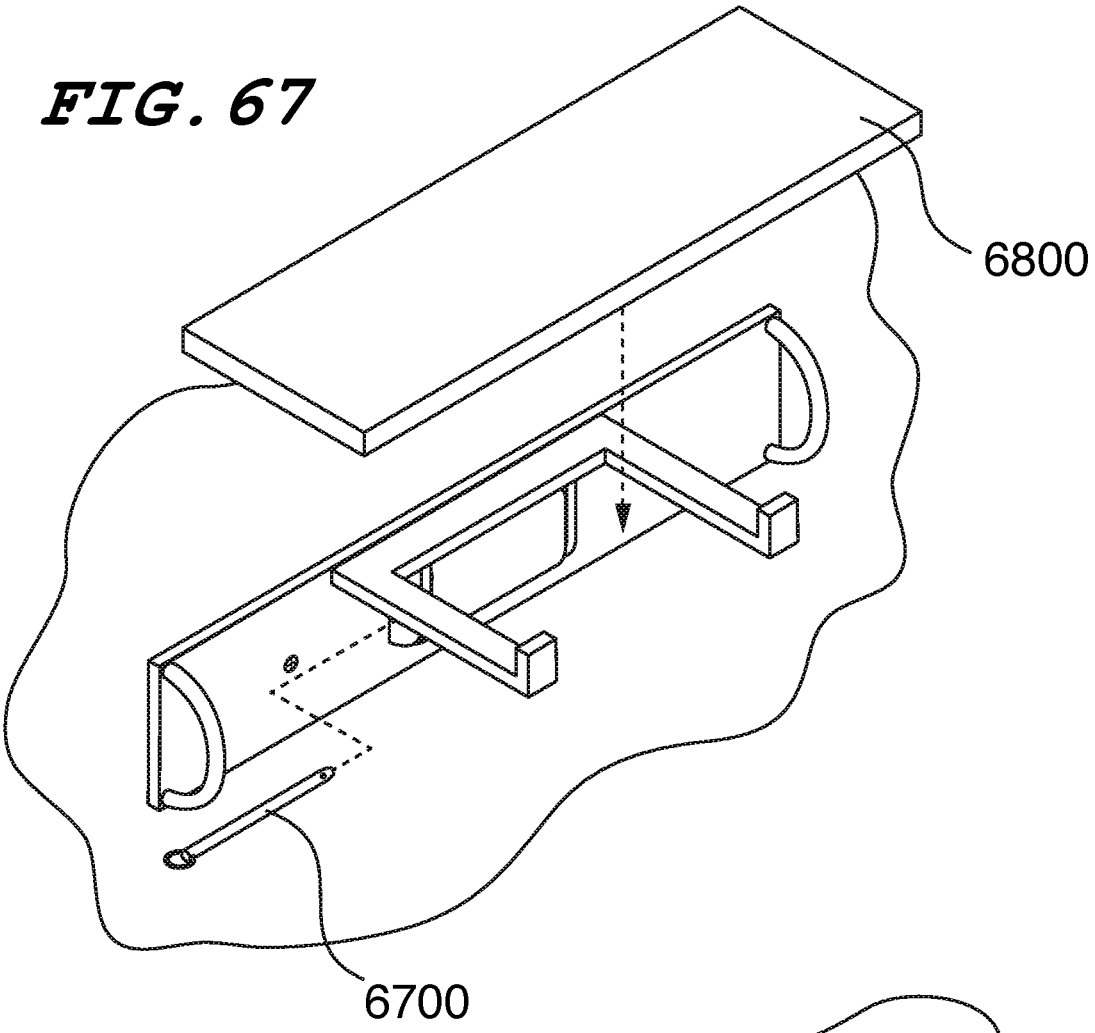
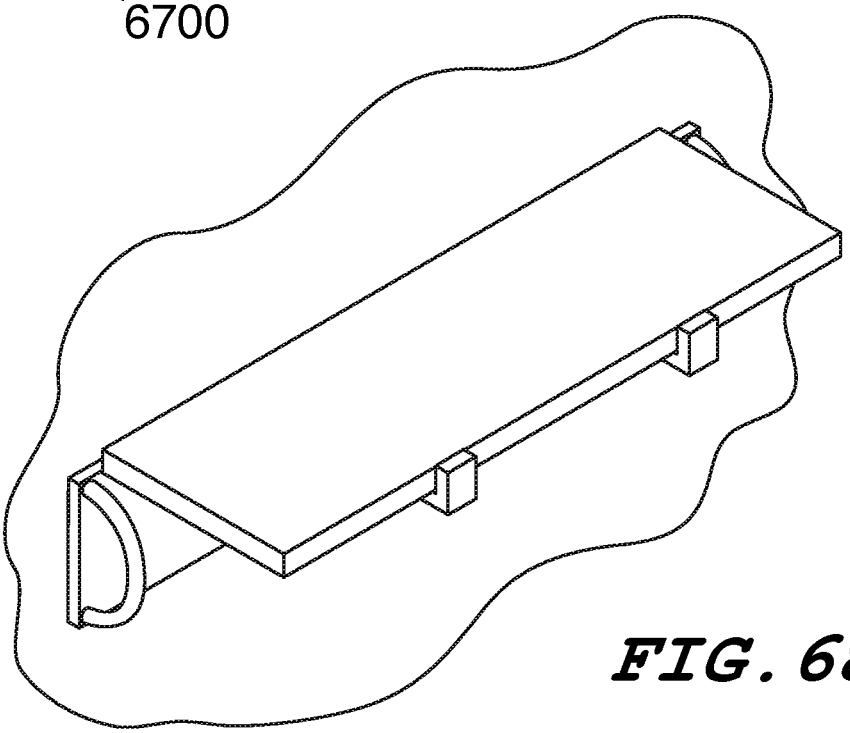
FIG. 68

PORTABLE EXERCISE APPARATUS

CROSS REFERENCE TO RELATED APPLICATIONS

This application is a continuation in part of U.S. application Ser. No. 15/417,188 (which is incorporated by reference herein in its entirety) which claims benefit to U.S. provisional application 62/450,560 (which is incorporated by reference herein in its entirety).

BACKGROUND OF THE INVENTION

Field of the Invention

The present general inventive concept is directed to a method and apparatus directed to a portable exercise apparatus.

Description of the Related Art

Exercise apparatus (such as in a gym) can be heavy and not conducive to being portable. Active persons who may not have the opportunity to go to the gym (e.g., because they are out camping, etc.) would benefit from a portable apparatus which would enable physical exercises and activity. What is needed is a portable device which can be used for various physical exercises which can be easy to assembly and install.

SUMMARY OF THE INVENTION

It is an aspect of the present invention to provide an improved exercise device.

These aspects can be achieved by: An apparatus, comprising: an attachment configured to attach to a horizontal bar; a package attached to the attachment; a chair support comprising a first end and a second end opposite the first end, the first end of the chair support connected to a floor of the package; wherein the chair support is configured to rotate between a lowered position parallel to the floor of the package and a raised position perpendicular to the floor of the package; and a seat configured to attach to the second end of the chair support when the chair support is in the vertical position.

These aspects can also be achieved by the apparatus in the preceding paragraph, wherein the chair support rotates about a chair pivot. These aspects can also be achieved by the apparatus in the preceding paragraph, further comprising a chair plate connected to the floor of the package, the chair plate comprising a chair hole. These aspects can also be achieved by the apparatus in the preceding paragraph, wherein the chair support comprises a chair button, wherein the chair button and the chair hole are configured such that when the chair support is in the raised position the chair button snaps into the chair hole thereby locking the chair support in the raised position. These aspects can also be achieved by the apparatus in the preceding sentence, wherein the chair button and the chair hole are further configured such that when the chair button is depressed, the chair support is unlocked so that the chair support can be lowered into the lowered position. These aspects can also be achieved by the apparatus in the preceding paragraph, further comprising a ladder attached to the package. These aspects can also be achieved by the apparatus in the preceding paragraph, wherein the seat is removable from the second end of the chair support. These aspects can also be achieved by the apparatus in the preceding paragraph, wherein the apparatus is configured such that when the chair support is in the lowered position, the seat is removed from the second end of the chair support and the seat is positioned over the chair support and parallel to the floor. These aspects can also be achieved by the apparatus in the preceding paragraph, further comprising at least two straps configured to fold over the package thereby securing the seat therein.

These aspects can also be achieved by an apparatus comprising: an attachment configured to attach to a horizontal bar; a net holder connected to the attachment, the net holder comprising a slot; a stake holder; and a net connected to both the stake holder and the net holder, wherein the net holder is configured such that the net slides through the slot thereby allowing the stake holder to be moved away from the net holder with the net connecting the stake holder and the net holder therebetween.

These aspects can also be achieved by the apparatus in the preceding paragraph, further comprising a cog. These aspects can also be achieved by the apparatus in the preceding sentence, wherein the cog is adapted to enable the net to wind around the cog inside the net holder. These aspects can also be achieved by the apparatus in the preceding sentence, further comprising an energy storage mechanism configured to automatically retract the net into the net holder when the net is extended. These aspects can also be achieved by the apparatus in the preceding sentence, wherein the energy storage mechanism is a bungee cord. These aspects can also be achieved by the apparatus in the penultimate sentence above, wherein the energy storage mechanism is housed in a housing attached to a lid on an end of the net holder. These aspects can also be achieved by the apparatus in the preceding sentence, further comprising a shaft inside the housing which receives the cog.

These aspects can also be achieved by the apparatus in the penultimate paragraph above, wherein the stake holder further comprises a collapsible net stake. These aspects can also be achieved by the apparatus in the preceding sentence, wherein the stake holder further comprises a door which is configured to be in an open and closed position, the open position enables the collapsible net stake to extend outside of the stake holder and the closed position restrains the collapsible net stake inside the stake holder. These aspects can also be achieved by the apparatus in the penultimate paragraph above, wherein the net is a volleyball net.

These aspects can also be achieved by an apparatus, comprising: a spine comprising at least three pairs of hooks; a first connector attached to a block, the block adapted to fit into two pairs of the plurality of pairs of hooks; and a bench connected to a bench connector, the bench connector configured to removably attach to the first connector.

These aspects can also be achieved by the apparatus in the preceding paragraph, wherein the block is a body. These aspects can also be achieved by the apparatus in the preceding paragraph, wherein the block is a pulley plate. These aspects can also be achieved by the apparatus in the preceding paragraph, wherein the spine is connected to a plurality of braces. These aspects can also be achieved by the apparatus in the preceding sentence, wherein the plurality of braces are mounted vertically on a wall, and the spine is mounted vertically on the plurality of braces. These aspects can also be achieved by the apparatus in the preceding paragraph, further comprising a resistance cord adapted to attach to the block. These aspects can also be achieved by the apparatus in the penultimate sentence above, further comprising a resistance cord adapted to attach to the plurality of braces. These aspects can also be achieved by an apparatus in the preceding paragraph, wherein the bench comprises leg lifts. These aspects can also be achieved by an apparatus in the preceding sentence, further comprising a resistance cord adapted to attach to the leg lifts. These aspects can also be achieved by an apparatus in the preceding paragraph, further comprising a resistance cord with handles at each end, the resistance cord passing through at least one pulley which is connected to the block. These aspects can also be achieved by an apparatus in the preceding paragraph, wherein the block comprises an upper support adapted to fit onto one of the two pairs of the plurality of pairs of hooks, and a lower support adapted to fit onto another one of the two pairs of the plurality of pairs of hooks. These aspects can also be achieved by an apparatus in the second sentence of this paragraph, wherein the pulley plate comprises a pulley ring. These aspects can also be achieved by an apparatus in the preceding paragraph, wherein a bench pivot is attached between the bench and the bench connector an configured to enable the bench connector to pivot about the bench.

These aspects can also be achieved by a method, comprising: providing an apparatus comprising vertical spine comprising at least three pairs of hooks, a first connector attached to a block, the block adapted to fit into two pairs of the plurality of pairs of hooks, and a bench connected to a bench connector, the bench connector configured to removably attach to the first connector; attaching the resistance cord to the apparatus; sitting on the bench; and performing an exercise by pulling on the resistance cord.

These aspects can also be achieved by the method in the preceding paragraph, wherein the vertical spine is mounted on a plurality of braces. These aspects can also be achieved by the method in the preceding paragraph, wherein the attaching the resistance cord to the apparatus comprises attaching a pulley to the apparatus and passing the resistance cord through the pulley. These aspects can also be achieved by the method in the preceding paragraph, wherein the resistance cord comprises a handle each end of the resistance cord, and the resistance cord passes through at least one pulley attached to the apparatus. These aspects can also be achieved by the method in the preceding sentence, wherein the at least one pulley is attached to the block.

The inventive concept can also be summarized as a portable exercise apparatus intended for indoor use. A vertical spine is constructed and mounted to a plurality of wall braces. The spine has a series of pairs of hooks aligned vertically. The user can then place either a pulley plate or a body into a desired hook. Hooks are configured such that when the pulley plate or body is placed therein, force in a downward or straight direction would not remove the pulley plate or body. A bench can be attached to the pulley plate or body which then allows a user to set or lie on and perform exercises using a resistance cord which can be connected to the body, pulley plate, and or braces.

The inventive concept can also be summarized to include attachments adapted for a portable exercise apparatus configured to attach to a vertical structure. The portable exercise apparatus includes a top strap attached to a hook and a bottom strap attached to a hook, the top strap and bottom strap can be wrapped around the vertical structure and secured at the apparatus. The attachments offer a variety of functionality which can all be utilized when attached to the portable exercise apparatus which would be attached to a vertical structure. Examples of some of the attachments include a basketball net, a dart board, a hammock, and other configurations which can be used and enjoyed by users.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 4 is a drawing illustrating a top view of a top attaching mechanism in an unsecured position, according to an embodiment;

FIG. 5 is a drawing illustrating a top view of the top attaching mechanism in a secured position, according to an embodiment;

FIG. 67 is a drawing showing a shelf being mounted onto the spine brace, according to an embodiment;

FIG. 68 is a drawing showing the shelf mounted onto the spine brace, according to an embodiment;

DESCRIPTION OF THE PREFERRED EMBODIMENTS

Figure 1:
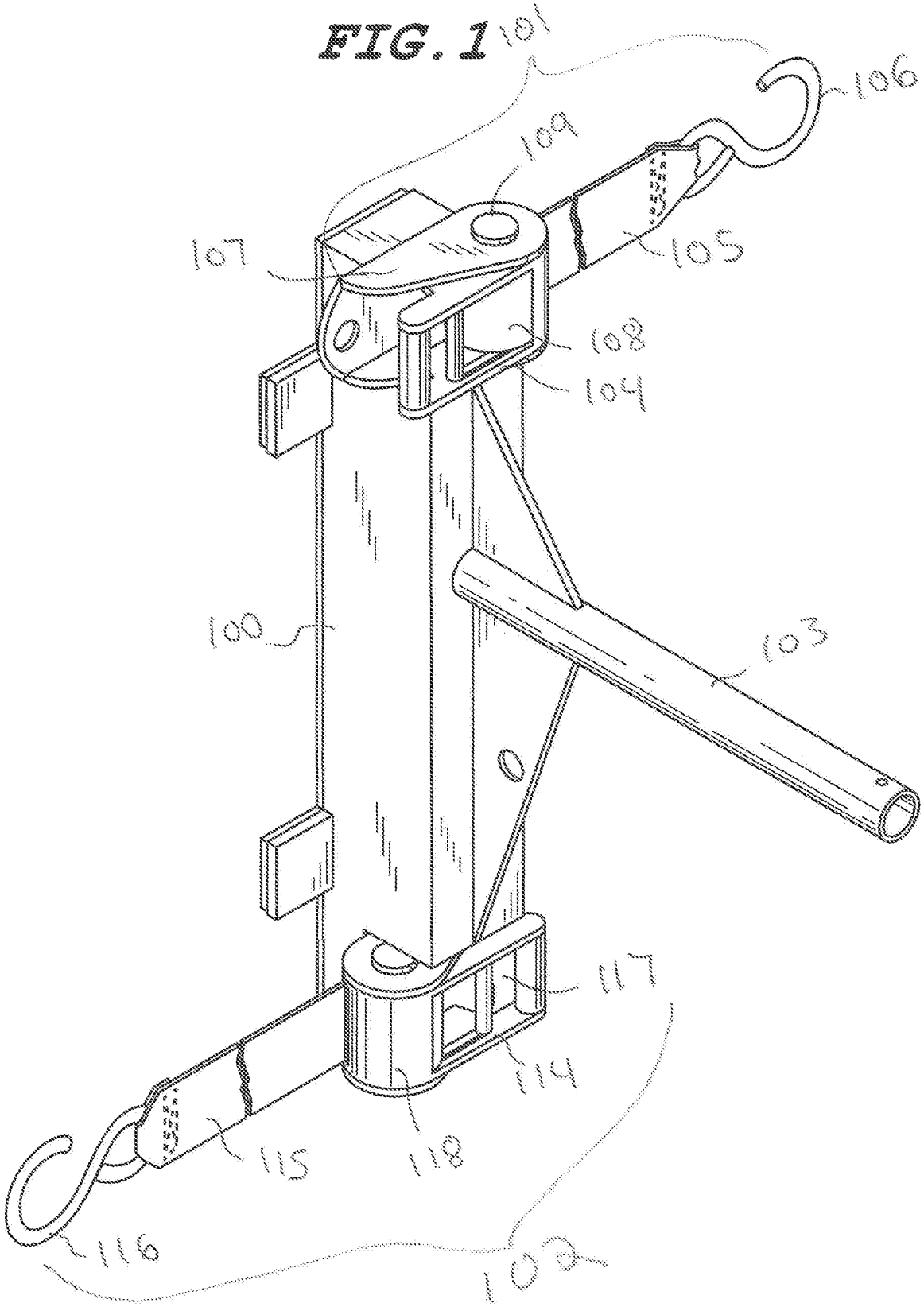
FIG. 1 is drawing of a portable exercise apparatus, according to an embodiment.

Reference will now be made in detail to the presently preferred embodiments of the invention, examples of which are illustrated in the accompanying drawings, wherein like reference numerals refer to like elements throughout.

The present inventive concept relates to a portable exercise apparatus which can typically fit inside a backpack or similar device. The portable exercise apparatus can be ideal for outdoor use which would enable a user to perform exercises outdoors that they previously had to perform indoors.

The portable exercise apparatus contains a top attachment mechanism and a bottom attachment mechanism both attached to a body. The top and bottom attachment mechanism each comprise a strap which can be wrapped around a stationary vertical structure such as a tree. Each strap can then be tightened by tightening a respective ratchet. A set of connectors can then be assembled which create an approximate 90 degree angle between a bar (the assembled connectors) and the vertical structure. The bar enables the user to perform exercises such as pull ups, etc. There are also various holes in the portable exercise apparatus so that karabiner clips can be locked therein, the karabiner clips can be attached to a variety of things such as a pulleys or other devices that utilize resistance to enable exercise.

FIG. 1 is drawing of a portable exercise apparatus, according to an embodiment.

A body 100 is connected to a top attachment mechanism 101, a bottom attachment mechanism 102, and an integrated connector 103. The top attachment mechanism 101 and the bottom attachment mechanism 102 can both be any type of strap ratcheting system, such as the ERICKSON 34420 Pro Series Black 1"×6" Retractable Ratcheting Tie-Down Strap, or other similar off-the-shelf product (also known as ratchet tie down, ratchet strap, etc.) Strap ratcheting systems are known in the art and use a ratchet to tighten a strap and then the tension can be released by pressing a button or lever. The top attachment mechanism 101 and the bottom attachment mechanism 102 are the same (but for a different orientation of parts) and serve the same purpose (to enable a ratchet assembly to tighten the strap).

Top attachment mechanism 101 comprises a top ratchet arm 104, a top strap 105, a top hook 106, a top ratchet assembly 107, a top rotatable strap coil 108, and a top release button 109.

The top strap 105 is connected to the top hook 106. When the top ratchet arm 104 is activated (moved back and forth) the top strap 105 winds to enlarge the top rotatable strap coil 108 (as the top ratchet arm 104 is activated the top rotatable strap coil 108 would grow in size as more of the top strap 105 is wound around it) thus tightening the top strap 105 around the vertical structure. The top ratchet assembly 107 houses the top release button 109 and is affixed to the body 100. The top ratchet arm 104 can swing open and closed (see FIG. 4), FIG. 1 shows the top ratchet arm 104 in the closed (locked) position. When the top ratchet arm 104 is in the closed position, the top rotatable strap coil 108 is prevented from rotating by virtue of the top ratchet arm 104 being tightly fit inside the top ratchet assembly 107 thereby pressing tightly against the top rotatable strap coil 108 and preventing it from rotating (as well as an optional spring which creates tension on the top rotatable strap coil 108 as well). As the top strap 105 is pulled out from the top rotatable strap coil 108, the top spring (not pictured) is wound up tighter causing more spring tension. When the top release button 109 is pressed, tension is released on the top strap rotatable strap coil 108 and it is then permitted to freely rotate, wherein the spring tension will then automatically cause the top strap rotatable strap coil 108 to rotate (in the opposite direction of when the top strap 105 was pulled out) thereby automatically winding up the top strap 105 in the top strap rotatable strap coil 108.

As such, the top ratchet arm 104 can be opened, and the top strap 105 can be wound around a vertical structure (such as a tree) and connected back to the top ratchet assembly 107, tightened, and then the top ratchet arm 104 can then be closed creating a tight loop of the top strap 105 around the vertical structure.

Similarly, the bottom attachment mechanism 102 comprises a bottom a bottom ratchet arm 114, a bottom strap 115, a bottom hook 116, a bottom ratchet assembly 117, a bottom rotatable strap coil 118, and a bottom release button 119.

The bottom strap 115 is connected to the bottom hook 116. When the bottom ratchet arm 114 is activated (moved back and forth) the bottom strap 115 winds to enlarge the bottom rotatable strap coil 118 (as the bottom ratchet arm 114 is activated the bottom rotatable strap coil 118 would grow in size as more of the bottom strap 115 is wound around it) thus tightening the bottom strap 115 around the vertical structure. The bottom ratchet assembly 117 houses the bottom release button 119 and is affixed to the body 100. The bottom ratchet arm 114 can swing open and closed (in the same manner as the bottom ratchet arm 114 swings as illustrated in FIG. 4), FIG. 1 shows the bottom ratchet arm 114 in the closed (locked) position. When the bottom ratchet arm 114 is in the closed position, the bottom rotatable strap coil 118 is prevented from rotating by virtue of the bottom ratchet arm 114 being tightly fit inside the bottom ratchet assembly 117 thereby pressing tightly against the bottom rotatable strap coil 118 and preventing it from rotating (as well as an optional spring which creates tension on the bottom rotatable strap coil 118 as well). As the bottom strap 115 is pulled out from the bottom rotatable strap coil 118, the bottom spring (not pictured) is wound up tighter causing more spring tension. When the bottom release button 119 is pressed, tension is released on the bottom strap rotatable strap coil 118 and it is then permitted to freely rotate, wherein the spring tension will then automatically cause the bottom strap rotatable strap coil 118 to rotate (in the opposite direction of when the bottom strap 115 was pulled out) thereby automatically winding up the bottom strap 115 in the bottom strap rotatable strap coil 118.

As such, the bottom ratchet arm 114 can be opened, and the bottom strap 115 can be wound around the vertical structure and connected back to the bottom ratchet assembly 117, tightened, and then the bottom ratchet arm 114 can then be closed creating a tight loop of the bottom strap 115 around the vertical structure.

Both straps can be, for example one inch wide and four feet long, although of course any other dimensions can be used as well.

Figure 2:
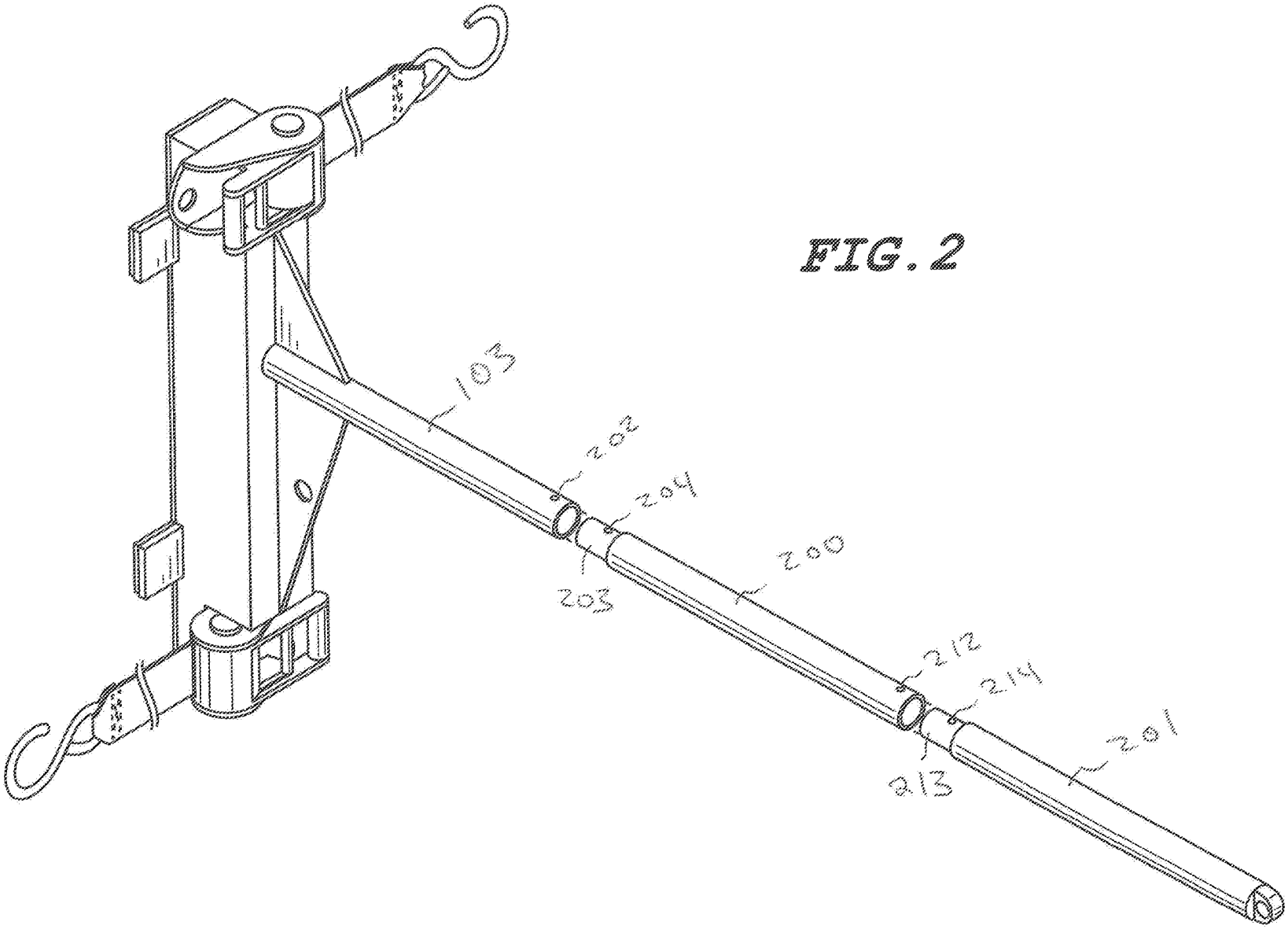
FIG. 2 is a drawing illustrating assembly of the connectors of the portable exercise apparatus, according to an embodiment.

FIG. 2 is a drawing illustrating assembly of the connectors of the portable exercise apparatus, according to an embodiment.

The integrated connector 103 (is permanently attached to the body 100) and removably attaches to the middle connector 200 which removable attaches to the end connector 201. Removably attaches means that when attached the attachment is firm and the end connector 201 can support a large weight (e.g., 500 lbs.), but all connectors can be disassembled easily into the separate connectors when desired (by pressing the respective buttons). Note that the integrated connector 103 is directly and fixedly attached to the body 100, that is, the integrated connector cannot rotate in any direction.

The integrated connector 103 comprises an integrated connector hole 202. The middle connector 200 comprises a middle connector recessed edge 203 and a middle connector button 204. The middle connector recessed edge 203 is configured (structured) to fit inside the integrated connector 103 (as shown). The middle connector button 204 is configured (structured) to fit inside the integrated connector hole 202. The middle connector button 204 (and all connector buttons) can be made of metal or preferably a firm but malleable material (such as rubber, plastic, etc.) so it can deform slightly when the middle connector 200 is inserted inside the integrated connector 103 so that the middle connector recessed edge 203 will fit inside the integrated connector 103 and when the middle connector button 204 is positioned under the integrated connector hole 202 the middle connector button 204 would "snap" (and expand) inside the integrated connector hole 202 so that the middle connector 200 is now firmly attached to the integrated connector 103. The middle connector 200 can be detached (disassembled) from the integrated connector 103 by pressing on the middle connector button 204 and removing the middle connector 200 from the integrated connector 103.

The end connector 201 attaches to the middle connector 200 in the same way that the middle connector 200 attaches to the integrated connector 103. The middle connector 200 comprises a middle connector hole 212. The end connector 201 comprises an end connector recessed edge 213 and an end connector button 214. The end connector recessed edge 213 is configured (structured) to fit inside the middle connector 200 (as shown). The end connector button 214 is configured (structured) to fit inside the middle connector hole 212. The end connector button 214 (and all connector buttons) can be made of metal or preferably a firm but malleable material (such as rubber, plastic, etc.) so it can deform slightly when the end connector 201 is inserted inside the middle connector 200 so that the end connector recessed edge 213 will fit inside the middle connector 200 and when the end connector button 214 is positioned under the middle connector hole 212 the end connector button 214 would "snap" (and expand) inside the middle connector hole 212 so that the end connector 201 is now firmly attached to the middle connector 200. The end connector 201 can be detached (disassembled) from the middle connector 200 by pressing on the end connector button 214 and removing the end connector 201 from the middle connector 200.

Thus, to assemble the bar, the user (typically after affixing the body to the vertical structure) attaches the middle connector 200 to the integrated connector 103 and the end connector 201 to the middle connector 200. To disassemble the connectors, the middle connector button 204 can be pressed and the middle connector 200 can be removed from the integrated connector 103, and the end connector button 214 can be pressed and the end connector 201 can be removed from the middle connector 200.

The integrated connector 103, middle connector 200, and end connector 201 should all typically be the same width (e.g., one inch, 1.25 inch, or any other amount). The integrated connector 103, middle connector 200, and end connector 201 can each be any length, such as 13 inches each (or any other length).

Note that while the middle connector 200 and the end connector 201 are shown having the recessed edge, any of the connectors can have the recessed edge (and button) which fits into an adjacent connector (with corresponding hole to receive the respective button). Thus, in other words, the integrated connector can have the recessed edge (and button) instead of the hole and the middle connector can have the hole and which receives the recessed edge of the integrated connector.

Figure 3:
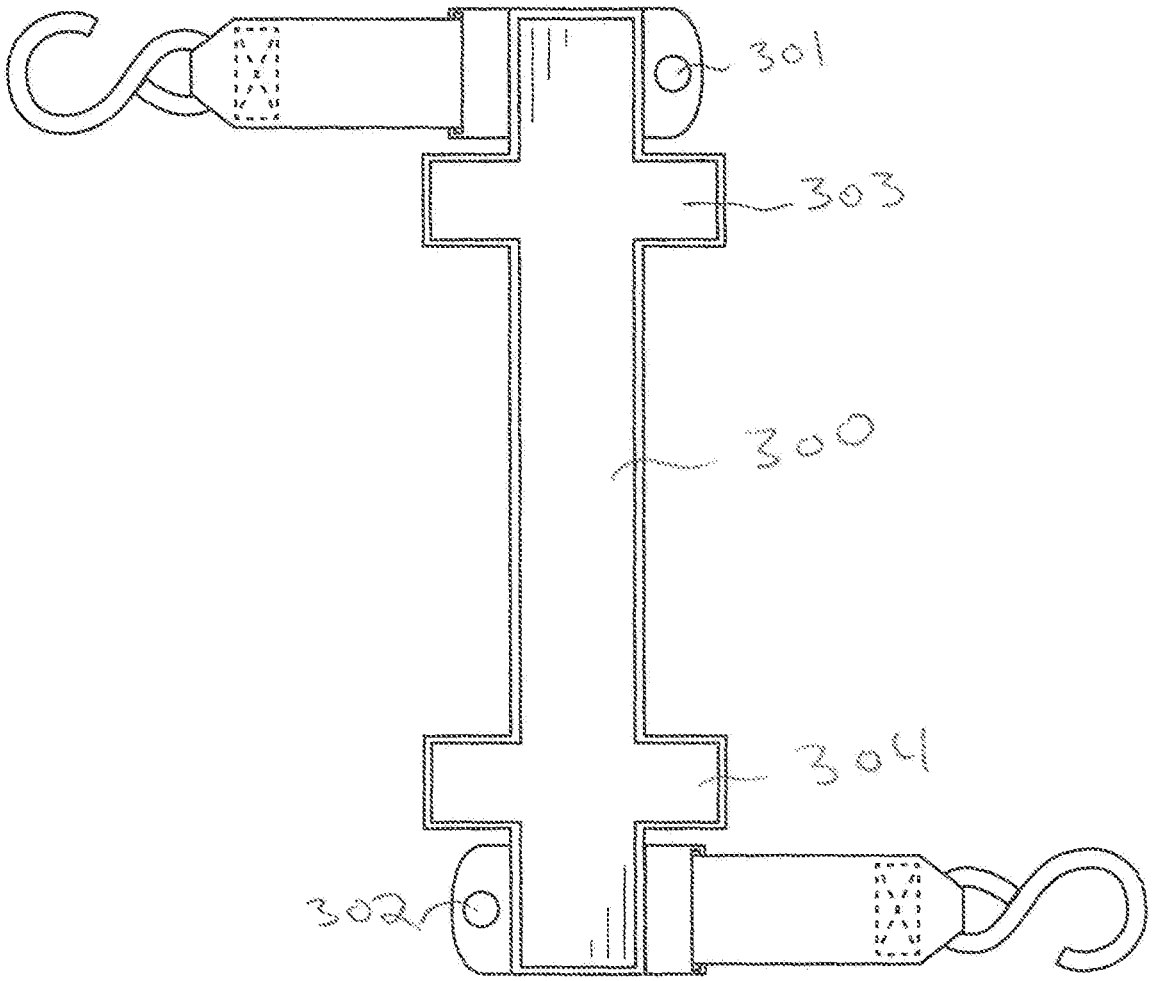
FIG. 3 is a drawing of a back view of the portable exercise apparatus, according to an embodiment.

FIG. 3 is a drawing of a back view of the portable exercise apparatus, according to an embodiment.

A body back 300 is a portion of the body that is pressed against the vertical structure. The body back 300 can be coated with a rubber coating (or other similar non-slip coating such as silicone, etc.) to prevent sliding of the body 100 down the vertical structure. A top hole 301 is present on the top ratchet assembly 107, and a bottom hole 302 is present in the bottom ratchet assembly 117. The top hole 301 is used to receive the top hook 106 when the top strap 105 is wrapped tightly around the vertical structure. The bottom hole 302 is used to receive the bottom hook 116 when the bottom strap 115 is wrapped tightly around the vertical structure.

An upper support 303 and a lower support 304 are present on the body back 300 and would abut the vertical structure being used.

FIG. 4 is a drawing illustrating a top view of a top attaching mechanism in an unsecured position, according to an embodiment.

The vertical structure 400 is shown abutting the body back 300. The top ratchet arm 104 is in the closed position although the open position 401 of the top ratchet arm 104 is shown in broken lines (the bottom ratchet arm 114 operates in the same manner).

FIG. 5 is a drawing illustrating a top view of the top attaching mechanism in a secured position, according to an embodiment.

The top strap 105 is wrapped tightly around the vertical structure 400 and the top hook 106 is hooked into the top hole 301. The user can crank the top ratchet arm 104 back and forth until the top strap 105 is very tight around the vertical structure. The top ratchet arm 104 is pressed into the closed position thereby locking the top rotatable strap coil 108 from rotating thereby securing the top strap 105 around the vertical structure. The bottom strap 115 operates similarly to secure the body 100 to the vertical structure 400 utilizing its counterparts on the bottom attachment mechanism.

Figure 6:
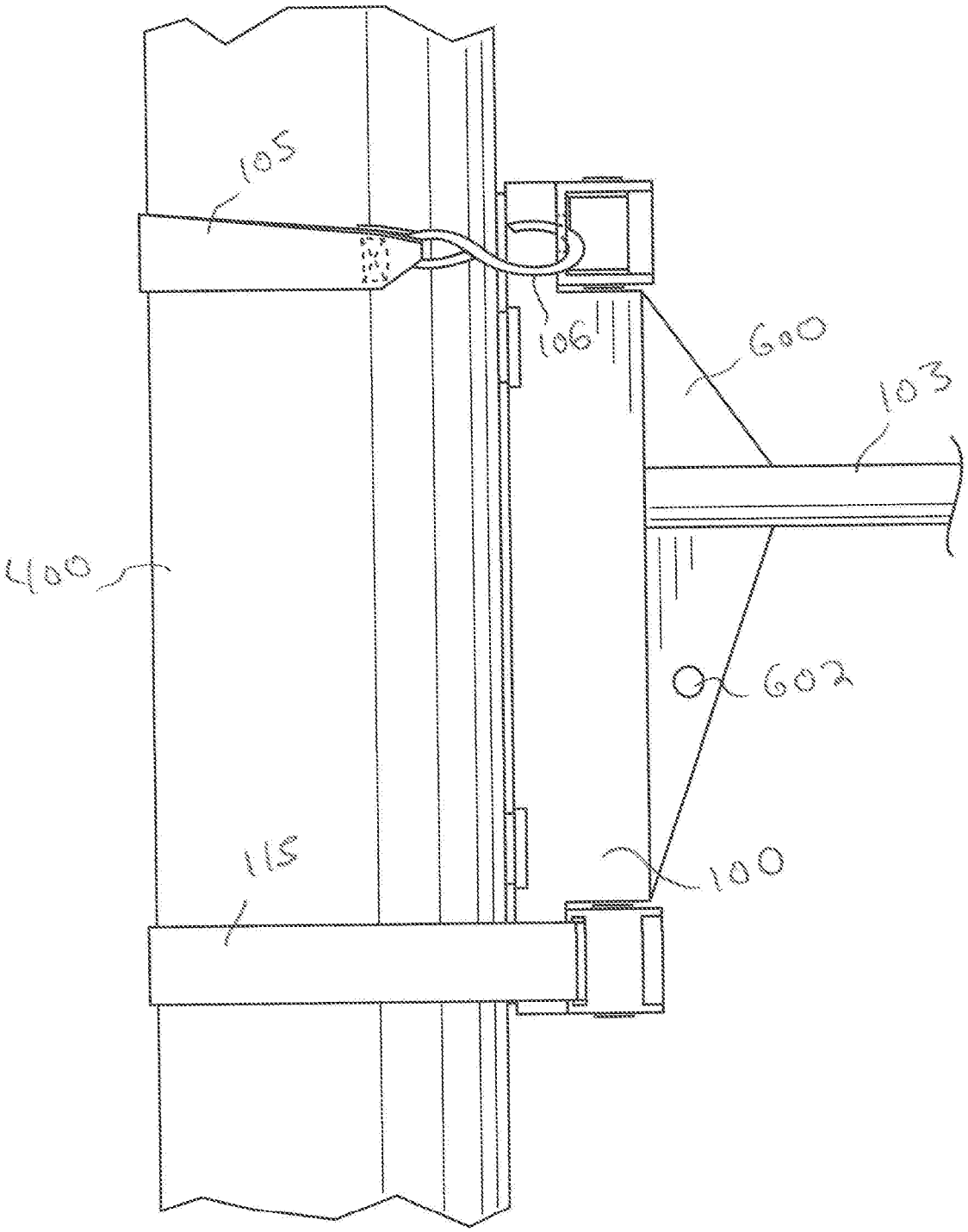
FIG. 6 is a drawing illustrating the portable exercise apparatus secured to a tree, according to an embodiment.

FIG. 6 is a drawing illustrating the portable exercise apparatus secured to a tree, according to an embodiment.

The top strap 105 is tightly wrapped around the vertical structure 400 with the top hook 106 securely hooked onto the top hole 301. The bottom strap 115 is tightly wrapped around the vertical structure 400 with the bottom hook 116 securely hooked onto the bottom hole 302 (not visible in FIG. 6).

A top triangular plate 600 and a bottom triangular plate 601 provide support between the body 100 and the integrated connector 103. A bottom triangular plate hole 602 is a hole in the bottom triangular plate 601 which can be used to receive any type of hook which can be attached to any other type of exercise mechanism (e.g., a pulley, resistance strap, etc.) so other exercises can be utilized with the portable exercise apparatus.

Figure 7:
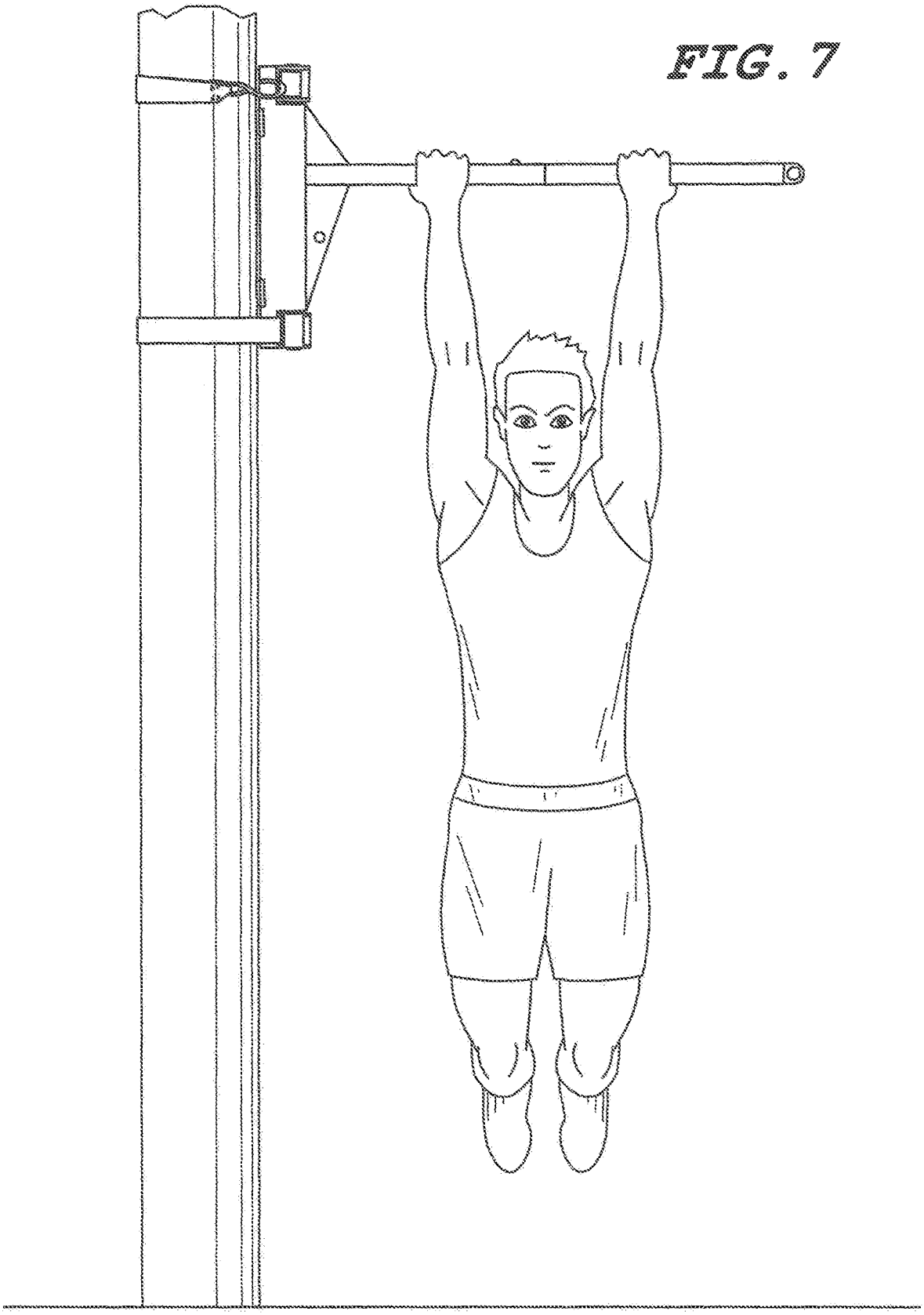
FIG. 7 is a drawing illustrating a potential use of the installed portable exercise apparatus, according to an embodiment.

FIG. 7 is a drawing illustrating a potential use of the installed portable exercise apparatus, according to an embodiment.

Shown is one possible use of the portable exercise apparatus. A user can utilize the portable exercise apparatus to do pull-ups, chin-ups, etc. A hook connected to a resistance strap (a strap which flexes when pulled) can be connected to the bottom triangular plate hole 602 so the user can perform other exercises as well (e.g., repeatedly pulling the resistance strap).

Note that the integrated connector is at a 90 degree angle (perpendicular) from a length of the body. The middle and end connectors are also at a 90 degree angle from the length of the body (e.g., the middle and end connectors extend the length of the integrated connector). Note that the integrated connector (and/or the middle connector and/or end connector) do not have to be at exactly a 90 degree angle with respect to the length of the body can be substantially at a 90 degree angle (e.g., 80 to 100 degrees).

Figure 8:
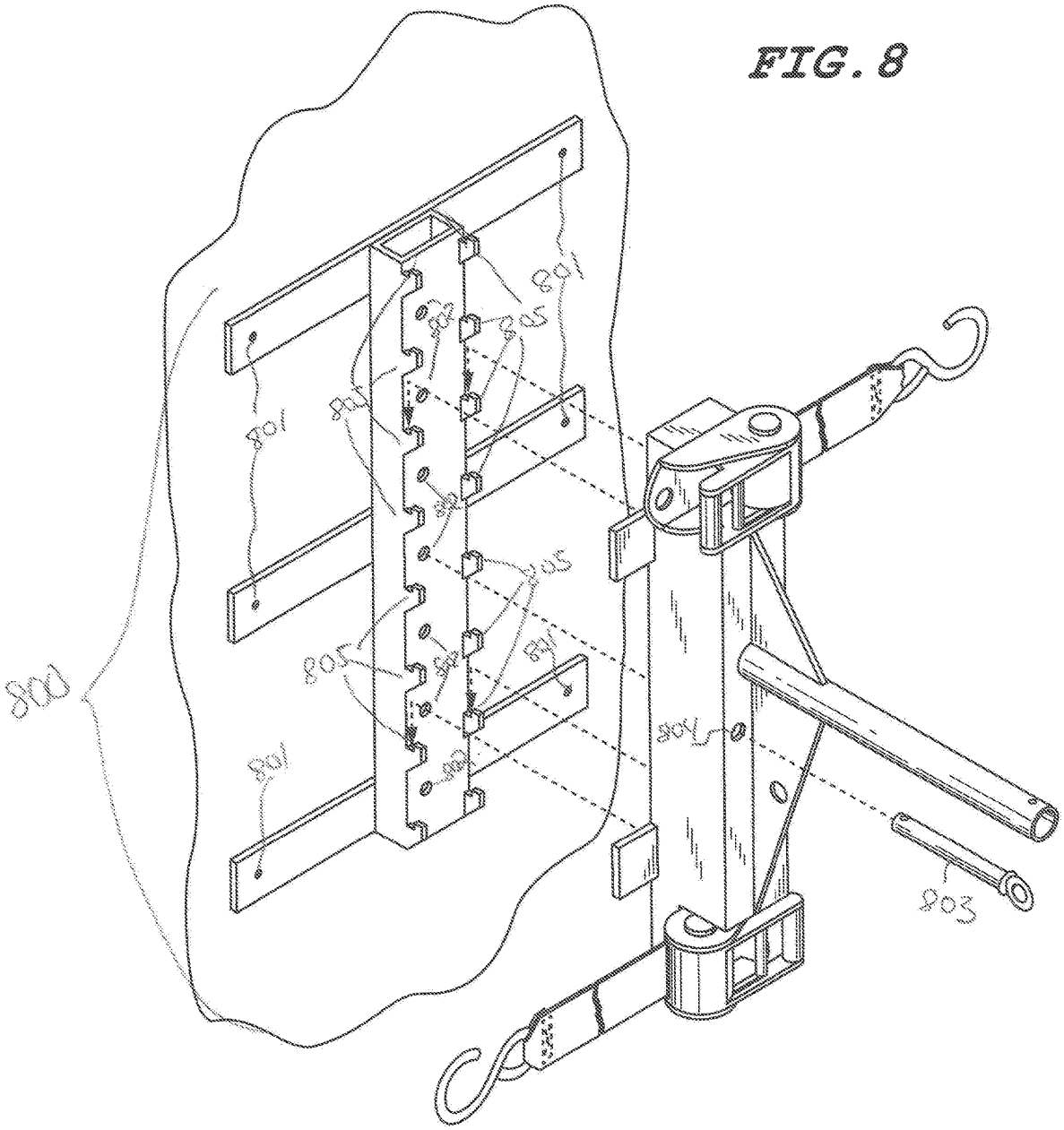
FIG. 8 is a drawing illustrating a wall mount used with the portable exercise apparatus, according to an embodiment.

FIG. 8 is a drawing illustrating a wall mount used with the portable exercise apparatus, according to an embodiment.

In this embodiment, the portable exercise apparatus can mount to a wall unit 800 which is permanently mounted onto a wall. In this embodiment, the straps (top strap 105 and bottom strap 115) are not needed to mount the portable exercise apparatus.

The wall unit 800 can be mounted to the wall via attachment units 801 (e.g., screws, nails, etc.) A set of wall unit holes 802 are configured to receive a key 803. A key hole 804 in the body 100 receives the key 803 which then inserts into one of the wall unit holes 802. A set of hooks 805 on the wall unit 800 is used to fit into grooves 900 on the back side of the body 100 (which are shown in FIG. 9).

Figure 9:
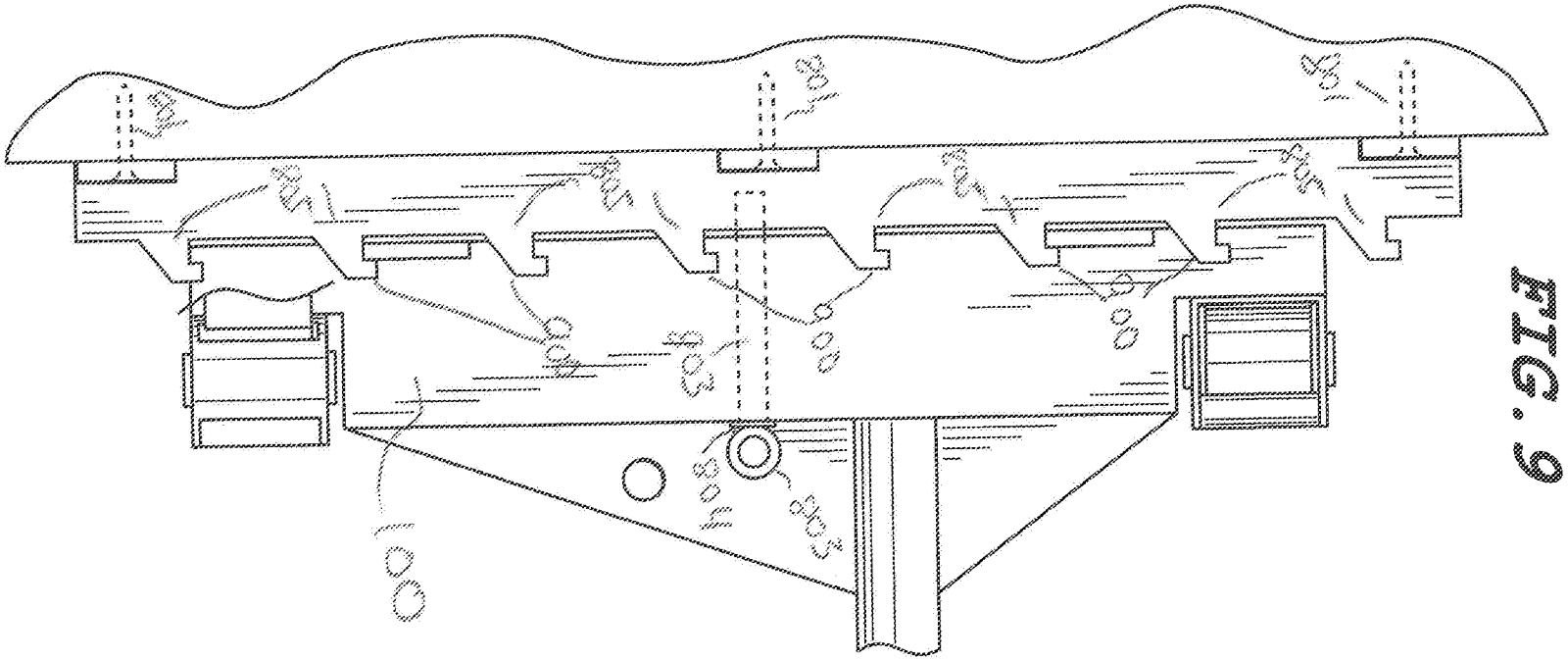
FIG. 9 is a drawing illustrating a side view of the portable exercise apparatus attached to a wall mount, according to an embodiment.

FIG. 9 is a drawing illustrating a side view of the portable exercise apparatus attached to a wall mount, according to an embodiment.

A set of grooves 900 on the back side of the body 100 is configured to fit onto the hooks 805 on the wall unit 800.

As such, the body 100 can be placed on the wall unit 800 at any one of a number of discrete heights by positioning the body to the desired height, hooking the body 100 on to a respective hook on the wall unit 800 and then inserted the key 803 through the key hole 804 and into a respective hole out of the wall unit holes 802. Once the body 100 is attached to the wall unit 800 in this manner, then the user can assemble the connectors and utilize the exercise apparatus as described herein (e.g., do pull-ups, etc.) As such, the portable exercise apparatus can also be utilized indoors as well.

Figure 10:
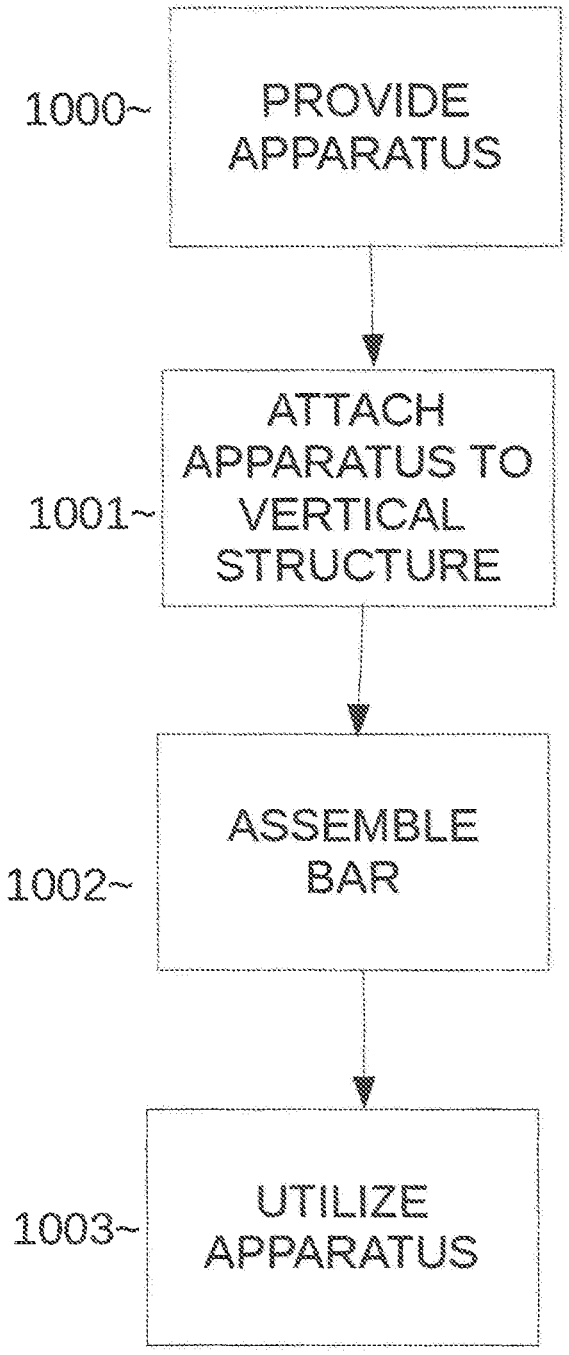
FIG. 10 is a flowchart illustrating a method of utilizing a portable exercise apparatus, according to an embodiment.

FIG. 10 is a flowchart illustrating a method of utilizing a portable exercise apparatus, according to an embodiment.

The method can begin with operation 1000, which provides the apparatus as described herein.

From operation 1000, the method proceeds to operation 1001, wherein the user attaches the apparatus to a vertical structure (e.g., a tree). This can be done as described herein.

From operation 1001, the method proceeds to operation 1002, wherein the user assembles the bar. This can be done as described herein (e.g., attaching all of the three connectors together).

From operation 1002, the method proceeds to operation 1003, wherein the user utilizes the apparatus by performing exercises (or other physical activities) using the apparatus.

Note that in a further embodiment, the integrated connector 103 can be any size and can even be short (e.g., one inch or less). In other words, the integrated connector can be used as a connector to other devices. Other attachments besides the middle connector 200 and the end connector 201 can be attached to the integrated connector 103. For example, a split bar can be attached to the integrated connector 103, a split bar being a bar that splits into two separate bars which can be utilized for different exercises. Other attachments that can attach to the integrated connector 103 can be a chair, child swing set, tent, etc. All of these connectable devices would have a compatible connector which would connect to the integrated connector 103. A volley ball net can also have an attachment which would connect to the integrated connector 103 or instead the volley ball net can have a hook on the end which can hook into the bottom triangular plate hole 602 (or any other hole in the apparatus). Note that holes can be placed (punched) anywhere in the apparatus which can be used for attaching hooks which are attached to any type of equipment (e.g., nets, tents, etc.) Also, in a further embodiment, the integrated connector does not have to extrude outside of the body but can instead be internal to the body (e.g., a recessed area inside the body such as a hole where another connector would be inserted inside the recessed area in the body and firmly connect using a button/hole (or other mechanism) as described herein or known in the art (e.g., the recessed area inside the body can have threads and an attachment which connects inside the recessed area would have corresponding threads which would screw into the threaded recessed area). As such, the integrated connector can extrude or be recessed and serve as a connector to connect a lot of different types of apparatuses/equipment which have their own connector adapted to connect to the integrated connector.

Note that many attachments will now be shown/described which will attach to the integrated connector 103 or the middle connector 200 connected to the integrated connector 103 (depending on how long the user wishes the cantilever bar to extend from the apparatus, as the user can choose whether to attach the attachment directly to the integrated connector 103 or attach the middle connector 200 to the integrated connector 103 and then attach the attachment to the middle connector 200). Note that the figures may not show the rest of the apparatus but for the integrated connector 103, as there is no need to show the remaining apparatus in these figures since the entire apparatus was already illustrated in its entirety. It can be assumed than anywhere the integrated connector 103 is illustrated (or 103/200), it is firmly attached to a tree (or other vertical structure) so the attachments described herein can be used. The notation "103/200" in the figures means the attachment can attach directly to the integrated connector 103 or to the middle connector 200 which is attached to the integrated connector 103. Note also that the integrated connector 103 can be any length, so with a longer integrated connector 103, it would extend an adequate distance from the tree (or other elevated structure) and hence no middle connector 200 would be needed.

Figure 11:
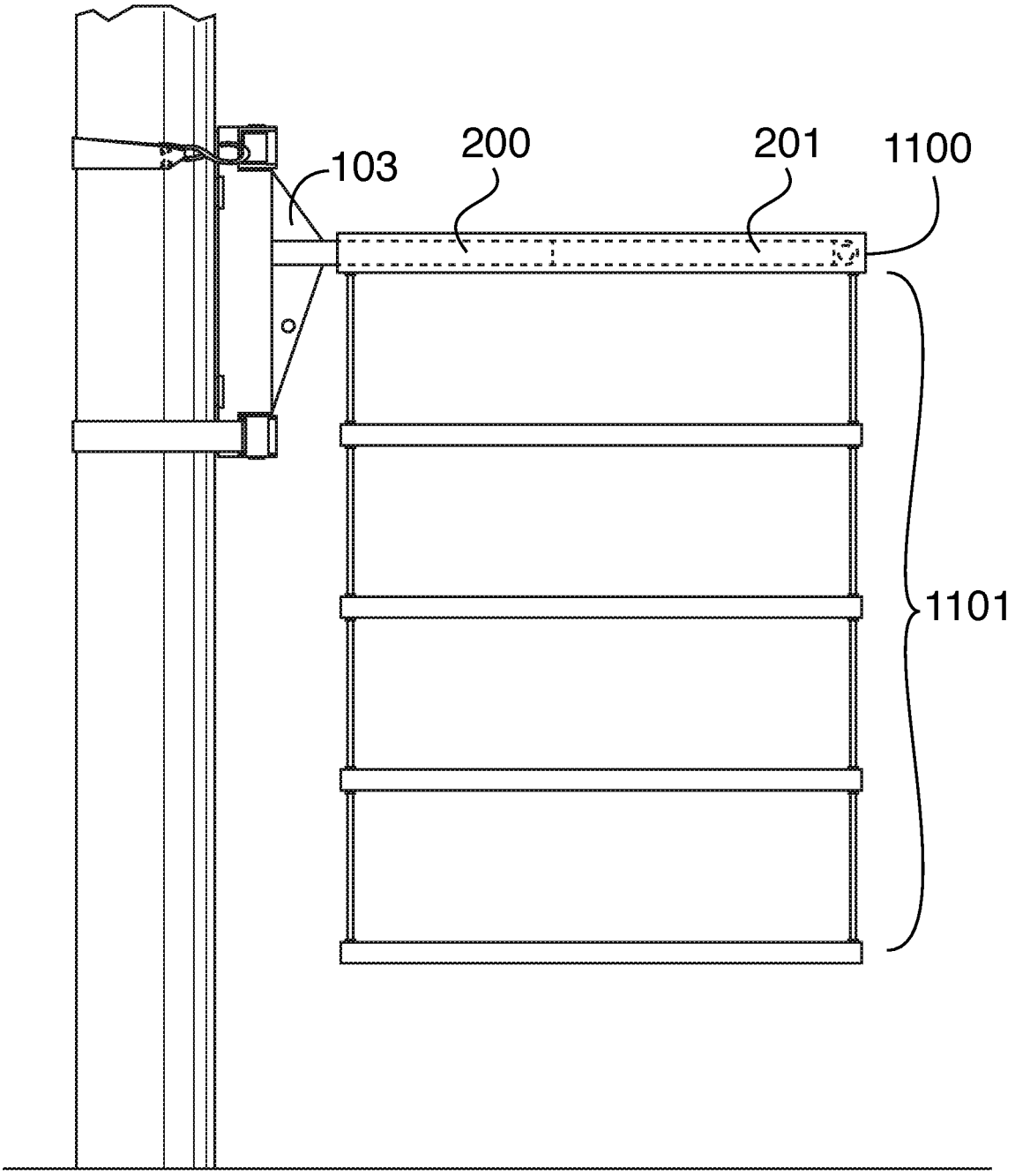
FIG. 11 is a drawing showing a sleeve with a rung game, according to an embodiment.

FIG. 11 is a drawing showing a sleeve with a rung game, according to an embodiment.

Figure 15:
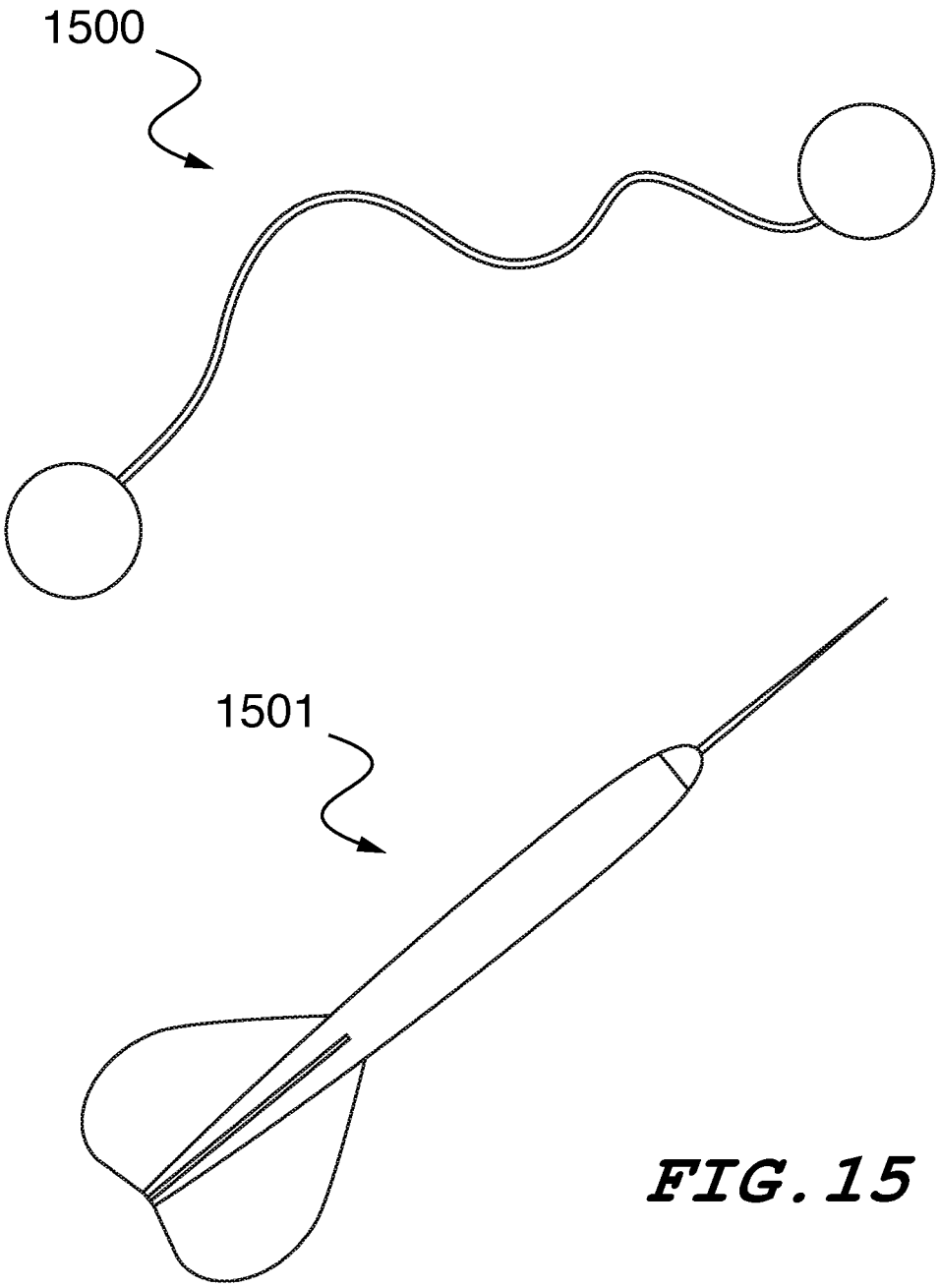
FIG. 15 is a drawing showing articles for playing games, according to an embodiment.

A sleeve 1100 (made of any material, such as plastic, vinyl, etc.) can fit over the integrated connector 103, middle connector 200 and end connector 201 (in some embodiments there is only middle connector 200 but not the end connector 201). The sleeve 1100 is connected to a ladder 1101. The ladder can be used for climbing or for a ladder ball game. FIG. 15 shows a pair of balls 1500 interconnected by a string/rope which can be used to play a game with the ladder 1101. The pair of balls 1500 can be thrown at the ladder 1101 with the objective of draping the pair of balls 1500 over a rung of the ladder.

All of the parts "snap together" as described herein, that is using a button/hole configuration wherein the button snaps into the corresponding hole on an adjacent piece. To remove the piece, the user presses into the button, which allows the pieces to be separated. Note that the piece which is smaller in diameter typically has the button and the part with the larger diameter typically has the hole. Note that which piece fits into which piece could be reversed. For example, consider an end of a first piece is larger in diameter than an end of a second piece which connects into the end of piece X, in which the end of the second piece has the button and the end of the first piece has the hole, so that the end of the second piece fits into the end of the first piece (thereby causing the button to snap into the hole). The connecting parts could be reversed so that the end of the first piece is smaller in diameter than the end of the second piece and thus the end of the second piece would have the hole and the end of the first piece would have the button. As such, any configuration of connections can be used in order to enable the pieces to fit together (and also be removable) as intended (described). Note that all such attachments are removable, that is the parts can be easily attached and easily disconnected (removed from each other), allowing for easy assembly and the easy storage (once disassembled).

Figure 12:
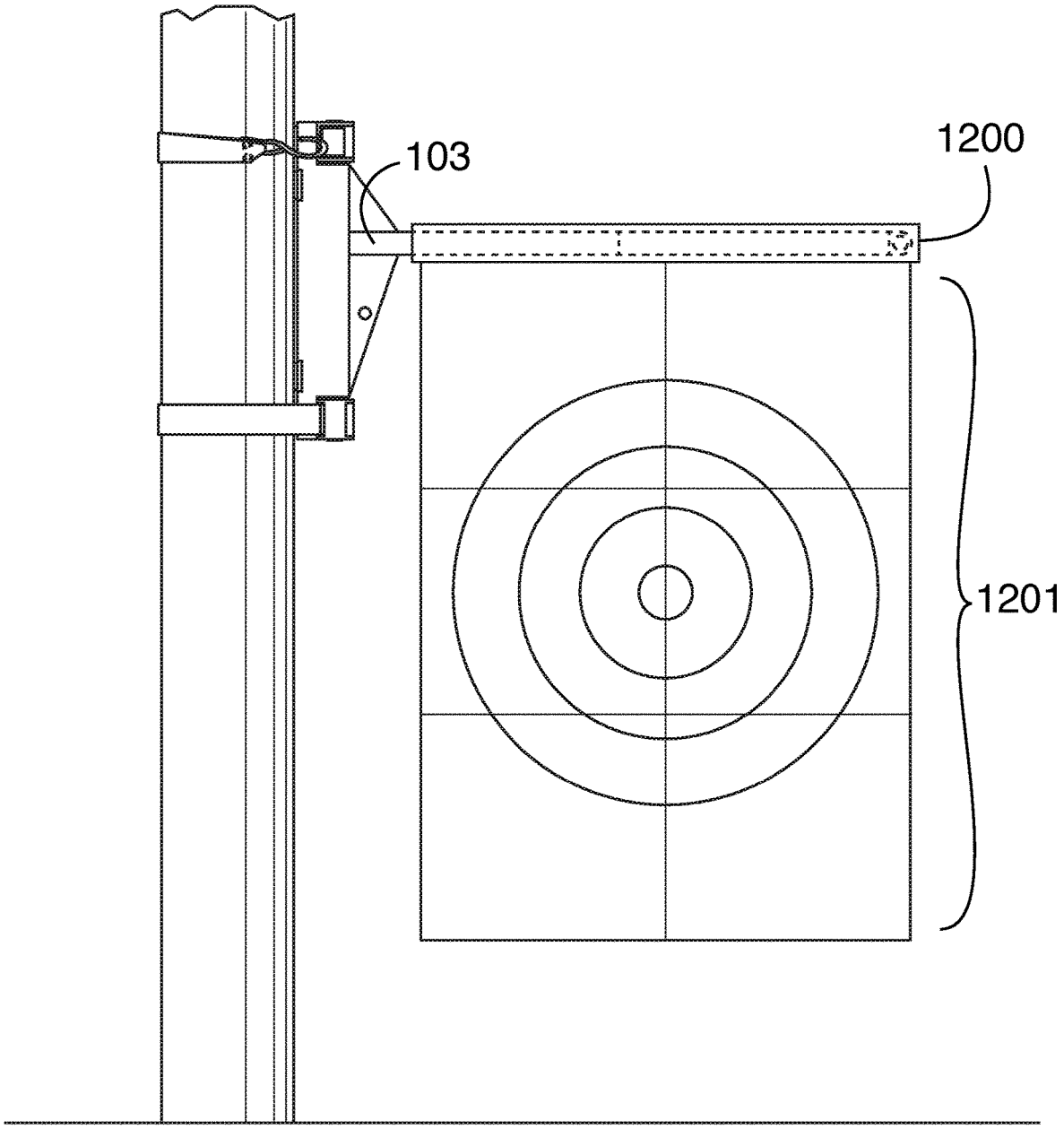
FIG. 12 is a drawing showing a sleeve with a target game, according to an embodiment.

FIG. 12 is a drawing showing a sleeve with a target game, according to an embodiment.

A sleeve 1200 (all sleeves herein and attached equipment can be made of any material, such as plastic, vinyl, etc.) is attached to a target 1201. The target 1201 can be made of any material, such as plastic, wood, cork, etc. If made out of wood or cork (or other foldable material), the Target can fold up for example in 6 sections. When the sleeve 1200 is removed from the connectors 103, 200, 201, then it can fold up for easy storage. The target 1201 can be used with a dart 1501 such as the one shown in FIG. 15.

Figure 13:
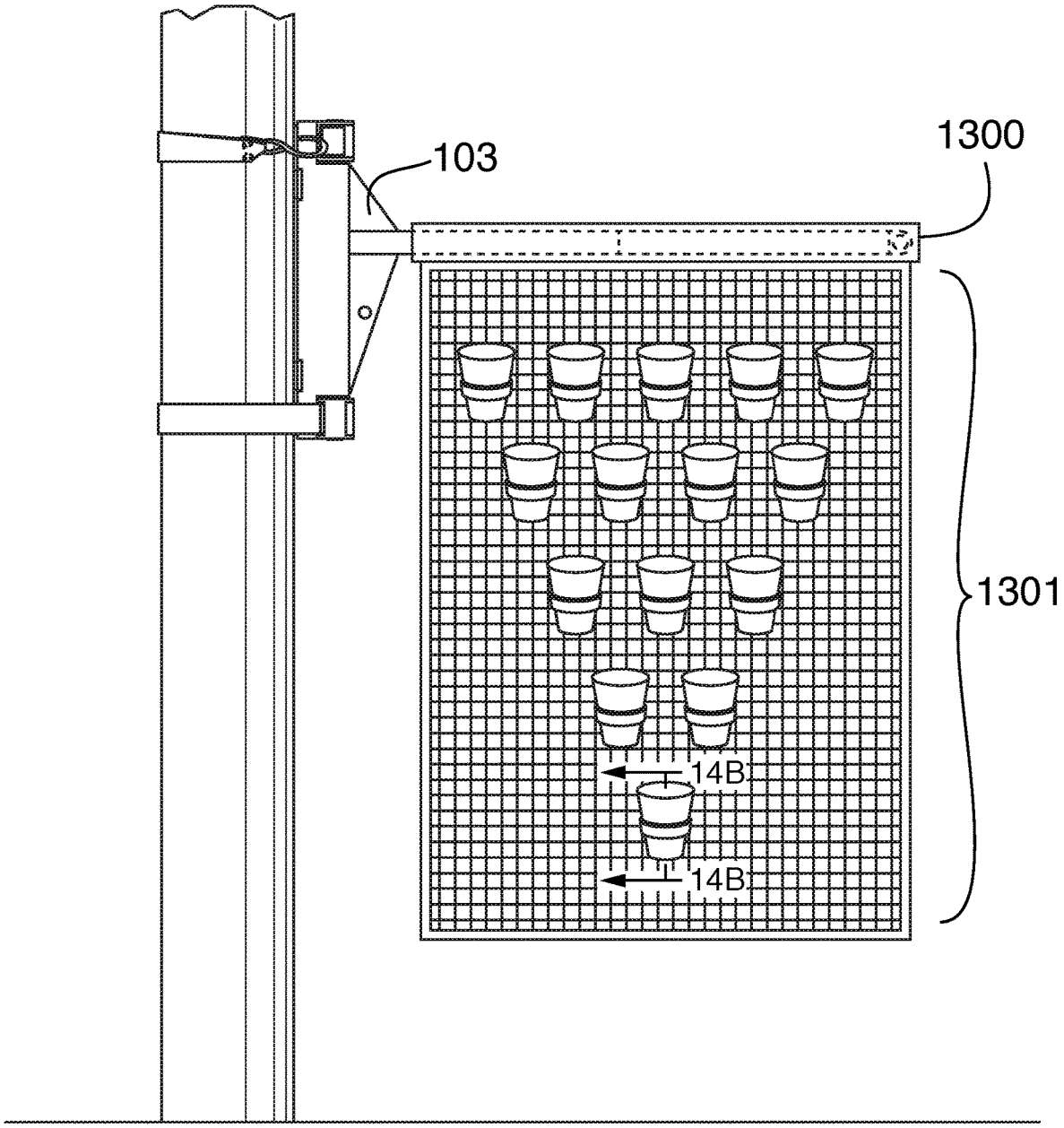
FIG. 13 is a drawing showing a cup toss game, according to an embodiment.

FIG. 13 is a drawing showing a cup toss game, according to an embodiment.

FIG. 13 shows a sleeve 1300 attached to a cup and ball game built into a net 1301. The idea is to throw balls into the cups. While 15 cups are shown, it can be appreciated that any number of cups can be used. Furthermore cups can be on both sides the net (shown is just the front of the net 1301). Players can attempt to throw the ball from a distance into the cups.

Figure 14A:
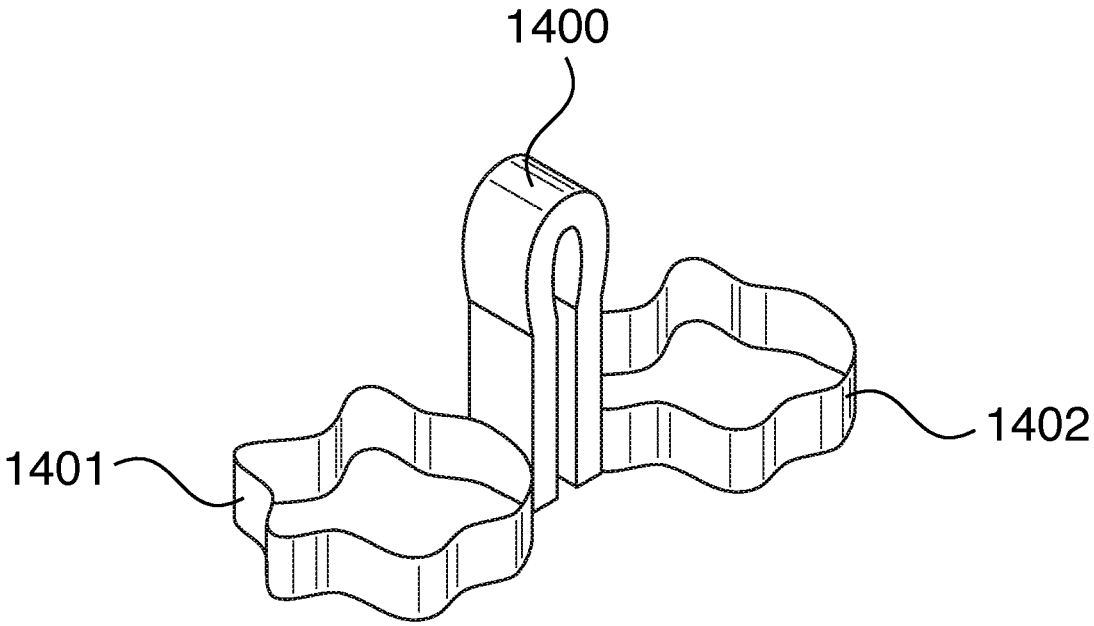
FIG. 14A is a drawing showing a cup holder for the cup toss game, according to an embodiment.

FIG. 14A is a drawing showing a cup holder for the cup toss game, according to an embodiment.

A clip 1400 is connected to a first holder 1401 and a second holder 1402. The clip attaches to the net 1301. Shown in FIG. 13 is 15 clips, each with two cups (in FIG. 13 the rear cups are not visible). The first holder 1401 and the second holder 1402 can be elastic to grip onto its respective cup.

Figure 14B:
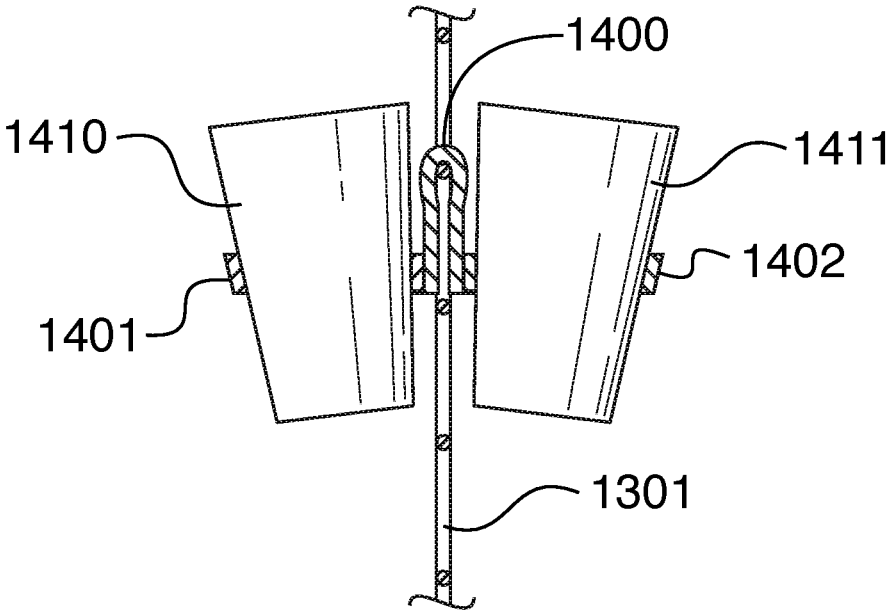
FIG. 14B is a drawing showing cups inserted into the cup holder for the cup toss game, according to an embodiment.

FIG. 14B is a drawing showing cups inserted into the cup holder for the cup toss game, according to an embodiment.

A first cup 1410 is inserted into the first holder 1401 and a second cup 1411 is inserted into the second holder 1402. The clip 1400 clips onto the net 1301 and holds/supports its two cups.

FIG. 15 is a drawing showing articles for playing games, according to an embodiment.

Shown is a pair of balls 1500 which can be used for the ladder ball game shown in FIG. 11. Also shown is a dart 1501 which can be used for the target which is shown in FIG. 12.

The integrated connector 103 can be attached to a hammer pull-up apparatus, which is illustrated in FIGS. 16-17A and 17B.

Figure 16:
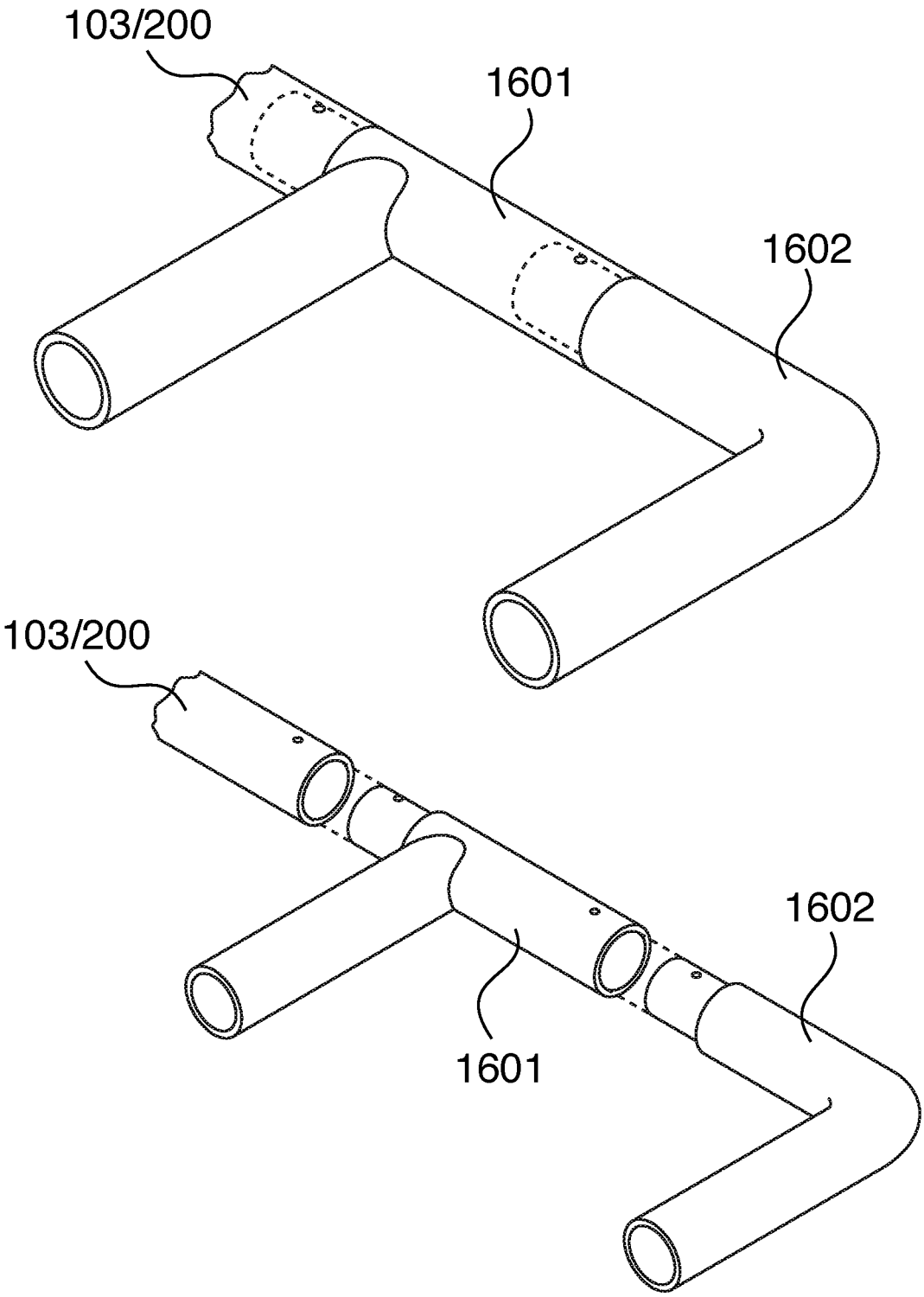
FIG. 16 is a drawing parts for hammer pull-ups, according to an embodiment.

FIG. 16 is a drawing parts for hammer pull-ups, according to an embodiment.

Hammer pull-ups are pull ups in which a user grabs a separate bar (but both bars are parallel) and pulls up. The integrated connector 103 is connected to a first bar connector 1601 which is connected to a second bar connector 1602. The top of FIG. 16 shows all three parts (the integrated connector 103, the first bar connector 1601, the second bar connector 1602) all connected and ready for use. The bottom of FIG. 16 shows all three parts (the integrated connector 103, the first bar connector 1601, and the second bar connector 1602) all separated. Instead of connecting the first bar connector 1601 directly to the integrated connector 103, the first bar connector 1601 can be connected to the middle bar 200 which is then connected to the integrated connector 103 (giving the user more distance from the tree or other vertical structure).

Figure 17A:
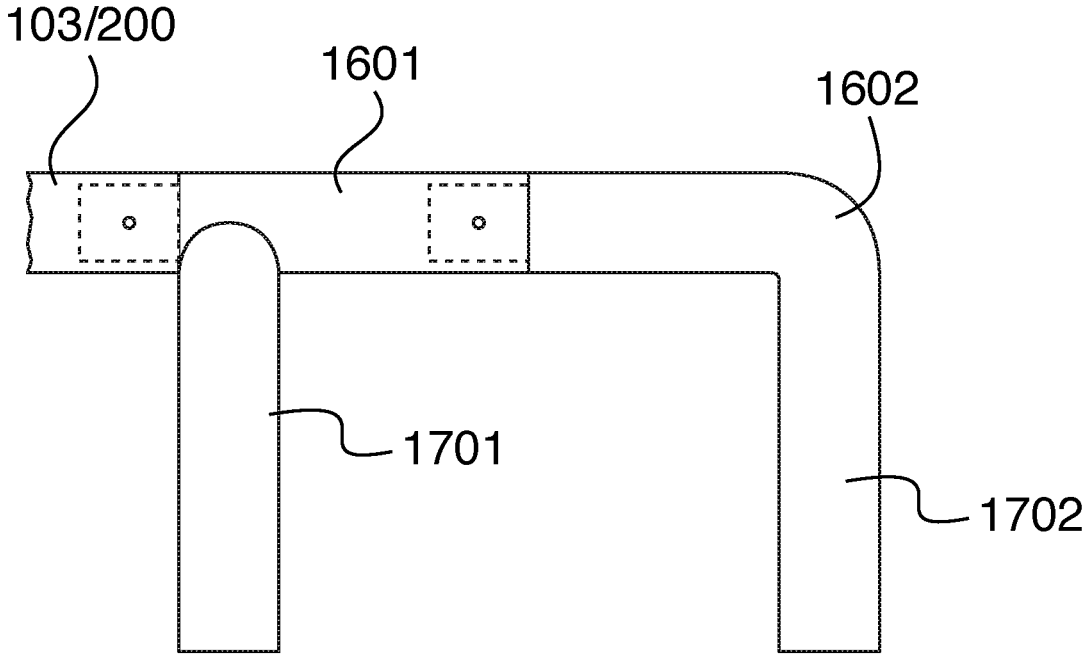
FIG. 17A is a top view showing the parts for hammer pull-ups, according to an embodiment.

FIG. 17A is top view showing the parts for hammer pull-ups, according to an embodiment.

Shown in the top view is the integrated connector 103 connected to the first bar connector 1601 which is connected to the second bar connector 1602.

Figure 17B:
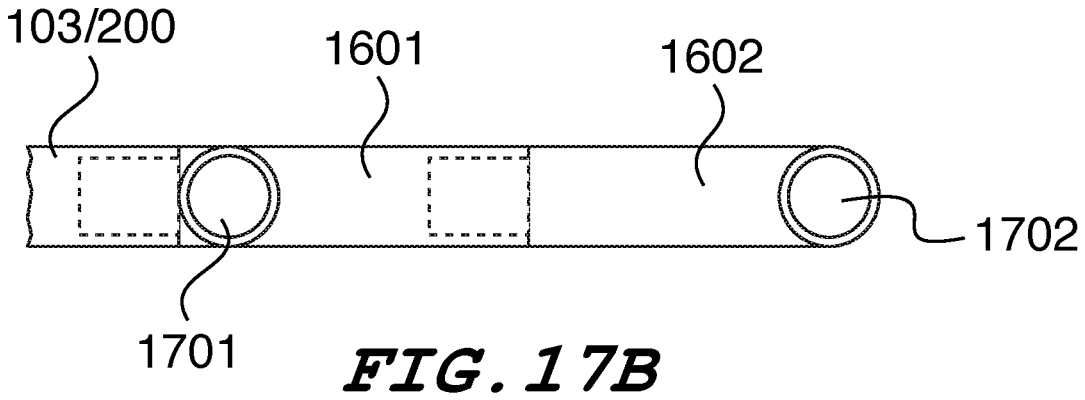
FIG. 17B is a side view showing the parts for hammer pull-ups, according to an embodiment.

FIG. 17B is a side view showing the parts for hammer pull-ups, according to an embodiment.

Shown in the side view is the integrated connector 103 connected to the first bar connector 1601 which is connected to the second bar connector 1602. A first bar handle 1701 is an integral part of the first bar connector 1601 and is what the user uses to grab onto with a first hand. A second bar handle 1702 is an integral part of the second bar connector 1602 and is what the user uses to grab onto with his/her other hand. When the user is hold onto both the first bar handle 1701 and the second bar handle 1702, then the user can do "hammer" pull-ups.

Figure 18:
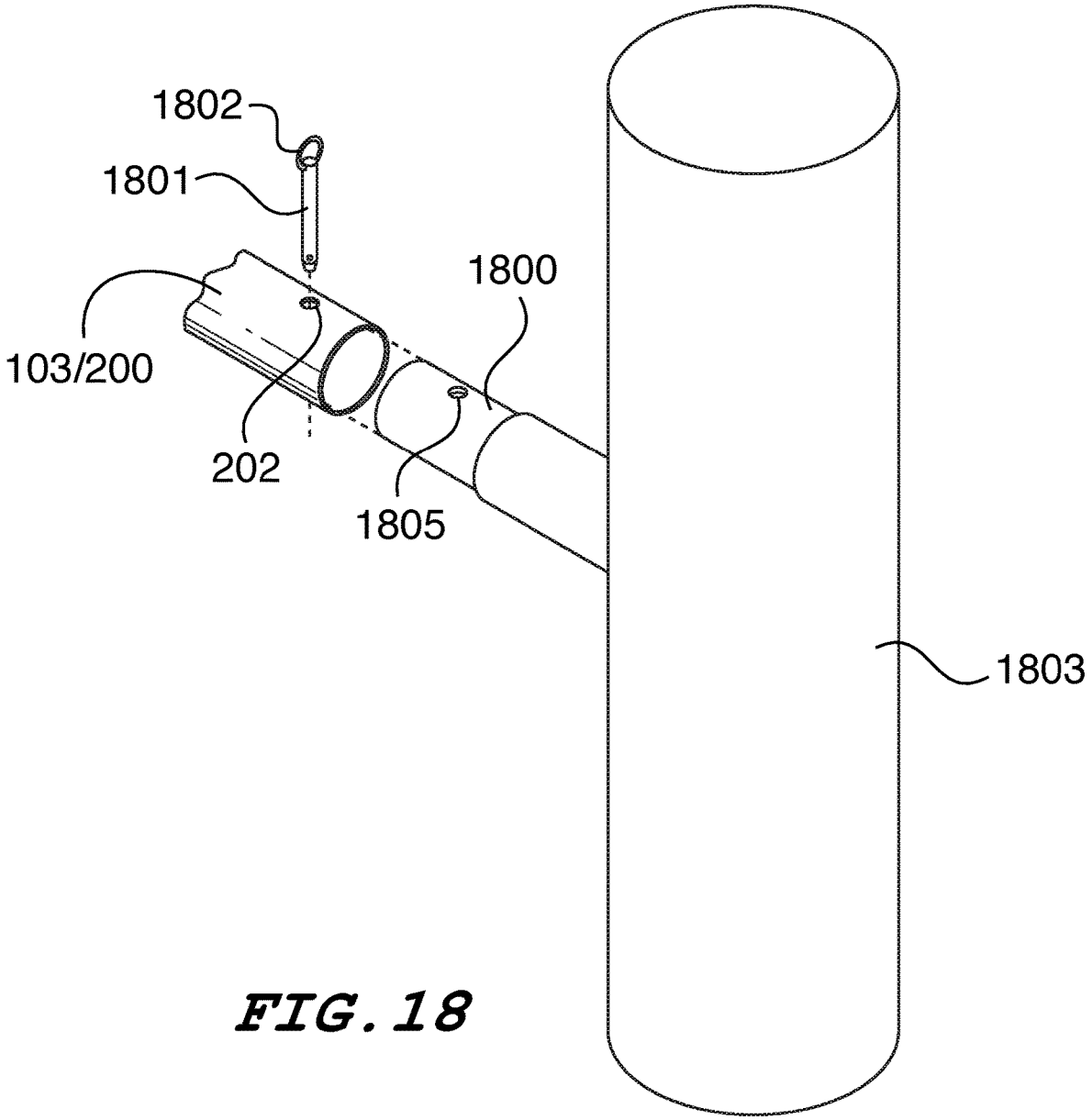
FIG. 18 is a drawing of a utility pole, according to an embodiment.
Figure 19:
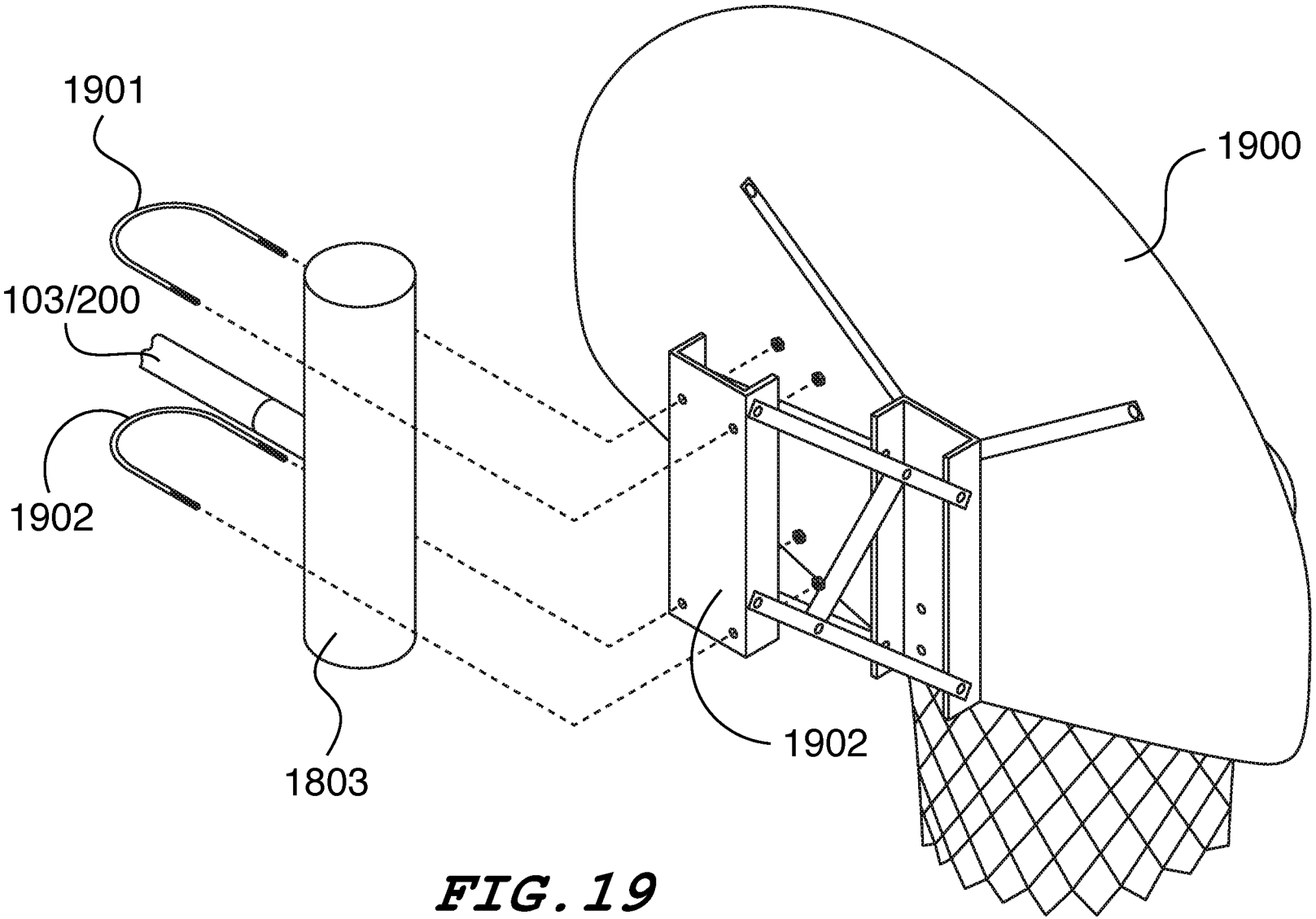
FIG. 19 is a drawing showing how a backboard attaches to the utility pole, according to an embodiment.
Figure 20:
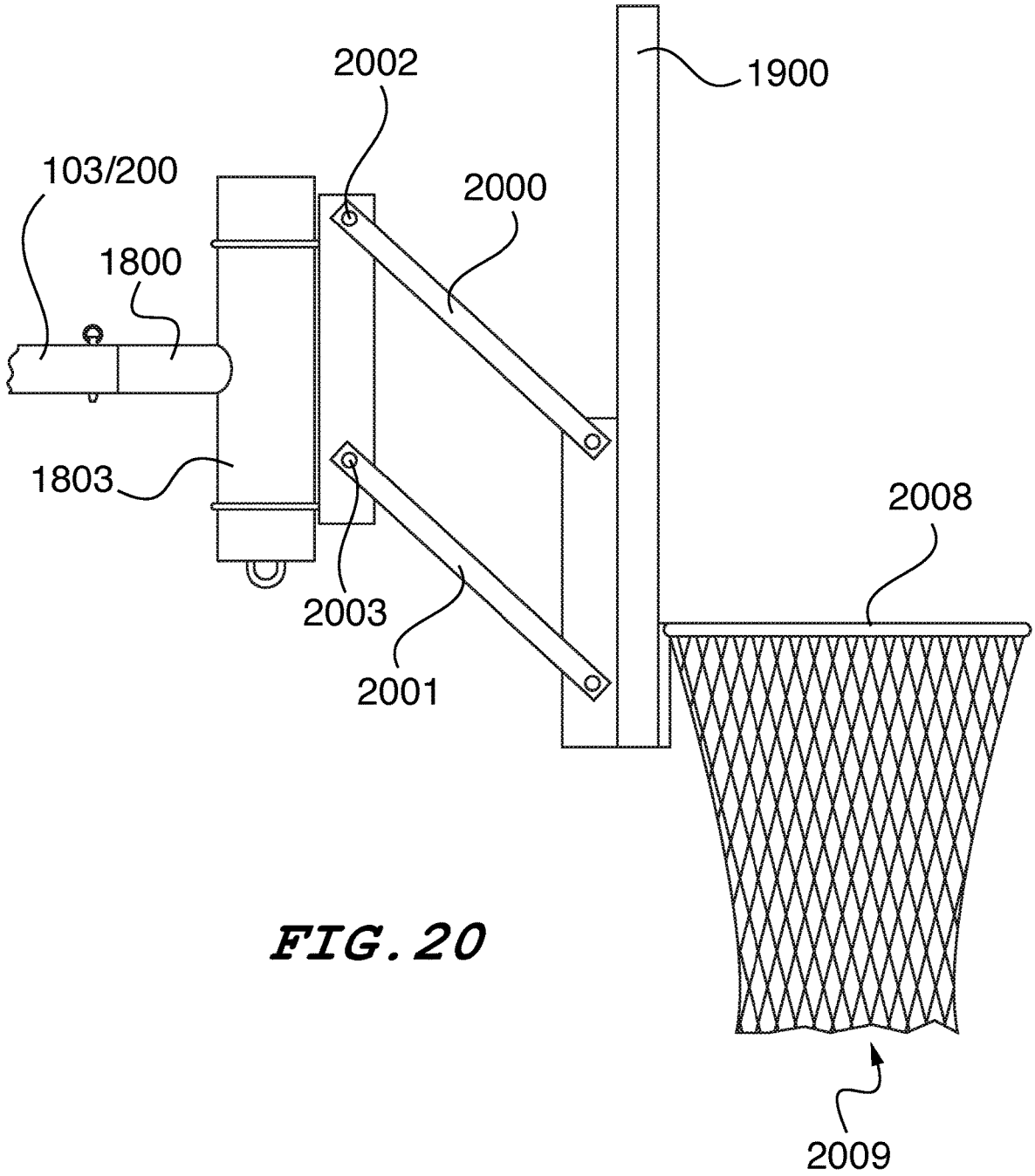
FIG. 20 is a drawing showing a connected backboard, according to an embodiment.

In another embodiment, a sports equipment such as a basketball backboard (or other sports equipment) can be attached to the integrated connector 103. FIGS. 18-20 illustrate this embodiment.

FIG. 18 is a drawing of a utility pole, according to an embodiment.

Integrated connector 103 (or middle connector 200 connected to integrated connector 103) connects to a utility pole 1803 which is integrally attached to a utility connector 1800. Note that utility connector 1800 has a utility pole connector hole 1805 instead of a button. After utility connector 1800 is inserted into integrated connector 103 and utility pole connector hole 1805 is aligned with integrated connector hole 202, a pin 1801 is inserted through both the utility pole connector hole 1805 and the integrated connector hole 202. The pin 1801 has an integral head 1802 which is larger than both the utility pole connector hole 1805 and the integrated connector hole 202 thereby preventing the pin 1801 from falling into those holes. The head 1802 can be round to facilitate a user gripping the head 1802 in order to pull the pin 1801 out of the integrated connector hole 202 and the utility pole connector hole 1805 in order to separate the utility connector 1800 from the integrated connector 103.

Note that the hole/button connection mechanism described herein can be replaced with the pin/two holes connection mechanism (e.g., pin 1801 with head 1802 fitting through two aligned holes 202 1805) illustrated in FIG. 18. Note that the button/hole connection mechanism can hold a large weight but the pin/two holes connection mechanism can support even more weight if supporting more weight is desired. Thus, the pin/two holes connection mechanism can be utilized anywhere when two parts need to be removably connected.

The utility pole 1803 can be made of metal (e.g., steel, aluminum, etc.) and is typically hollow.

FIG. 19 is a drawing showing how a backboard attaches to the utility pole, according to an embodiment.

A first U-bolt 1901 and a second U-bolt 1902 are both made of metal (e.g., steel, aluminum, etc.) and are wrapped around the utility pole 1803. Both the first U-bolt 1901 and the second U-bolt 1902 have threaded ends. After the first U-bolt 1901 and the second U-bolt 1902 are wrapped around the utility pole 1803, they are both inserted into holes in a bracket 1902 connected to the backboard 1900. There are four bolts which are then each screwed over the protruding ends of the U-bolts 1901, 1902 in order to tighten the U-bolts 1901, 1902 to the bracket 1902 thereby fixedly mounting the utility pole 1803 to the bracket 1902.

FIG. 20 is a drawing showing a connected backboard, according to an embodiment.

The backboard 1900 has two arms, an upper arm 2000 and a lower arm 2001 which holds up a basketball rim 2008 which holds a net 2009. The upper arm 2000 has an upper pivot 2002 which allows the upper arm 2000 to rotate around the upper pivot 2002 and lower the backboard 1900 due to the force of gravity. The lower arm 2001 has a lower pivot 2003 which allows the lower arm 2001 to rotate around the lower pivot 2003 and lower the backboard 1900 due to the force of gravity.

As illustrated, a user can now play basketball using the backboard 1900 and associated equipment. Note that in addition to a basketball net, other recreational equipment can be utilized as well, including lights, a chair, etc.

In a further embodiment, an attachment can include a chair that would attach to the integrated connector 103 (or the middle connector 200 attached to the integrated connector 103). FIGS. 21-24 illustrate the elevated chair embodiment.

Figure 21:
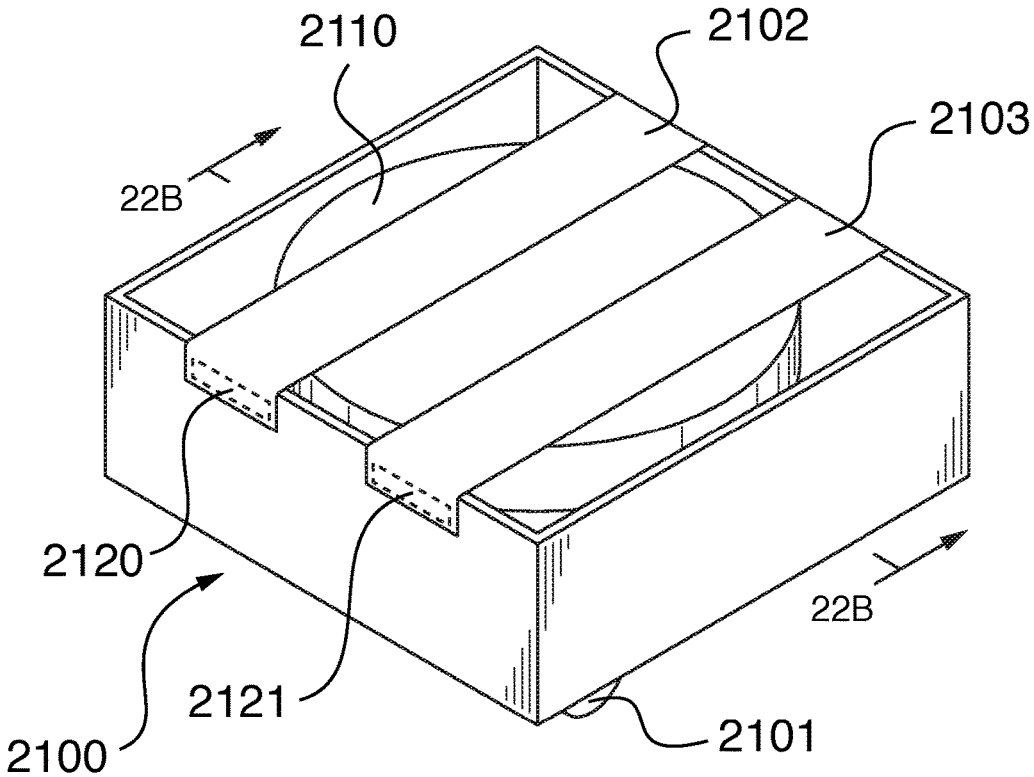
FIG. 21 is a drawing showing a chair folded up into a package, according to an embodiment.
Figure 21:
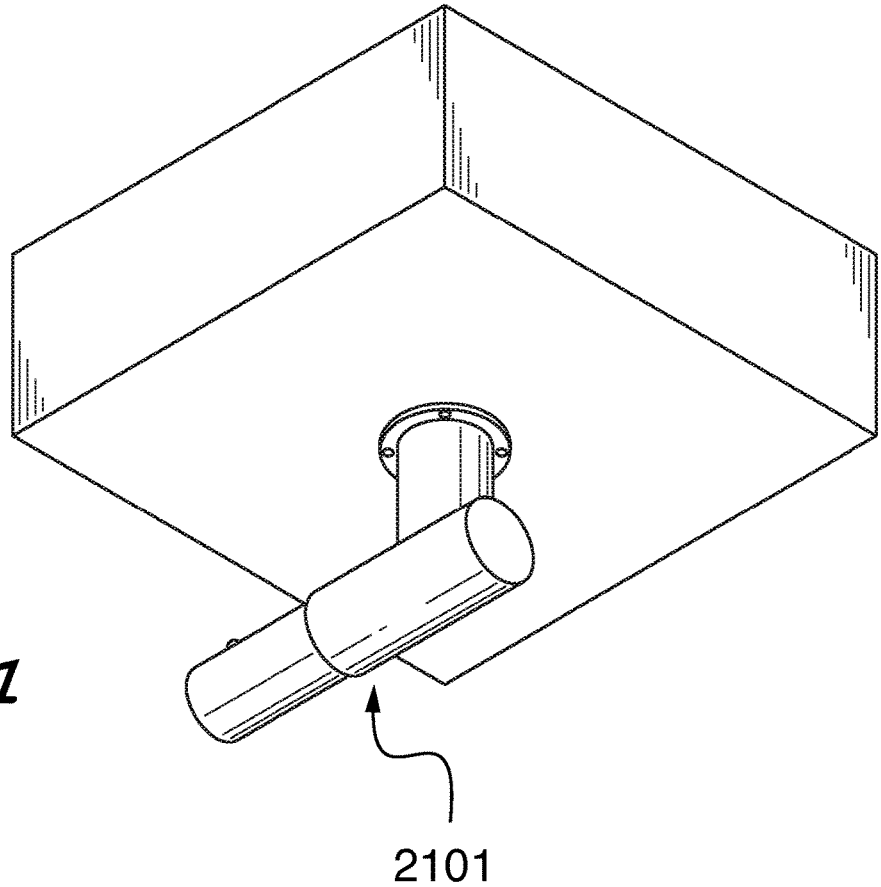

FIG. 21 is a drawing showing a chair folded up into a package, according to an embodiment.

A chair connector 2101 fits onto the integrated connector 103 or the middle connector 200 (which would be attached to the integrated connector 103). The chair connector 103 connects to the chair package 2100.

Two straps 2102 2103 contain the contents of the package 2100. Each strap 2102, 2103 is sealed to the package 2100 using Velcro (the end of the strap has a male/female Velcro and a respective area on the package 2120, 2121 has a cooperating male/female Velcro to removably attach to the Velcro on the end of the strap). A seat 2110 is folded inside the package 2100.

Figure 22A:
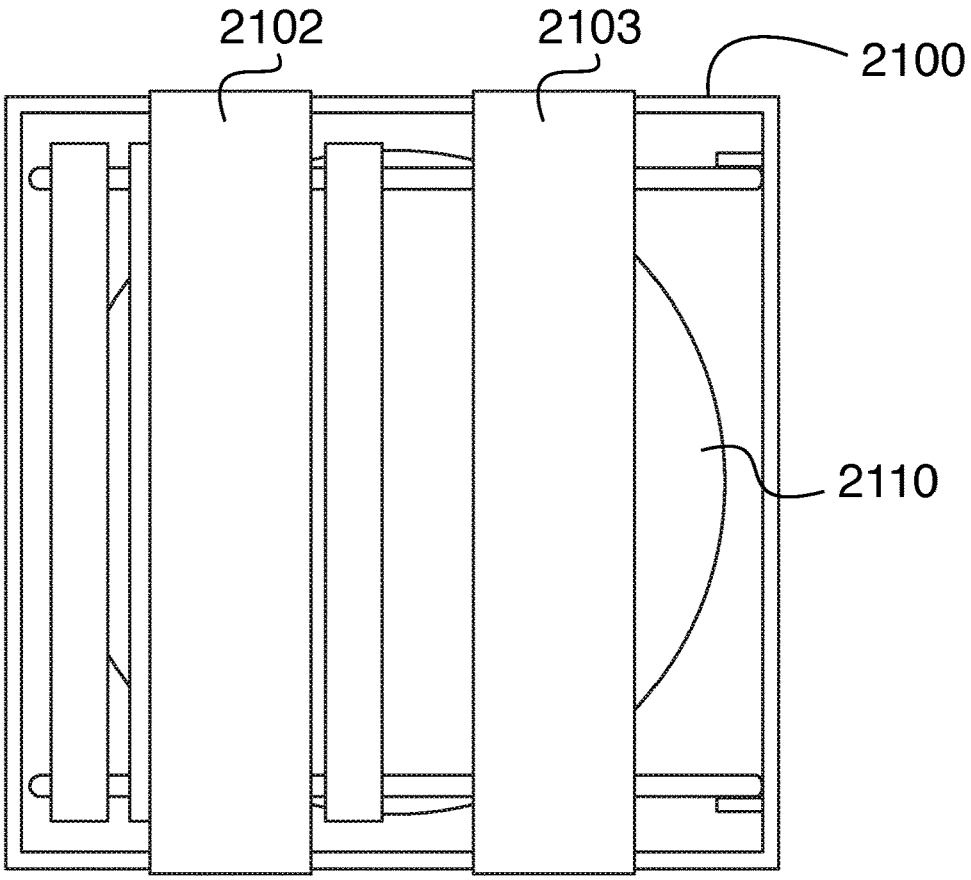
FIG. 22A is a drawing showing a top view of the package, according to an embodiment.

FIG. 22A is a drawing showing a top view of the package, according to an embodiment.

In this view the two straps are still sealed over the package 2100.

Figure 22B:
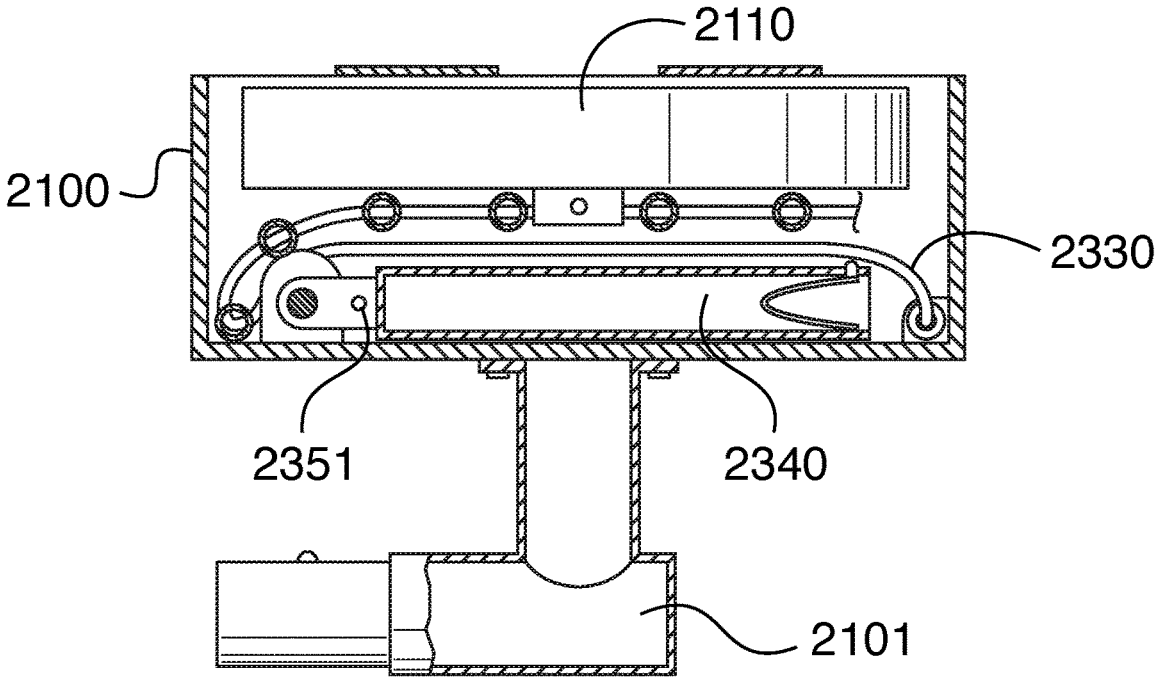
FIG. 22B is a drawing showing a cross section of the package, according to an embodiment.

FIG. 22B is a drawing showing a cross section of the package using the view shown in FIG. 21, according to an embodiment.

A ladder 2330 is shown wrapped up inside the compartment. A chair support 2340 is also shown in a folded (lowered) position. The chair support 2340 is parallel to a floor of the package 2100 and is under the ladder 2330. The chair support 2340 has the ability to fold upwards into an unfolded (raised) position (shown in FIGS. 23-24).

Figure 23:
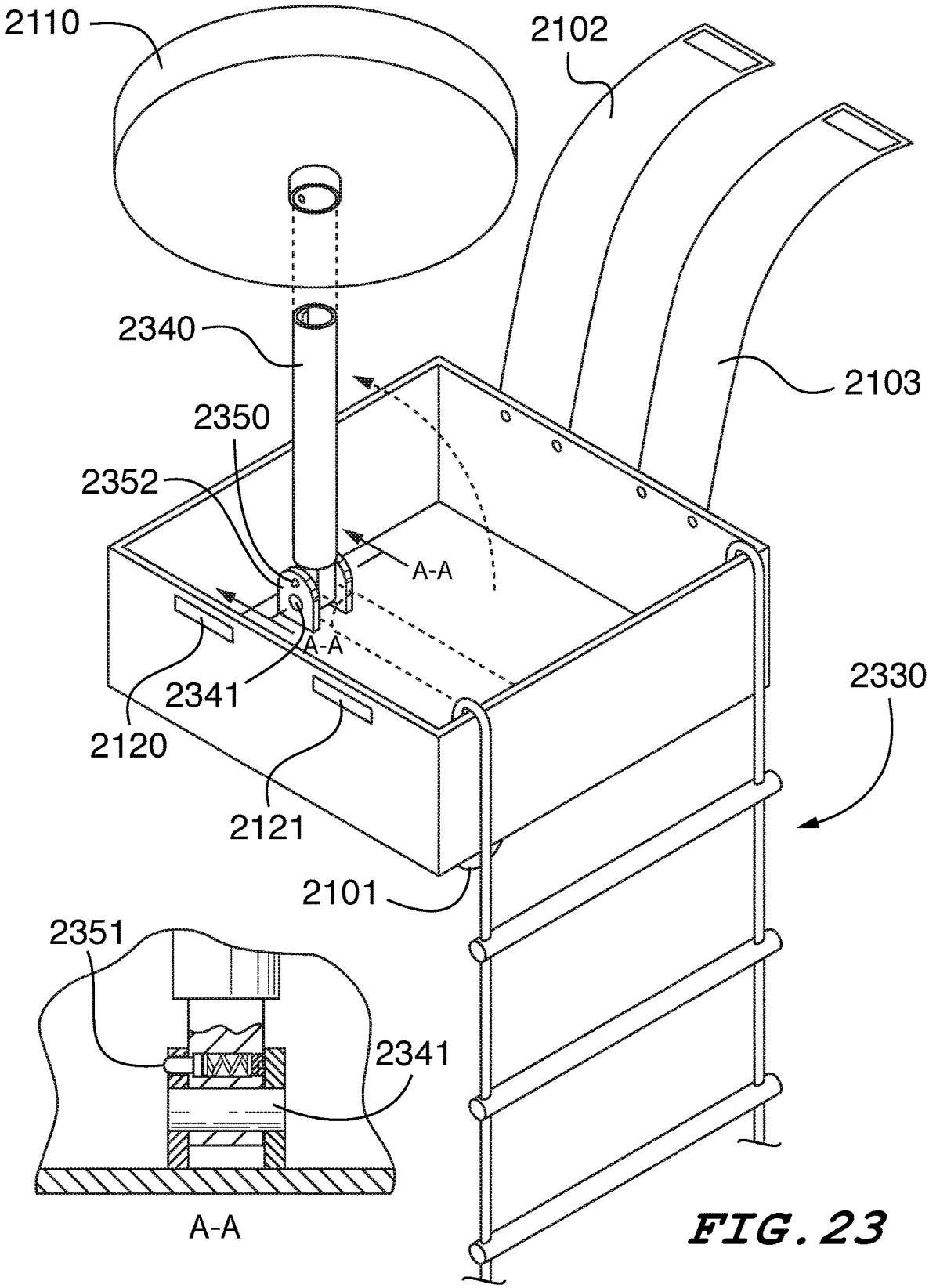
FIG. 23 is a drawing showing the chair as it unfolds from the package, according to an embodiment.

FIG. 23 is a drawing showing the chair as it unfolds from the package, according to an embodiment. Also shown in FIG. 23 is an enlarged cross section labeled 'A-A' taken from the view labeled 'A-A' in FIG. 23.

The chair support 2340 is shown in the raised (unfolded) position which puts the chair support 2340 in a position perpendicular to the floor of the package. The chair support 2340 pivots about a chair pivot 2341 and can rotate about the chair pivot 2341 to raise and lower. A chair hole 2350 in a chair plate 2352 connected to a floor of the package is used to receive a chair button 2351 on the chair support 2340. When the chair support 2340 is rotated to be in the raised position, the chair button 2351 snaps into the chair hole 2350 and locks the chair support 2340 in the raised (unfolded position). In order to lower the chair support 2340 back into the lowered (folded) position, a user would press into the chair button 2351 which would release the chair support 2340 from the locked position and allow it to be lowered into the lowered position. The button is like any other described herein, which naturally extends but can be depressed manually, and thus the button chair button 2351 is used to lock the chair support 2340 into the raised position.

The seat 2110 snaps onto the chair support 2340 (e.g., via a friction fit) and when the chair support 2340 is in the raised position the seat 2110 would be stable so a user could sit thereupon safely.

Figure 24:
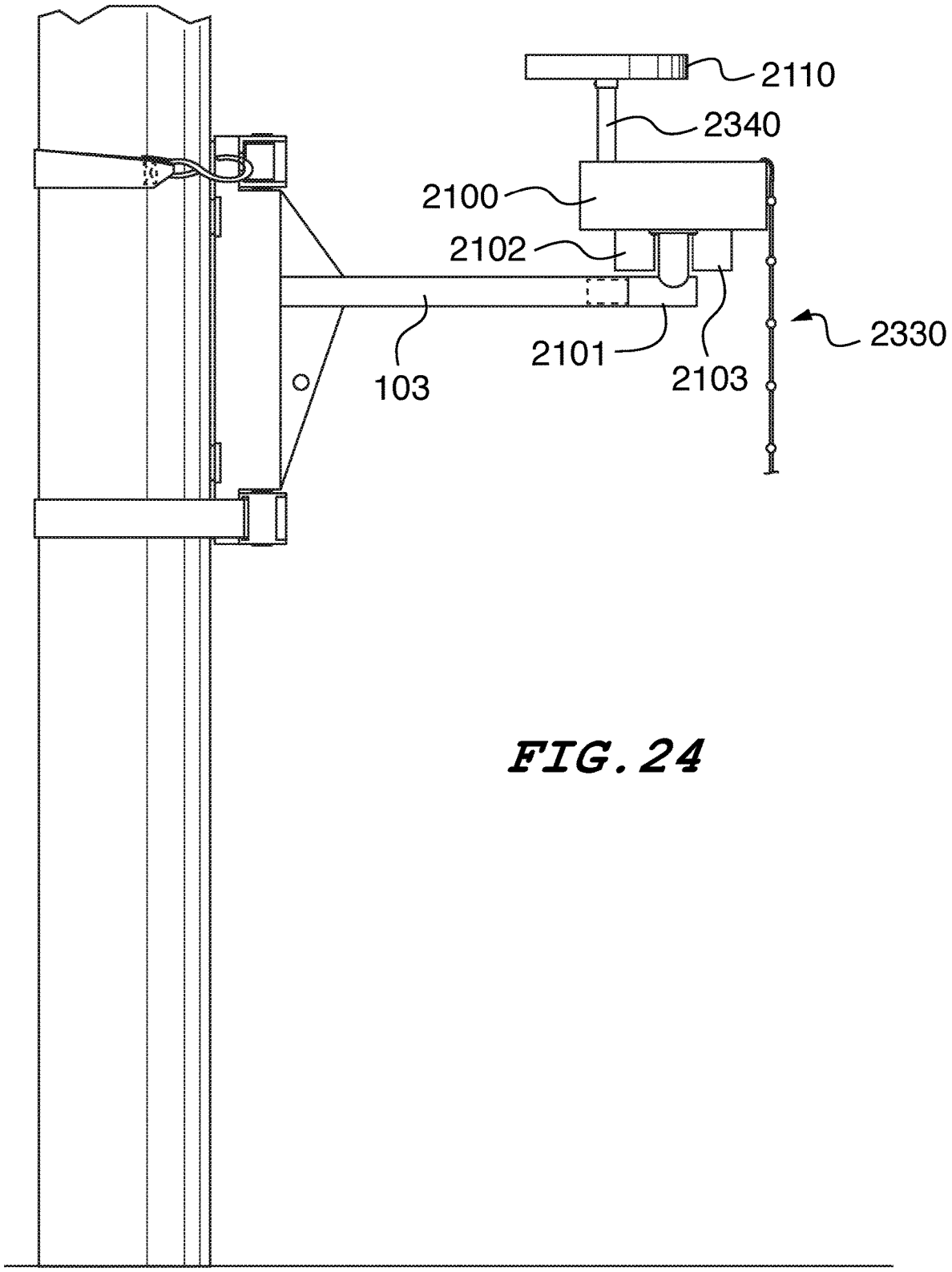
FIG. 24 is a drawing showing a fully assembled chair attached to the integrated connector, according to an embodiment.

FIG. 24 is a drawing showing a fully assembled chair attached to the integrated connector, according to an embodiment.

The seat 2110 is fully installed onto the chair support 2340 which is in the raised (and locked) position. The ladder 2330 is fully extended. A user can now climb the ladder 2330 to be able to climb onto and sit on the seat 2110 in an elevated position above the ground.

In a further embodiment, an attachment for providing a hammock (can also be used as a canopy) is provided. FIGS. 25-29 illustrate the hammock/canopy attachment. As used herein, each time "hammock" is used, it can also serve as a canopy, and vice-versa.

Figures 25A, 25B:
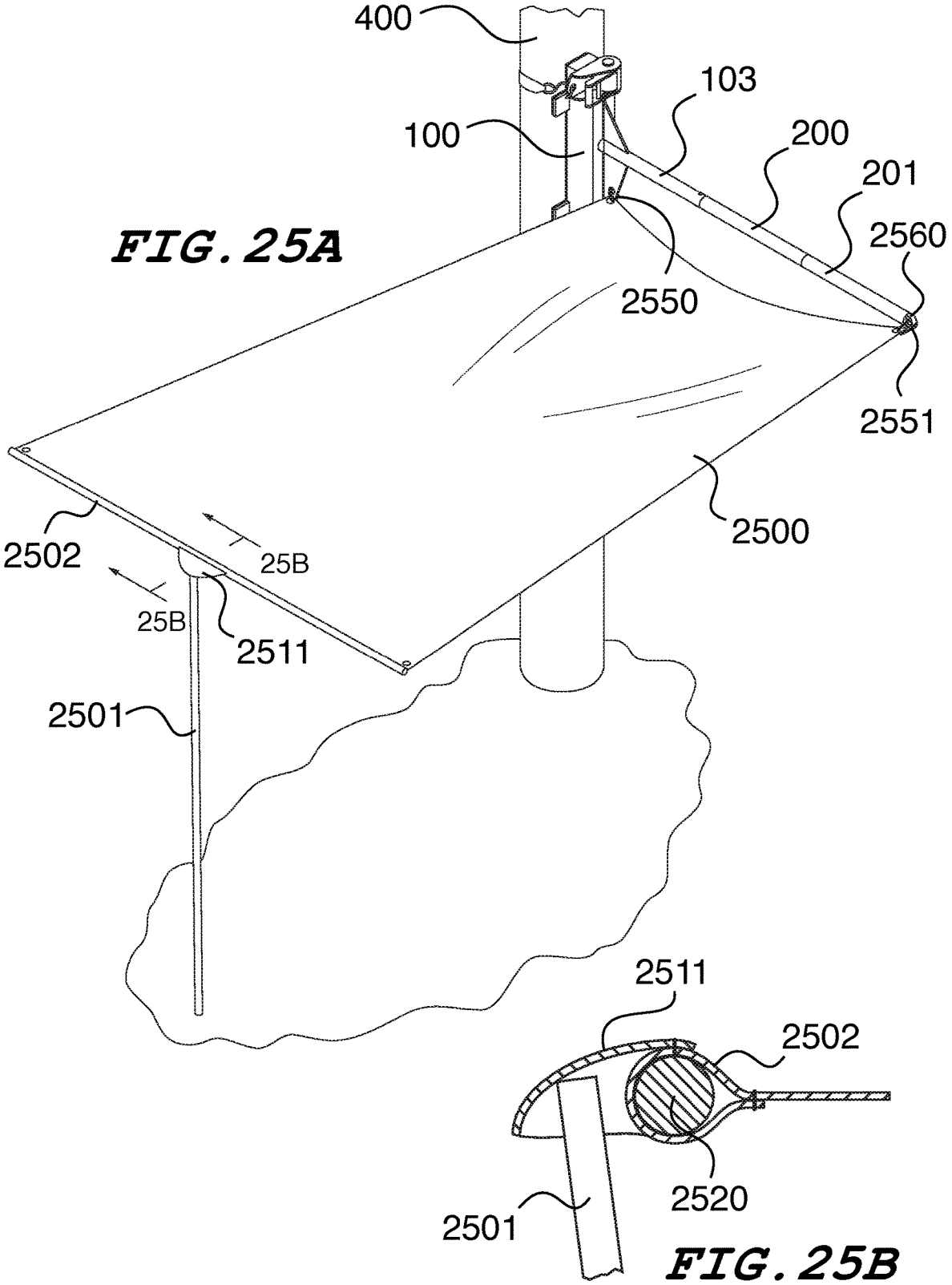
FIG. 25A is a drawing showing an assembled hammock/canopy, according to an embodiment.
FIG. 25B is a cross section of the assembled hammock/canopy taken at the view shown in FIG. 25A.

FIG. 25A is a drawing showing an assembled hammock/canopy, according to an embodiment.

A hammock 2500 (rectangle, square, or other shape) is provided of a durable fabric (e.g., nylon, etc.) A hollow sleeve 2502 sewed attached (e.g., sewed) onto the hammock 2500 which is adapted to receive a support rod 2520 which is inserted through the sleeve 2502. A fold 2511 is a cupped piece attached/sewed adjacent to the sleeve 2502 which is used to hold a stake 2501. The fold 2511 can be made out of the same fabric used to construct the hammock 2500 or it can be a harder material (e.g., hard plastic, etc.) A lower end of the stake 2501 is pressed into the ground and the opposite end of the stake 2501 is pressed into the fold which is used to support to the hammock 2500.

The hammock 2500 has holes in each corner of the hammock 2500. A first carabiner clip 2550 is clipped to attach the bottom plate hole 602 and one of the holes in the hammock 2500. A second carabiner clip 2551 is clipped to attach an end hole 2560 in the end connector 201 and another one of the holes in the hammock 2500 as illustrated in FIG. 25A, the end hole 2560 is shown clearly in FIGS. 2 and 7 and is a hole integrated to the very end of the middle connector 200 or end connector 201.

FIG. 25B is a cross section of the assembled hammock/canopy taken at the view shown in FIG. 25A.

Shown is the support rod 2520 inserted through the sleeve 2502. The stake 2501 is inserted into the fold 2511. The stake 2501 supports the end of the hammock 2500 opposite the end clipped to the bottom plate hole 602 and the end hole 2560 in the end connector 201.

Figure 26:
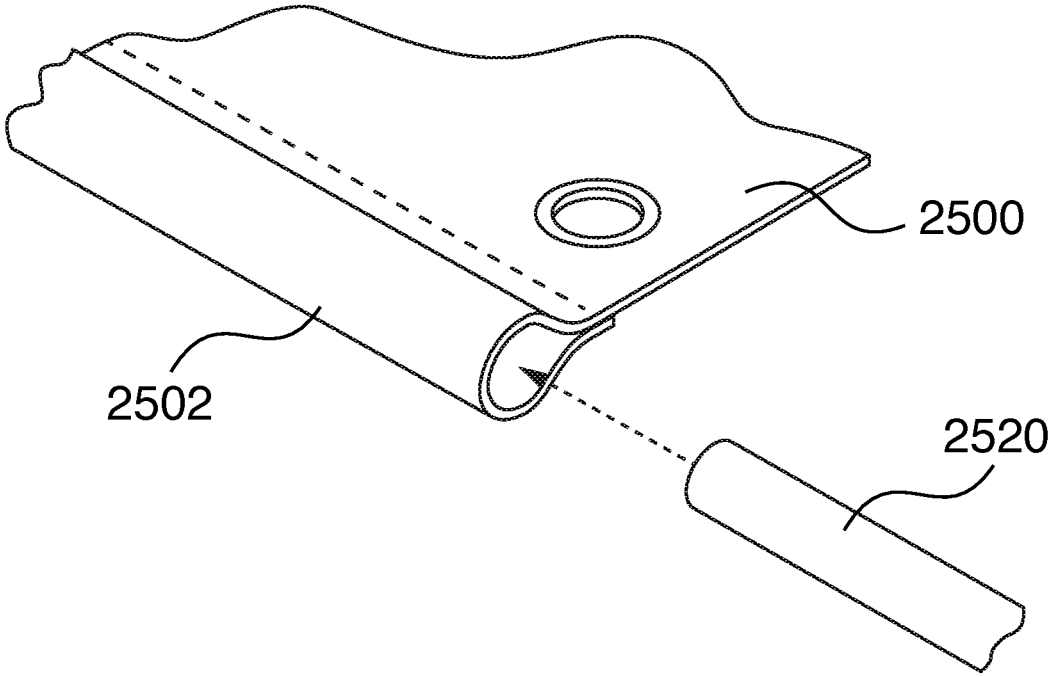
FIG. 26 is a drawing showing insertion of a rod into a sleeve embedded into the hammock, according to an embodiment.

FIG. 26 is a drawing showing insertion of a rod into a sleeve embedded into the hammock, according to an embodiment.

The hammock 2500 has an attached sleeve 2502 adapted to fit the support rod 2520 therethrough. The support rod 2520 (once inserted into the hammock 2500) serves to maintain a straight edge of the hammock so it can be used to lie upon (as a hammock) or support a roof (if used as a canopy).

Figure 27:
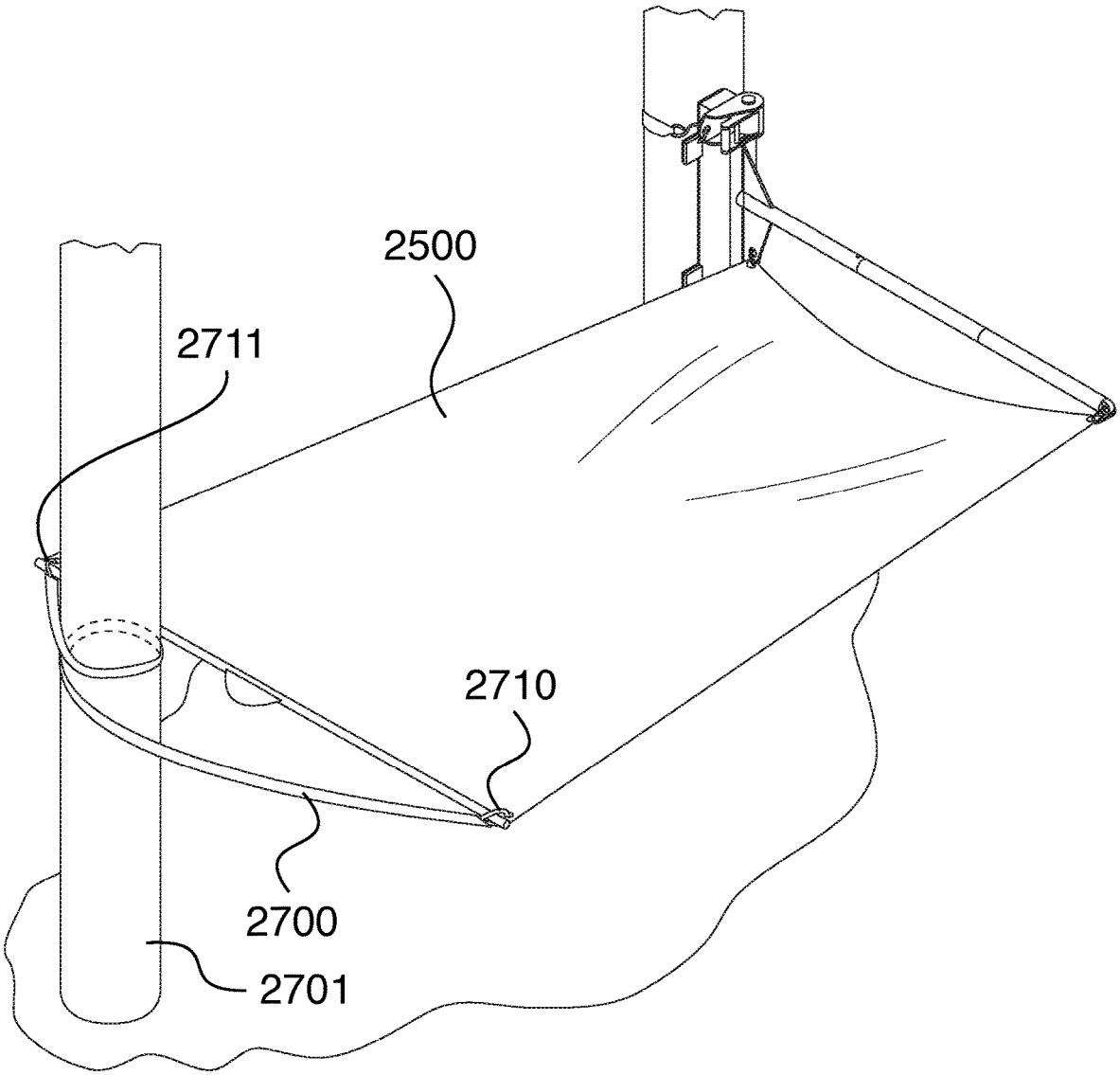
FIG. 27 is a drawing showing assembly of the hammock, according to an embodiment.

FIG. 27 is a drawing showing assembly of the hammock, according to an embodiment.

The hammock 2500 is assembled similarly to FIG. 26 but instead of using the stake 2501 to support the end of the hammock 2500 with the sleeve 2502, a strap 2700 is used to wrap around a second vertical structure 2701 (e.g., tree, post, etc.) The strap 2700 can be made of elastic (e.g., rubber, etc.) so it can wrap tightly around the second vertical structure 2701, thereby supporting the hammock 2500 so somebody can lie on top of it, or supporting its use as a canopy (e.g., someone can sleep under the hammock 2500).

A third carabiner clip 2710 attaches (clips) a hole in the strap 2700 to a hole in the hammock 2500, and a fourth carabiner clip 2711 attaches (clips) a hole in the opposite end of the strap 2700 to a hole in the hammock 2500.

Figure 28:
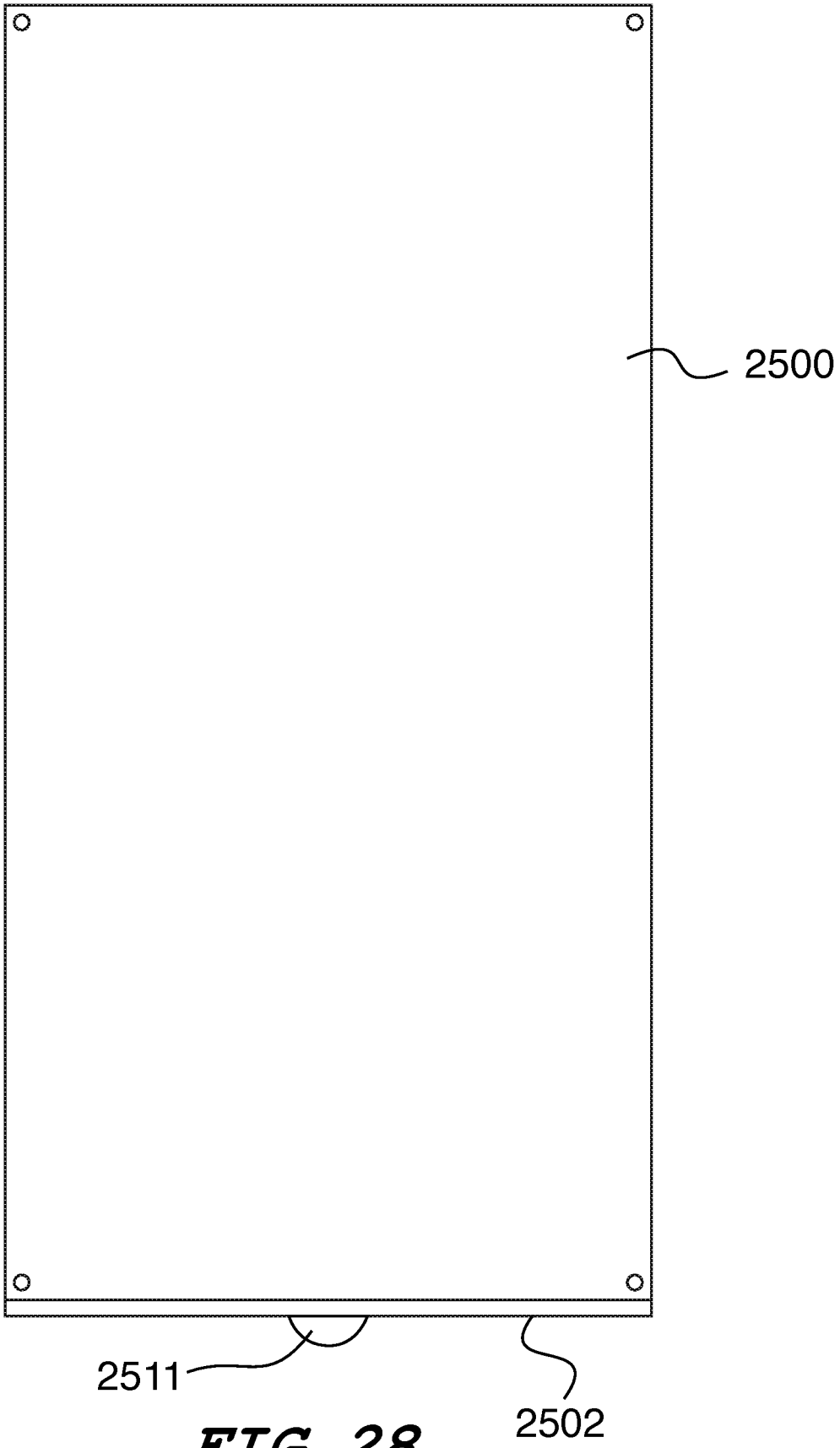
FIG. 28 is a top view of the hammock, according to an embodiment.

FIG. 28 is a top view of the hammock, according to an embodiment.

The hammock 2500 has four holes in its corners as shown. The sleeve 2502 runs from one corner of the hammock 2500 to the other corner, adapted for insertion of the support rod 2520 therethrough.

Figure 29:
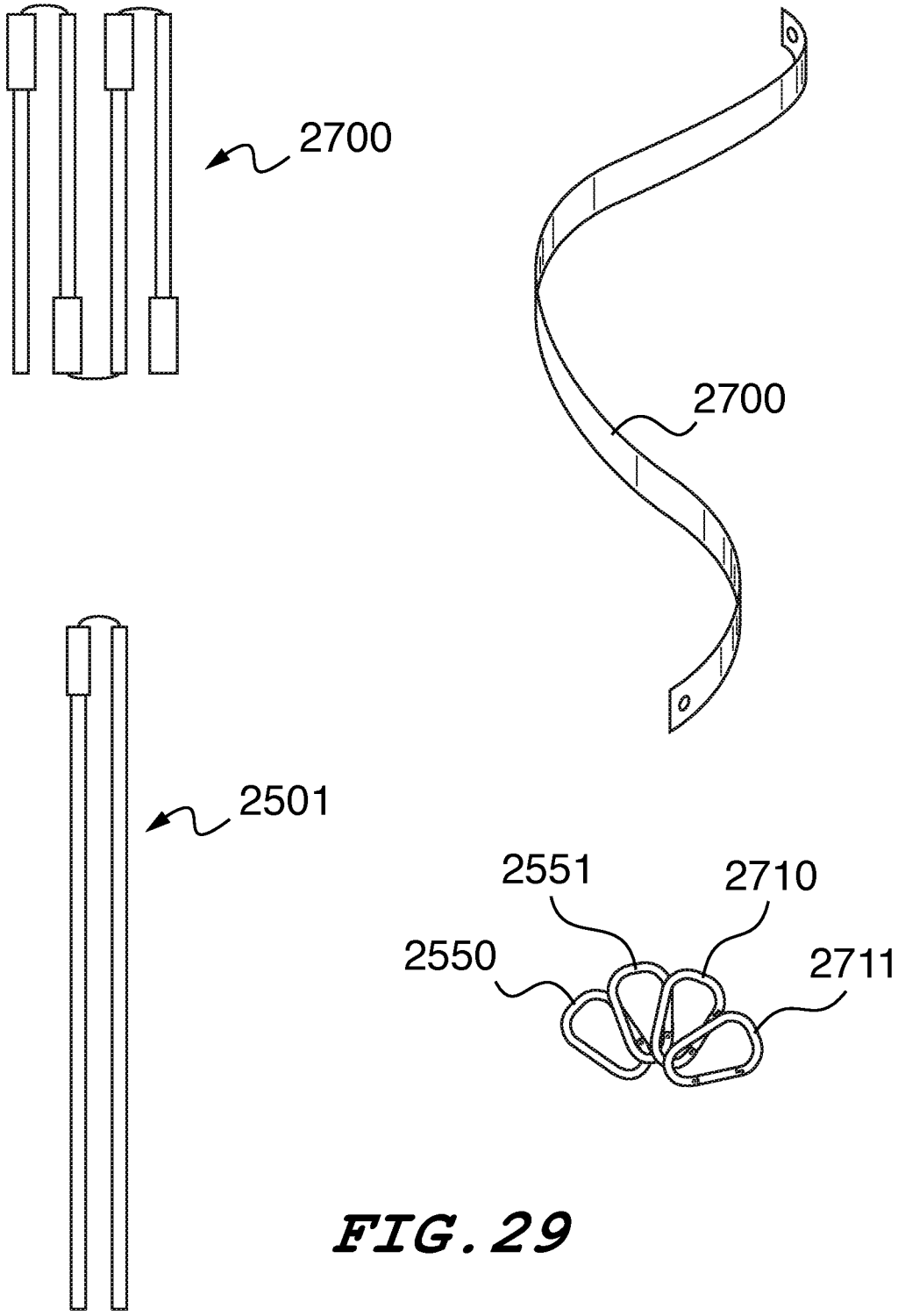
FIG. 29 is a drawing shows parts used to assemble the hammock/canopy, according to an embodiment.

FIG. 29 is a drawing shows parts used to assemble the hammock/canopy, according to an embodiment.

Four carabiner clips are shown 2710, 2711, 2550, 2551. In the embodiment illustrated in FIG. 27, all four carabiner clips are used. In the embodiment shown in FIG. 25A, only two carabiner clips are used. A strap 2700 (also referred to as band) has holes on each side to receive a carabiner clip (or other type of clip) and is made of a stretchable (e.g., elastic) material so it can wrap around a vertical structure tightly.

In an embodiment, the stake 2501 can be disassembled and folded up as shown for easy storage. In this embodiment, the stake 2501 can come into two parts (e.g., two metal or wooden rods) connected by a rope and one end of the one of the parts is adapted to fit tightly into another end of the other part (e.g., friction fit, screw into, etc.) in order to make a longer stake which can then be used as described herein. Each of the smaller rods is typically hollow to house the rope when the smaller rods are all interconnected to form the stake 2501. The stake 2501 is thus foldable, in that it can be disassembled and reassembled for easier storage and transport.

In an embodiment, the support rod 2520 can also be disassembled into a plurality of smaller rods in the same manner as the stake 2501. Shown are for smaller rods, each connected to another by a rope, and the smaller rods are adapted to fit into each other (e.g., friction fit, screw into, etc.) to form a longer single rod which is then used as described herein. Each of the smaller rods is typically hollow to house the rope when the smaller rods are all interconnected to form the stake 2501. The support rod 2520 is thus foldable, in that it can be disassembled and reassembled for easier storage and transport.

Note that while carabiner clips are described herein to make attachments, any other attachment clip or mechanism can be used as well (e.g., Velcro, etc.)

In a further embodiment, a sports net attachment can be provided for, in order to play games that would use such a sports net, such as volleyball, badminton, etc.

Figure 30:
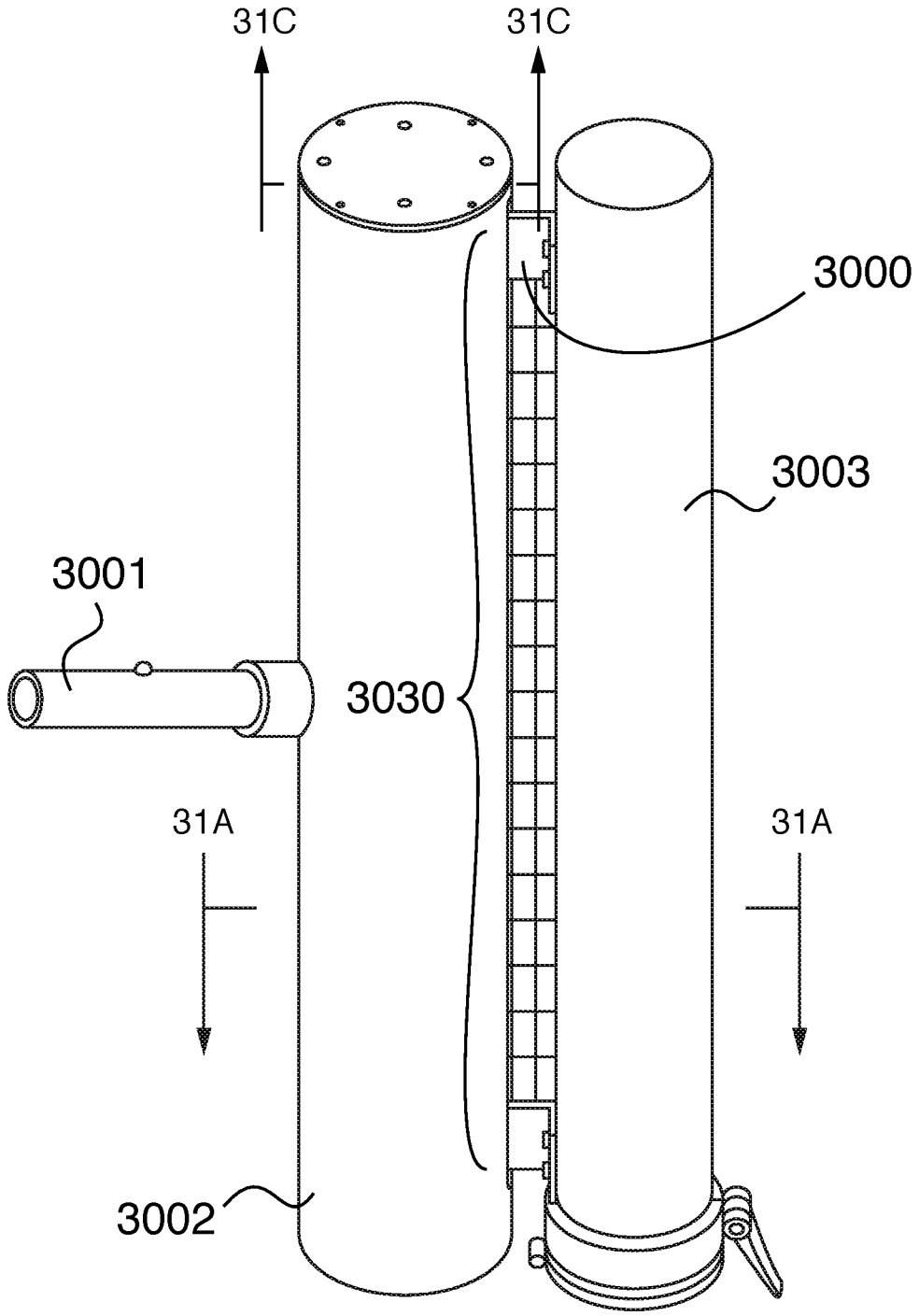
FIG. 30 is a drawing of a sports net attachment, according to an embodiment.

FIG. 30 is a drawing of a sports net attachment, according to an embodiment.

A net holder 3002 is a circular hollow shell (can be made of metal, such as aluminum, steel, etc.) which houses a sports net 3000 (e.g., a volleyball net or any other type of net) which is rolled up inside the net holder 3002. The net holder 3002 is connected to a net holder attachment 3001 which attaches to the integrated connector 103 (or middle connector 200 or end connector 201). A stake holder 3003 houses a collapsible net stake 3100 which can collapse and extend. Once extended, the net stake 3100 can be pressed into the ground.

A slot 3030 in the net holder 3002 is slightly bigger than the height of the net 3000 so it allows the net 3000 to be pulled out of from the net holder 3002.

Figure 31A:
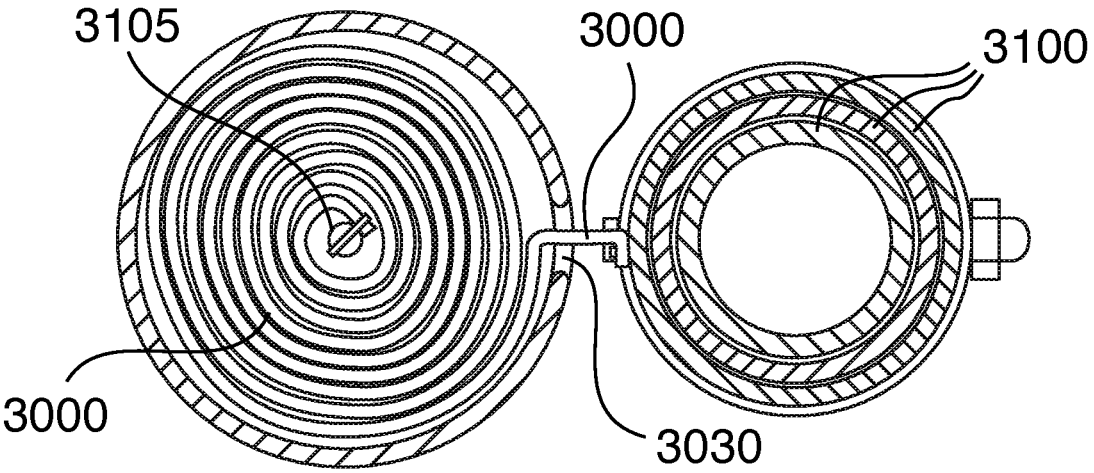
FIG. 31A is a cross showing of the sports net from a view shown in FIG. 30, according to an embodiment.

FIG. 31A is a cross showing of the sports net from a view shown in FIG. 30, according to an embodiment.

The sports net 3000 is rolled up inside the net holder 3002. The net stake 3100 is contained inside the net stake 3100. Note that as the net 3000 is pulled out of the slot 3030, the a mechanism (which automatically pulls the net 3000 back into the net holder 3002 to retract it when the user is done using the net 3000) is automatically wound. If the user continues to pull the net 3000 out of the net holder 3002, eventually and end of the net 3000 could not be further removed because the end of the net is connected to the cog 3005 which remains in the center of the net holder 3002.

Figure 31B:
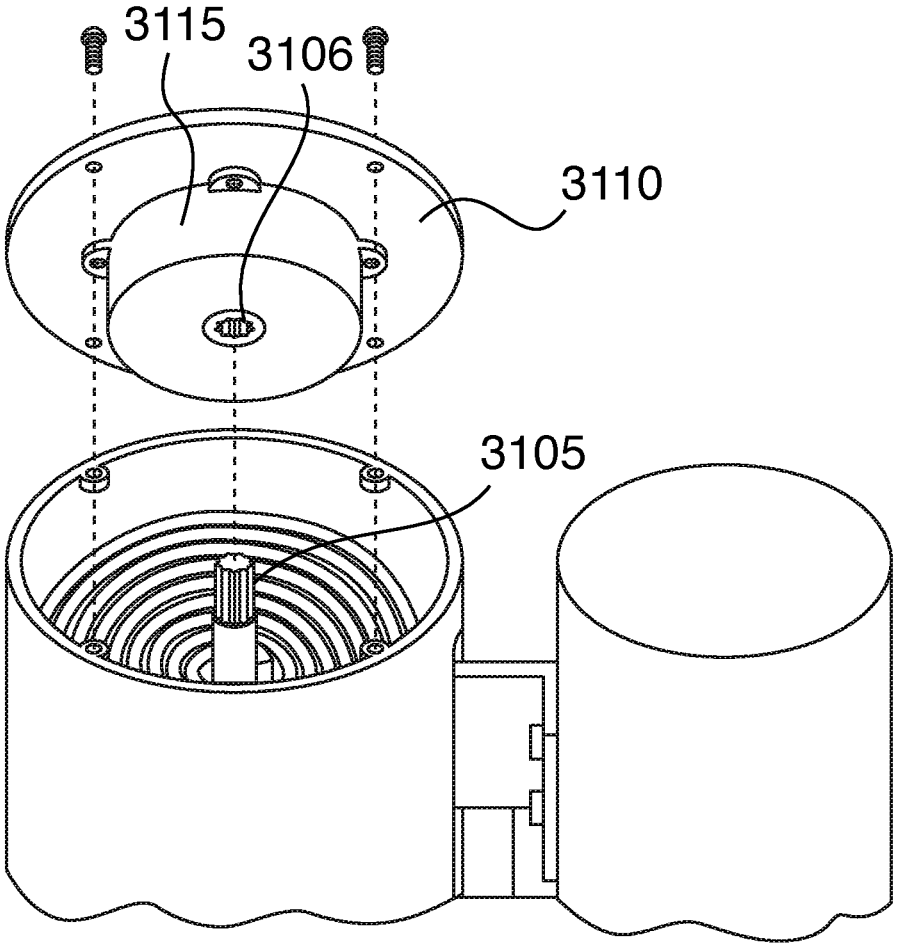
FIG. 31B is further drawing of the sports net attachment showing an interior, according to an embodiment.

FIG. 31B is further drawing of the sports net attachment showing an interior, according to an embodiment.

A net holder lid 3110 can screw onto the net holder 3002 using four screws and four threaded screw holders on the net holder 3002. A cog 3005 is attached to the sports net 3000. The cog 3105 fits into a receiver 3106 in the net holder lid 3110. The cog 3105 has a ridged top and the receiver 3106 in the net holder lid has a same ridged pattern as the top of the cog 3005. Thus, the top of the cog 3105 fits into the receiver 3106 in the net holder lid, and as the cog 3105 rotates it rotates the receiver 3106 which winds a mechanism which is located inside the housing 3115. The housing 3115 is attached to the lid 3110 by virtue of four screws. Thus, when the net 3000 is pulled out from the net holder 3002, it would turn the receiver 3106 which automatically winds up the mechanism, thereby causing the mechanism to pull on the net 3000 in order to naturally retract the net 3000 back into the net holder 3002.

When the users are done playing with the net 3000 and want to fold up the equipment, the stake holder 3003 can be moved closer to the net holder 3002 and the mechanism would automatically wind the net 3000 around the cog 3105 and the net 3000 becomes fully wrapped inside in the net holder 3002.

Figure 31C:
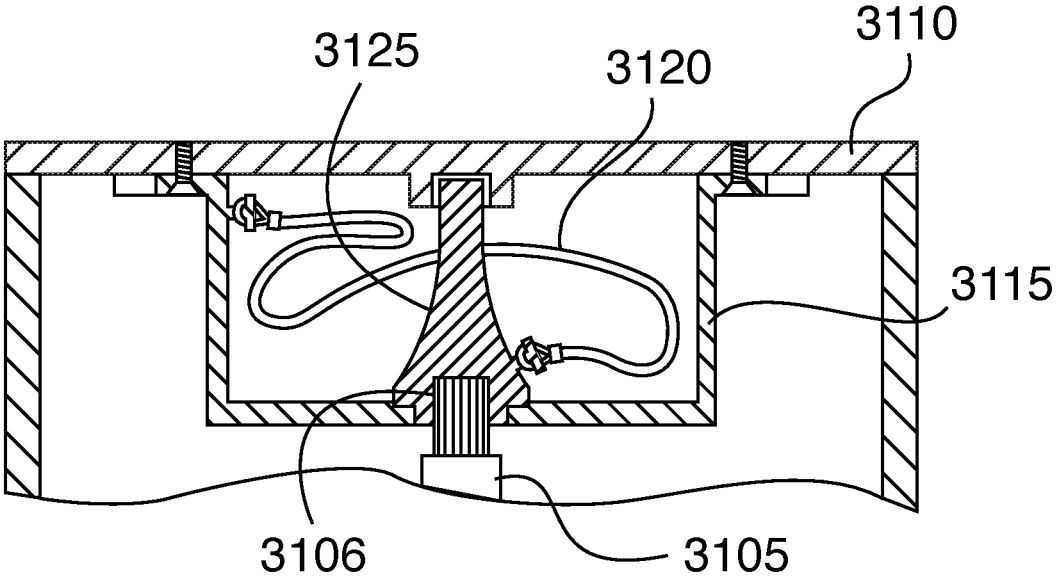
FIG. 31C is a further cross section showing the sports net from a view shown in FIG. 30, according to an embodiment.

FIG. 31C is a further cross section showing the sports net from a view shown in FIG. 30, according to an embodiment.

The housing 3115 houses the mechanism that enables the cog 3105 to automatically roll the net back up. In other words, as the net 3000 is pulled out of the net holder 3002, the cog 3105 rotates against force of the mechanism. This exerts a natural force on the net 3000 to wind back up into the net holder 3002. Thus, when the user is finished playing with the net 3000, it will be easy to place the net 3000 back into the net holder 3002 because the mechanism will automatically pull the net 3000 back into the net holder 3002 and wind the net 3000 up circularly. The cog 3105 fits into a receiver 3106 which is a hole on the bottom of a shaft 3125. The receiver 3106 is specially shaped to receive a top of the cog 3105 which has a matching shape (e.g., vertical grooves so that the cog 3105 and the receiver 3106/shaft 3125 would rotate together). Then the net 3000 is pulled out of the net holder 3002, the cog 3105 rotates in first direction which causes the receiver 3106 and hence the shaft 3125 to rotate. A bungee cord 3120 (or other elastic cord such as a rubber band, etc.) is fixedly attached to both the shaft 3125 and an inside of the housing 3115. The shaft 3125 is configured to rotate inside the housing 3115 (by not being permanently affixed to the housing 3115, but it is still held in place via a top and bottom seats (as illustrated in FIG. 31C) that keep the shaft 3125 in its place while allowing it to rotate). Thus, as the shaft 3125 rotates (which is turned by the cog 3105 in the receiver 3106 on the bottom of the shaft 3125), the bungee cord 3120 will wind around the shaft 3125 thereby causing tension on the bungee cord 3120 and hence tension on the net 3000 (the tension being a force to naturally draw the net 3000 back into the net holder 3002). In other words, the shaft 3125, as it is wound in the first direction, will naturally be urged (by the bungee cord 3120) to rotate in a second direction opposite the first direction. As such, when the net 3000 is fully extended from the net holder 3002, there will be a strong natural force (but not strong enough to pull the stake holder 3003 towards the net holder 3002 once the stake holder 3003 is staked into the ground) to pull the net 3000 back into the net holder 3002. When the net 3000 is extended and it is time to pack up the equipment, the user can pull the stake holder 3003 out of the ground and walk the stake holder 3003 towards the net holder 3002 and the natural operation of the mechanism inside the housing 3115 (e.g., the bungee cord 3120, shaft, 3125, receiver 3106, cog 3105, etc.,) will automatically cause the net 3000 to wind back up circularly into the net holder 3002. Note that while a bungee cord 3120 is described and shown as being the energy storage mechanism that automatically stores energy as the net 3000 is removed from the net holder 3002 and utilizes that stored energy when the energy storage mechanism causes the net 3000 to wrap back up inside the net holder 3002, other energy storage mechanisms can be used as well such as a rubber band, circular spring, etc.

Figure 32:
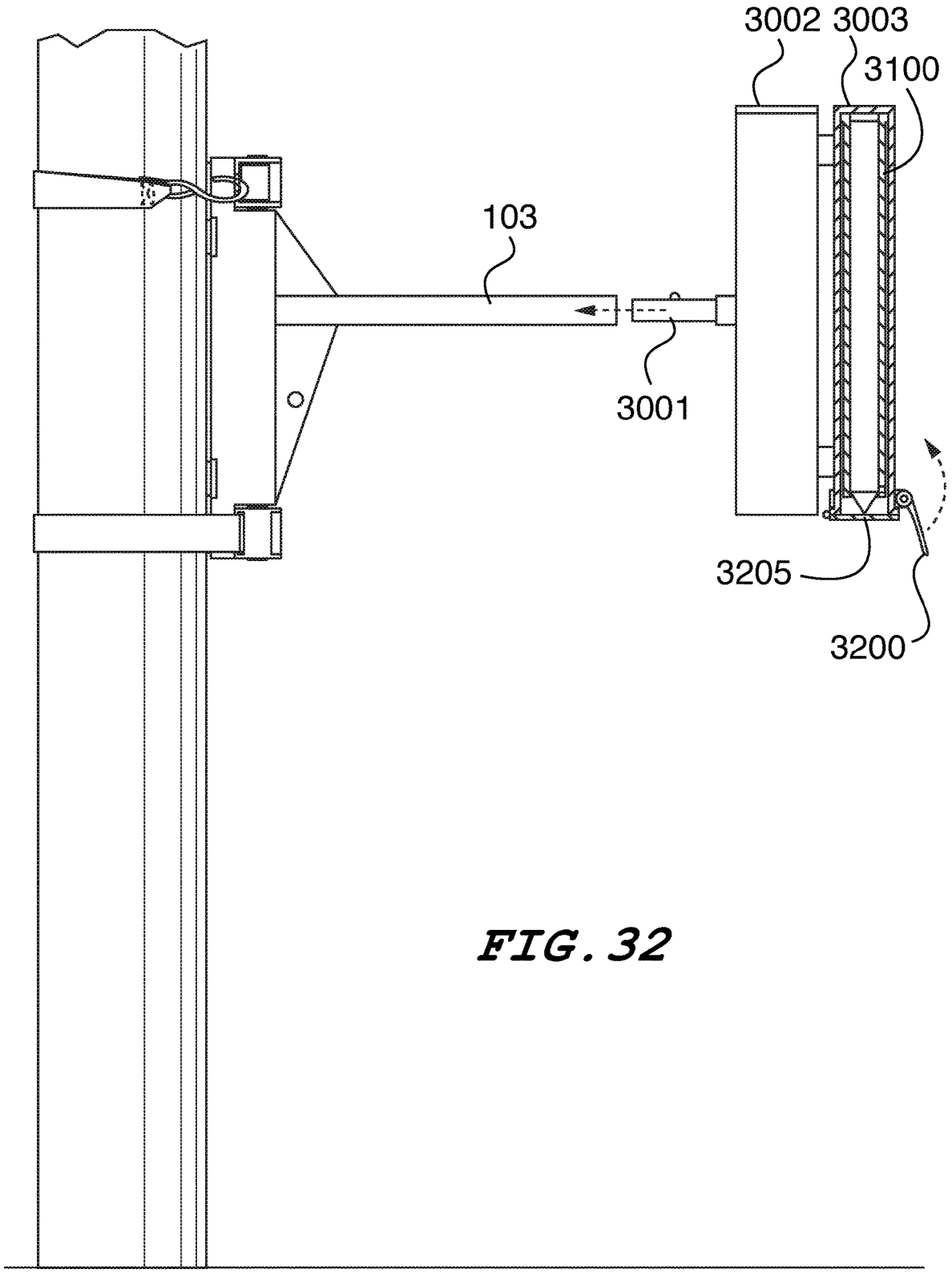
FIG. 32 is a drawing of a sports net attachment being attached to an integrated connector, according to an embodiment.

FIG. 32 is a drawing of a sports net attachment being attached to an integrated connector, according to an embodiment.

The stake holder 3003 holds a collapsible net stake 3100. When a floor 3205 (can also be referred to as a door) of the stake holder 3003 is opened by operating a release 3200, the collapsible net stake 3011 is released out of the stake holder 3003 (see FIG. 33A showing how the collapsible net stake 3011 falls out automatically due to the force of gravity).

Figure 33A:
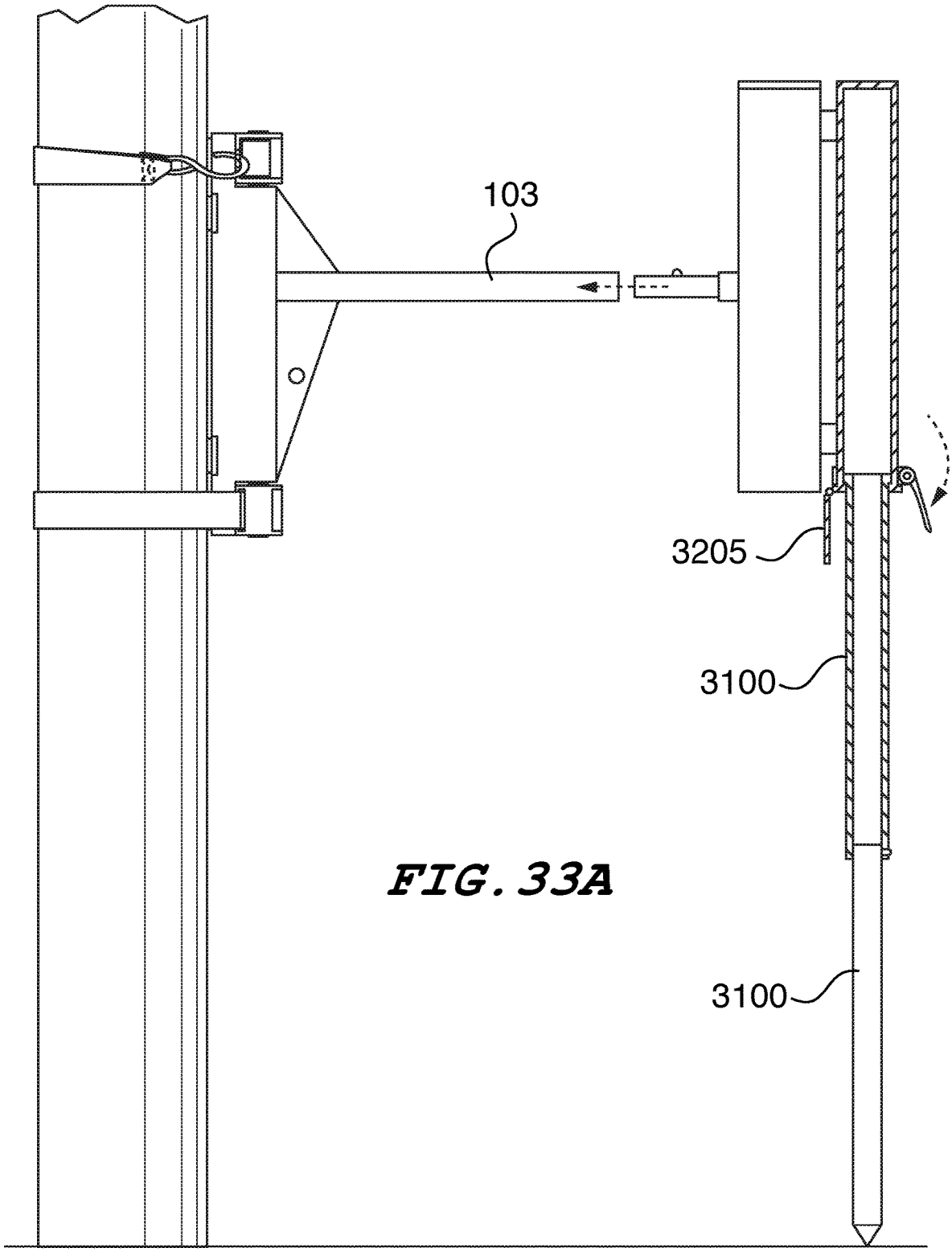
FIG. 33A is a drawing of a sports net attachment being staked into the ground, according to an embodiment.

FIG. 33A is a drawing of a sports net attachment being staked into the ground, according to an embodiment.

The net stake 3100 falls out of the stake holder 3003 due to the force of gravity once the floor 3205 is opened and extends. The net stake 3100 can then be driven into the ground. When the user is finished playing with the equipment, the net stake 3100 can be pushed back up into the stake holder 3003 and the bottom 3205 pushed (and locked) back over the stake holder 3003 by operating the release 3200.

Figure 33B:
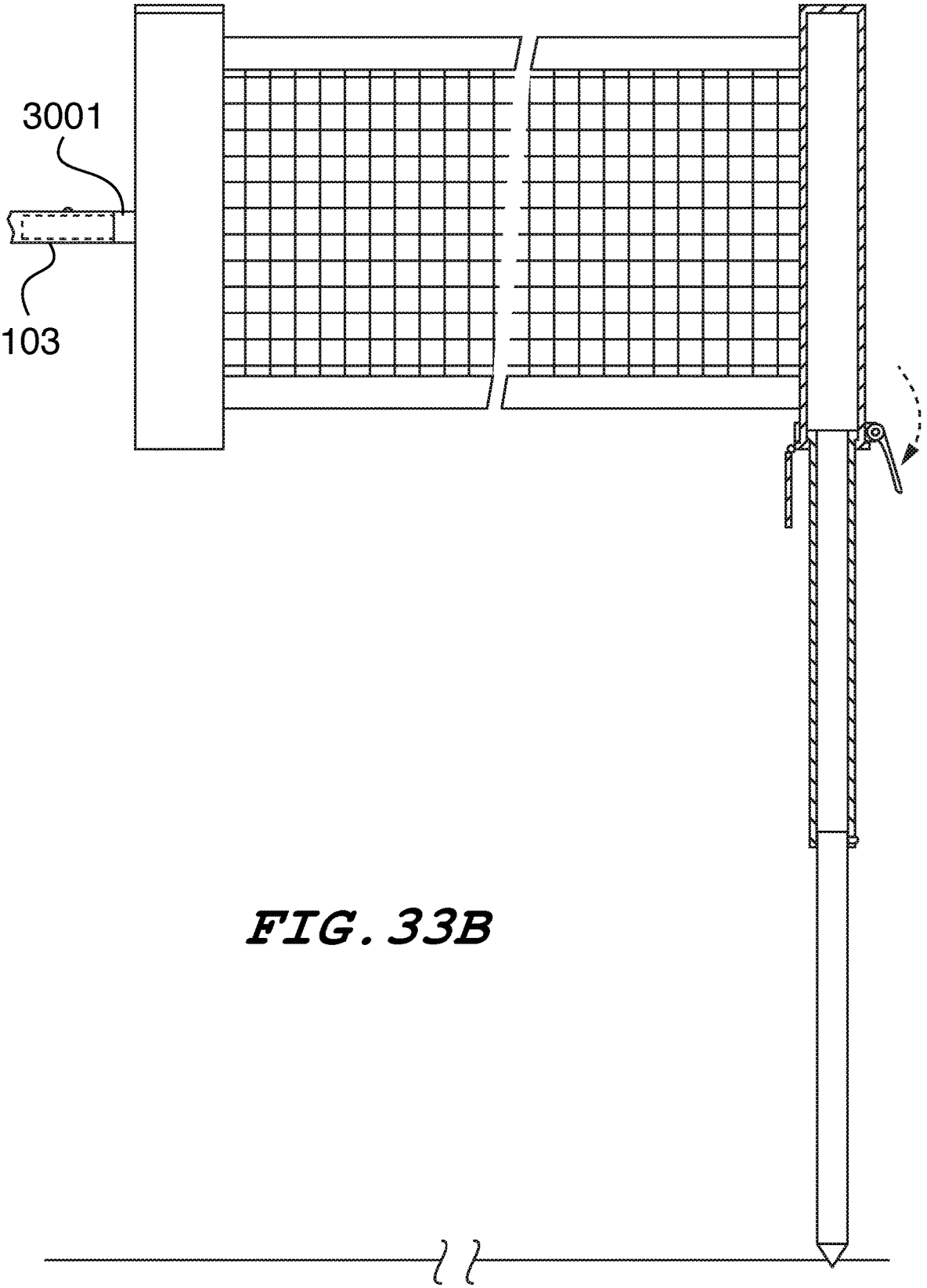
FIG. 33B is a drawing of an extended sports net attachment being extended, according to an embodiment.

FIG. 33B is a drawing of an extended sports net attachment being extended, according to an embodiment.

The user would attach the net holder attachment 3001 to the integrated connector 103 (or the middle connector 200 or the end connector 201). The stake holder 3003 is then pulled away from the net holder 3002 to extend the net 300 in its entirety. Once the net is extended, then the net stake 3100 is driven into the ground (for example by using a mallet or other heavy object on top of the stake holder 3003). The net can then be played with.

When the user is done playing with the net, he/she would remove the stake holder 3003 from the ground and walk the stake holder 3003 towards the net holder 3002. The spring loaded mechanism would automatically be pulling the net 3000 into the net holder 3002 thereby automatically winding it up inside the net holder 3002. The net holder attachment 3001 can then be removed from the integrated connector 103 (or the middle connector 200, etc.) by pressing the button (or removing a pin), and then everything can be stored.

Figure 34A:
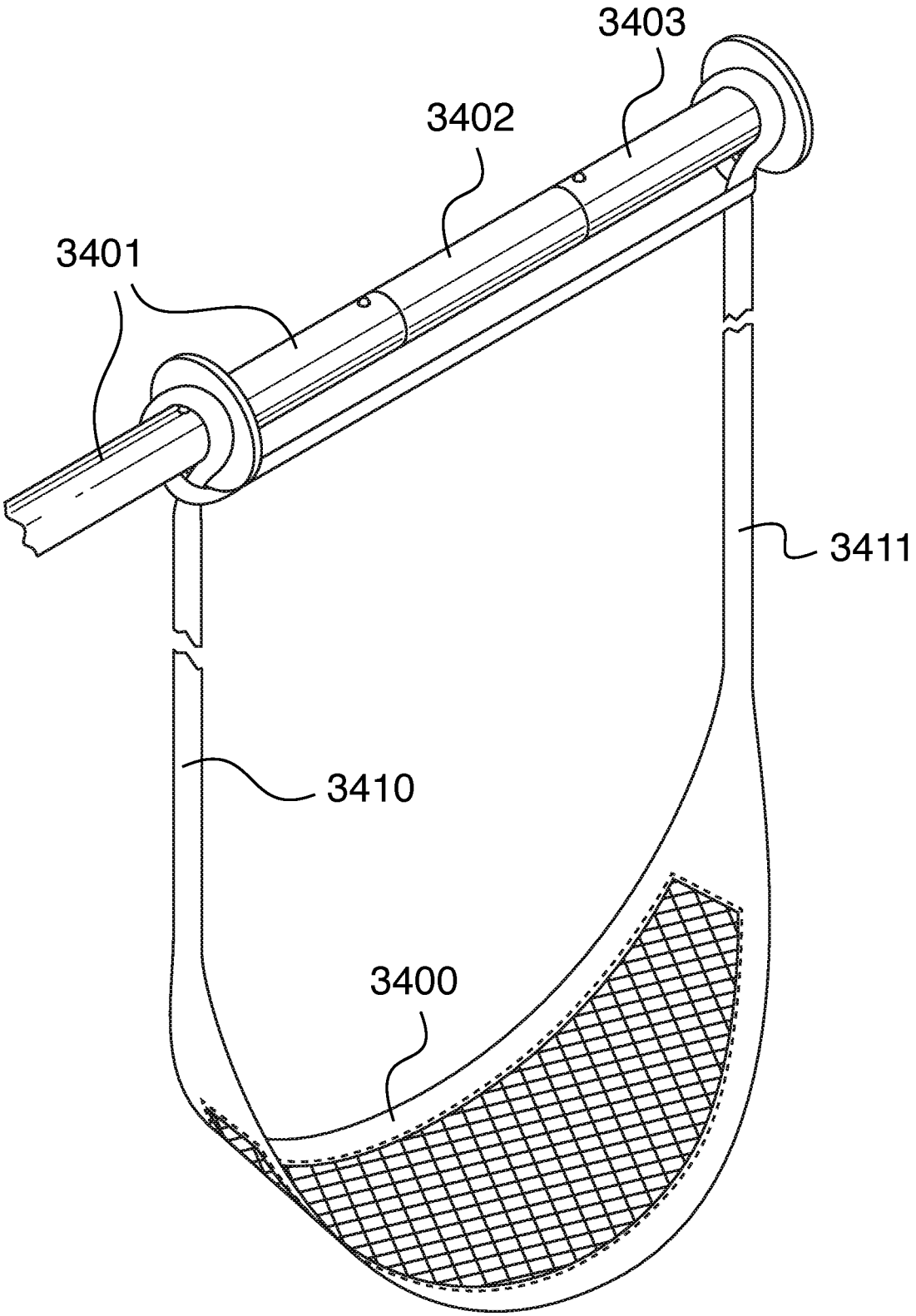
FIG. 34A is a drawing illustrating a swing attachment, according to an embodiment.

In a further embodiment, a swing can be implemented as attachments. FIGS. 34A-35 illustrate the swing embodiment.

FIG. 34A is a drawing illustrating a swing attachment, according to an embodiment.

A swing 3400 is attached to a left strap 3410 and a right strap 3411. The left strap 3410 and right strap 3411 are ultimately attached to each other in a loop (see FIG. 34B), a first swing connector 3401 is attached to a second swing connector 3402 which is attached to the third swing connector 3403. The first swing connector 3401 is attached to the integrated connector 103 or the middle connector 200 or the end connector 201.

Figure 34B:
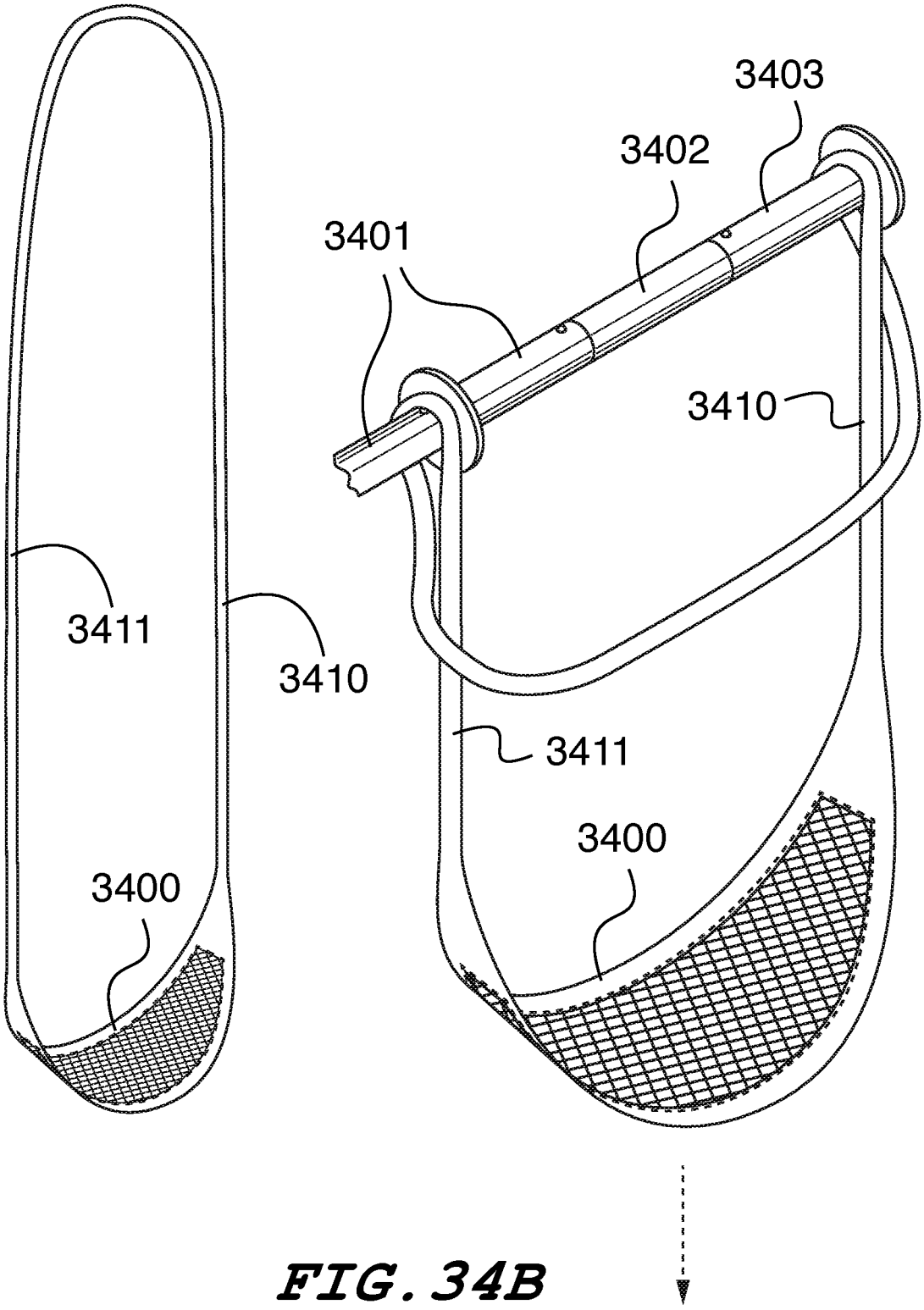
FIG. 34B is a drawing showing an entire swing and how it is connected to the swing attachment, according to an embodiment.
Figure 35:
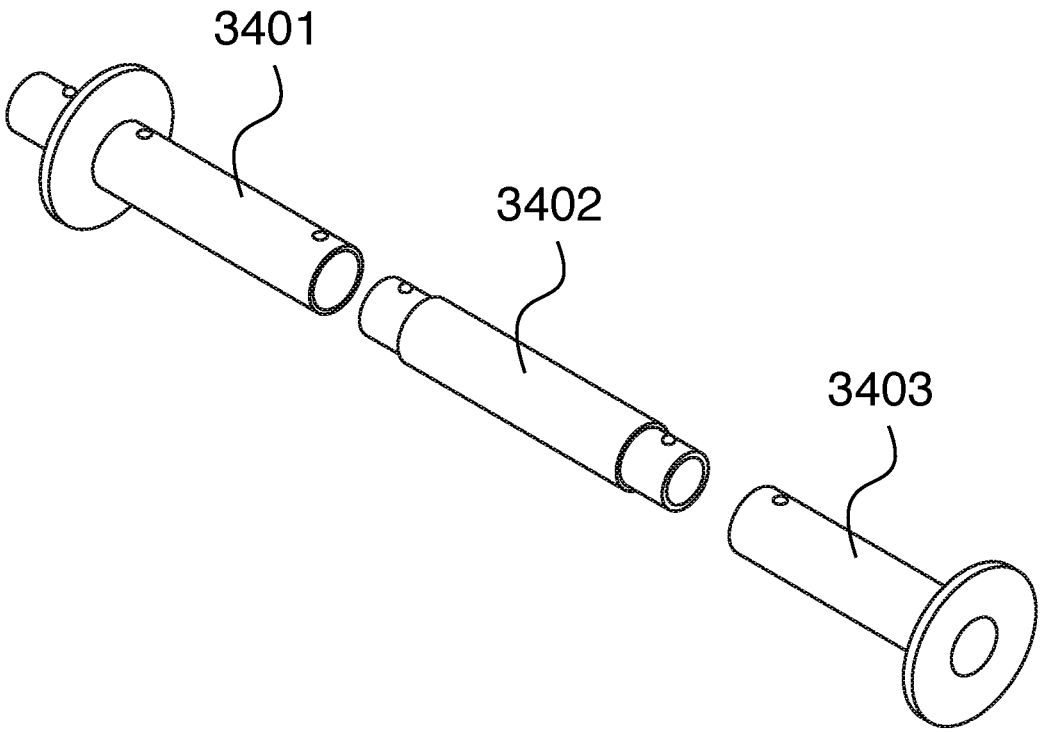
FIG. 35 is drawing illustrating attachments for the swing, according to an embodiment.

FIG. 34B is a drawing showing an entire swing and how it is connected to the swing attachment, according to an embodiment.

The swing 3400 comprises a left strap 3411 and a right strap 3410 which are connected so that the left strap 3411 and the right strap 3410 form a loop. The swing 3400 can be attached to the first swing connector 3401, second swing connector 3402, and third swing connector 3403 (once all three parts are connected) by looping the loop of the swing 3400 around the connectors 3401, 3402, 3403 as shown, and then pulling down on the swing 3400 to tighten the knot.

When the user is done using the swing, the user can simply untie the knot formed on the straps 3411, 3410 being wrapped around the connectors 3401, 3402, 3403 and remove the swing 3400 from the connectors 3401, 3402, 3403 for storage.

FIG. 35 is drawing illustrating attachments for the swing, according to an embodiment.

Shown are the first swing connector 3401, the second swing connector 3402, and the third swing connector 3403 all detached from each other. They all can attach to each other using any attachment mechanism described herein.

In a further embodiment, a climbing attachment can be attached to the integrated connector 103 which would allow a user to use for climbing by hooking a carabiner (or other type of) clip into it. The clip (carabiner or other) would have a rope attached to it so that it could be used for climbing (e.g., mountain climbing, etc.)

Figure 36A:
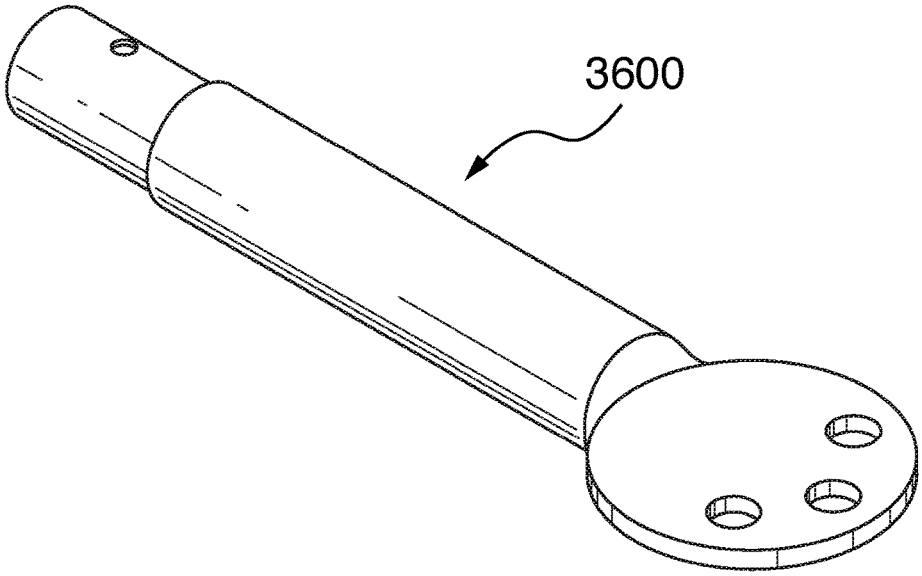
FIG. 36A is an orthographic view showing a climbing attachment, according to an embodiment.

FIG. 36A is an orthographic view showing a climbing attachment, according to an embodiment.

A climbing attachment 3600 is key shaped and can attach to the integrated connector 103.

Figure 36B:
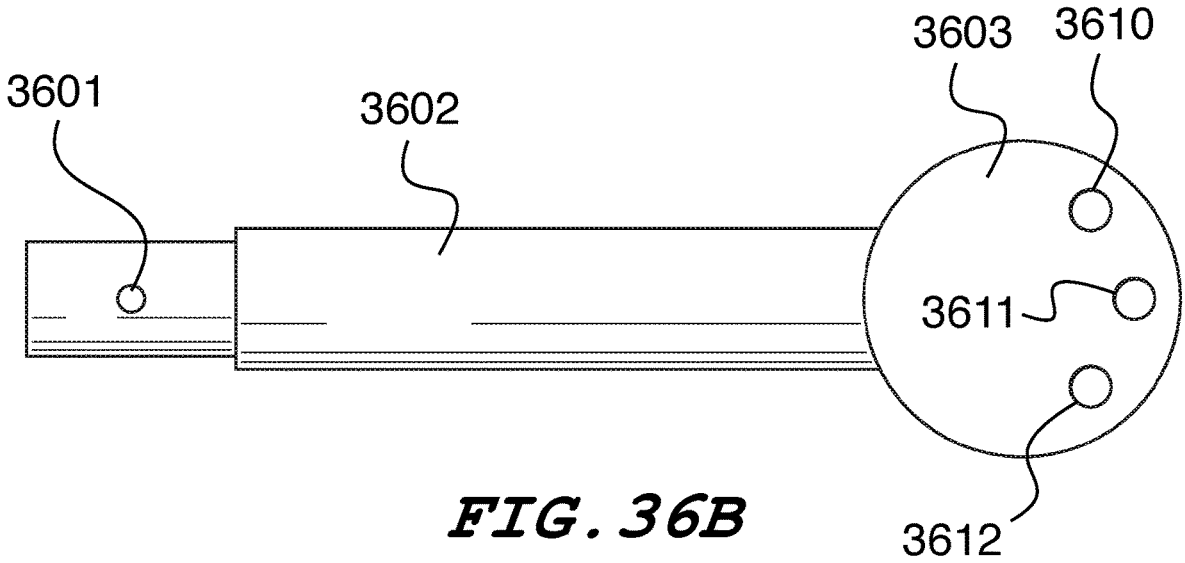
FIG. 36B is a top view of the climbing attachment, according to an embodiment.

FIG. 36B is a top view of the climbing attachment, according to an embodiment.

A hole 3601 in the climbing attachment is used to connect to the integrated connector 103 (or middle connector 200 or end connector 201). Note that when any attachment herein is connecting to the middle connector 200 it is assumed that the middle connector 200 is connected to the integrated connector 103. It is also assumed that when any attachment herein is connecting to the end connector 201 it is assumed that the end connector 201 is connected to the middle connector 200 which is connected to the integrated connector 103.

The climbing attachment 2600 has a shaft 3602 which connects to a head 3603. The head 3603 has three holes 3610, 3611, 3612 (although any number of holes can be used). The holes 3610, 3611, 3612 can be used to clip a carabiner (or other type) of clip on it which can be used for climbing.

Figure 37A:
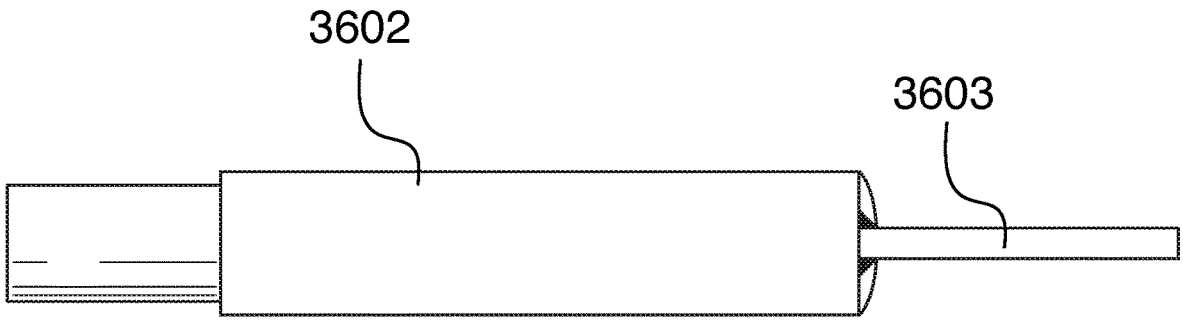
FIG. 37A is a side view of the climbing attachment, according to an embodiment.

FIG. 37A is a side view of the climbing attachment, according to an embodiment.

The shaft 3602 is integral to the head 3603.

Figure 37B:
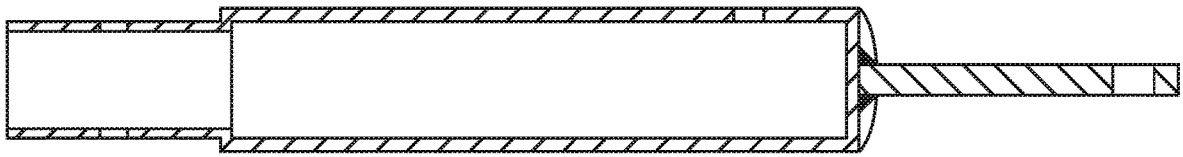
FIG. 37B is a cross section view of the climbing attachment, according to an embodiment.

FIG. 37B is a cross section view of the climbing attachment, according to an embodiment.

Figure 38:
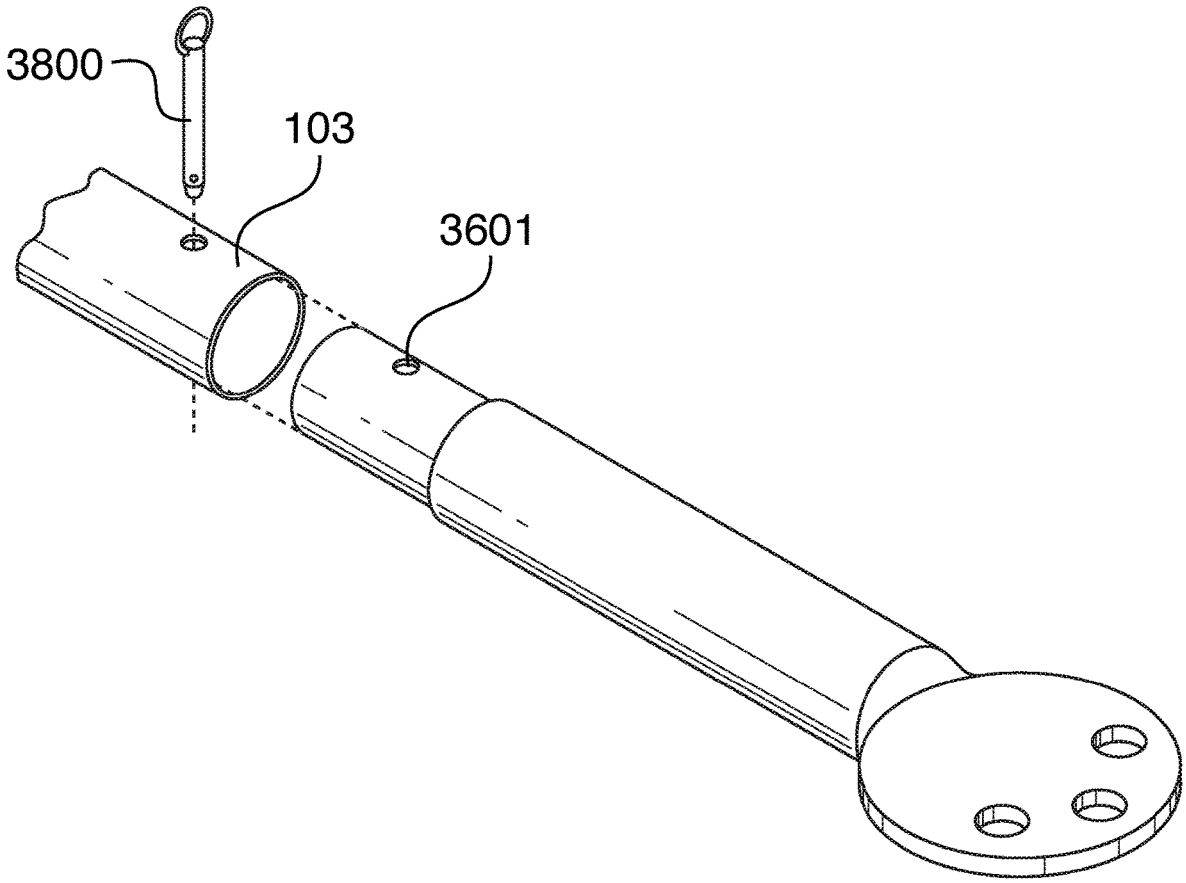
FIG. 38 is a drawing of the climbing attaching showing how it connects to the integrated connector, according to an embodiment.

FIG. 38 is a drawing of the climbing attaching showing how it connects to the integrated connector, according to an embodiment.

While a hole/button configuration can be used to attach the climbing apparatus to the integrated connector 103 (or the middle connector 200 or the end connector 201), because the climbing attachment can be used for climbing it may be desirable to be able to support heavier weights. Thus, the pin/hole configuration is preferred for the climbing attachment. The hole 3601 in the climbing attachment 3600 would be aligned with a hole in the integrated connector 103 and then a pin 3800 would be inserted through both holes thereby securing the integrated connector 103 to the climbing attachment 3600. A climber can have climbing equipment (e.g., a rope attached to a clip) which can clip into one of the holes 3610, 3611, 3611 and used to pull himself/herself up. The climber can release/remove the body 100 from the vertical structure, continue climbing and then attach the body 100 to a new vertical structure and the climbing attachment can be used again by climbers to climb towards using rope and clips. This can assist additional climbers in the climber's party to climb up a mountain (or other path, etc.)

In a further embodiment, attachments can be utilized to form a stool which rests on the ground. This embodiment is illustrated in FIGS. 39-41B.

Figure 39:
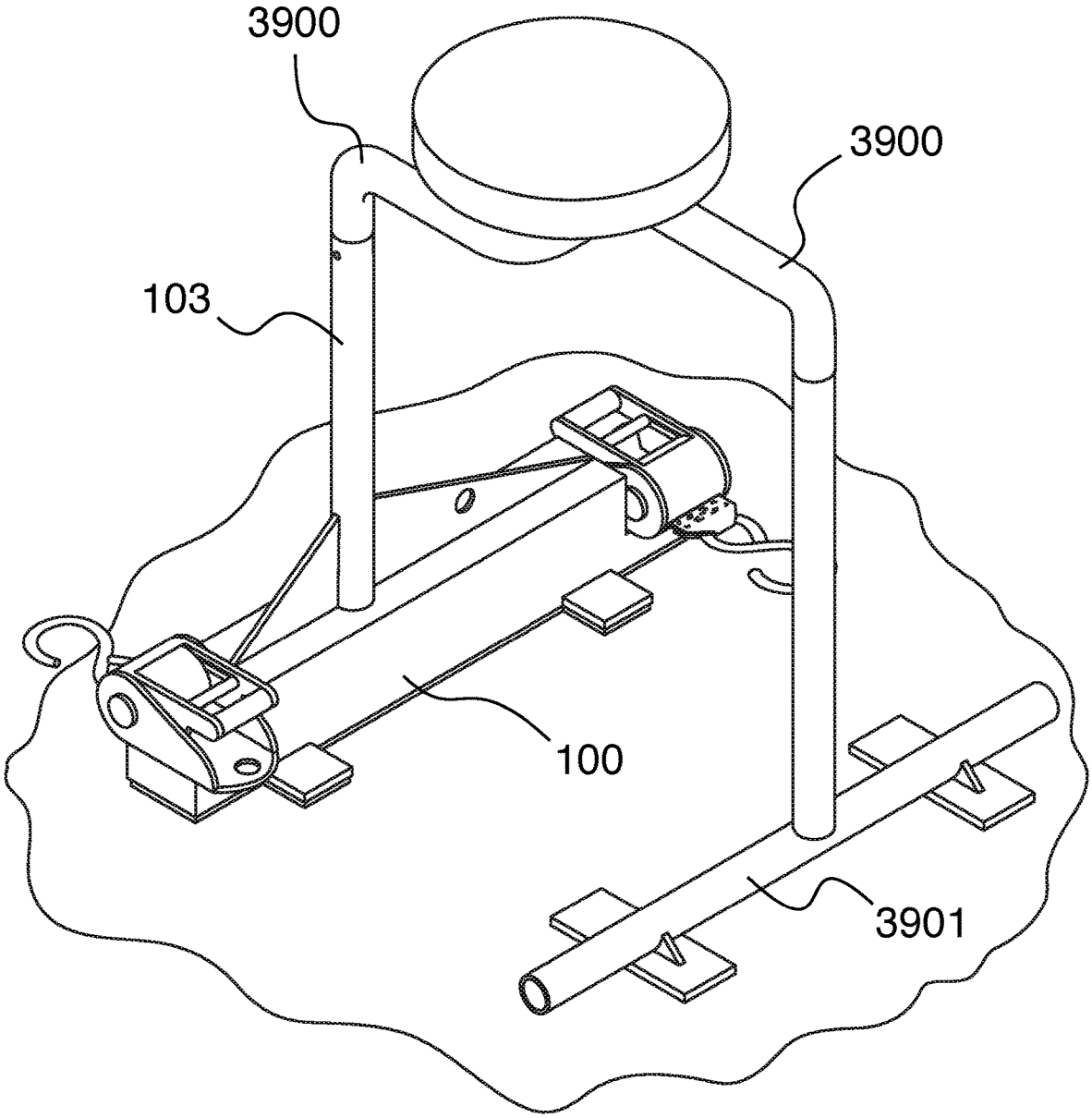
FIG. 39 is a drawing showing a set of attachments to form a stool, according to an embodiment.

FIG. 39 is a drawing showing a set of attachments to form a stool, according to an embodiment.

A stool attachment 3900 attaches to the integrated connector 103 and a stool base 3901. Note that the body 100 is resting on the ground, which is different than all of the other attachments illustrated herein utilize the body 100 attached high on a vertical structure. The stool base 3901 also rests on the ground and serves as support for the stool attachment 3900.

Figure 40:
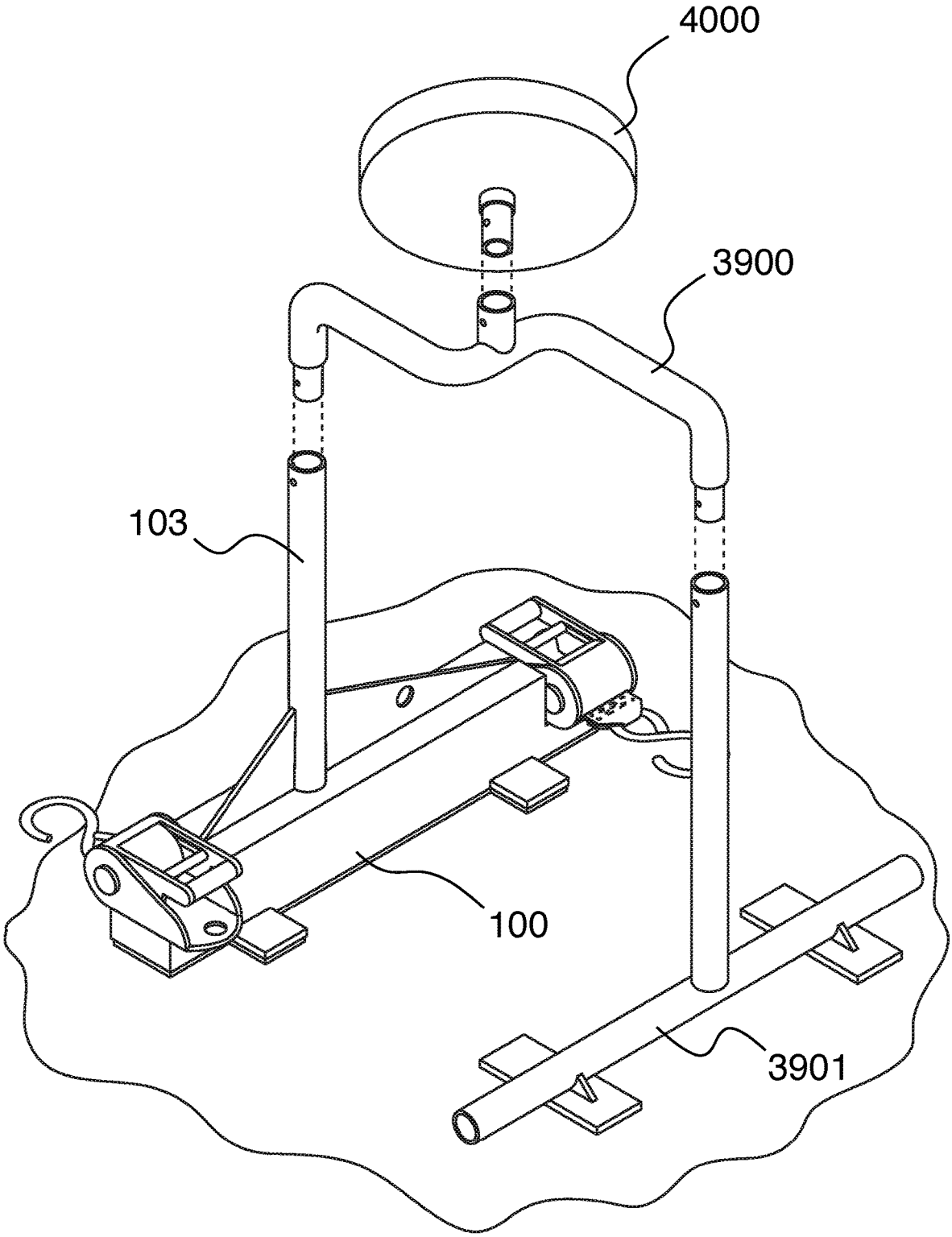
FIG. 40 is a drawing showing the assembly of the attachments to form a stool, according to an embodiment.

FIG. 40 is a drawing showing the assembly of the attachments to form a stool, according to an embodiment.

A stool 4000 attaches to the stool attachment 3900 using an attachment mechanism such as button/hole, etc. The stool attachment 3900 has two arms in which one arm attaches to the integrated connector 103 and the other arm attaches to the stool base 3901. Once assembled, a user can sit on the stool 4000.

Figure 41A:
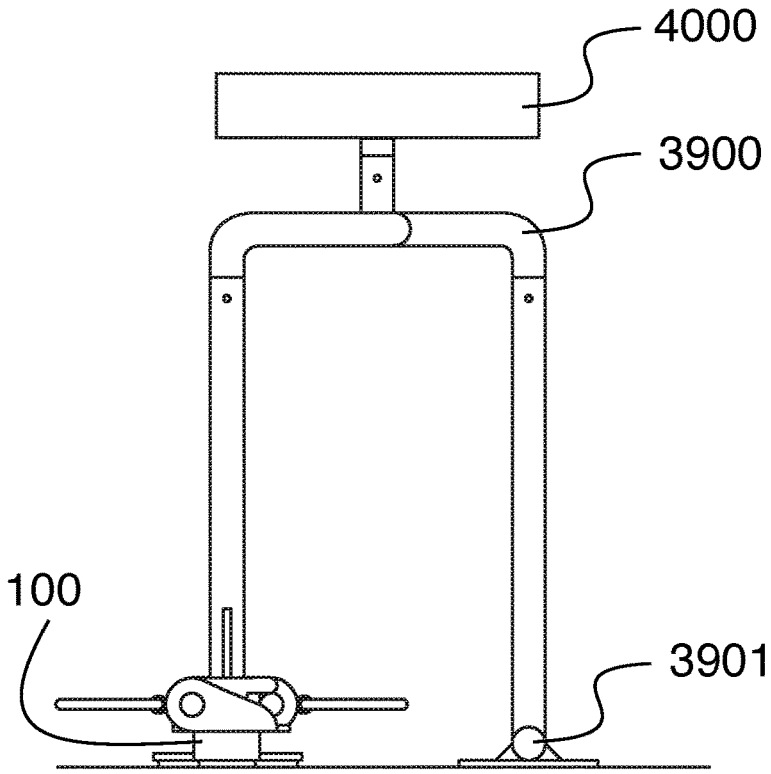
FIG. 41A is a side view of the assembled stool, according to an embodiment.

FIG. 41A is a side view of the assembled stool, according to an embodiment.

Figure 41B:
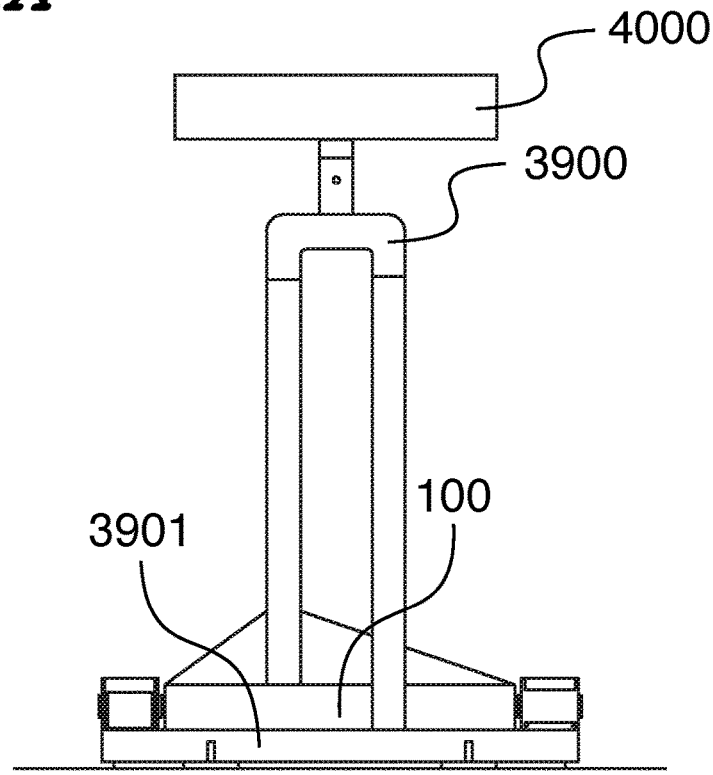
FIG. 41B is a front view of the assembled stool, according to an embodiment.

FIG. 41B is a front view of the assembled stool, according to an embodiment.

Figure 42A:
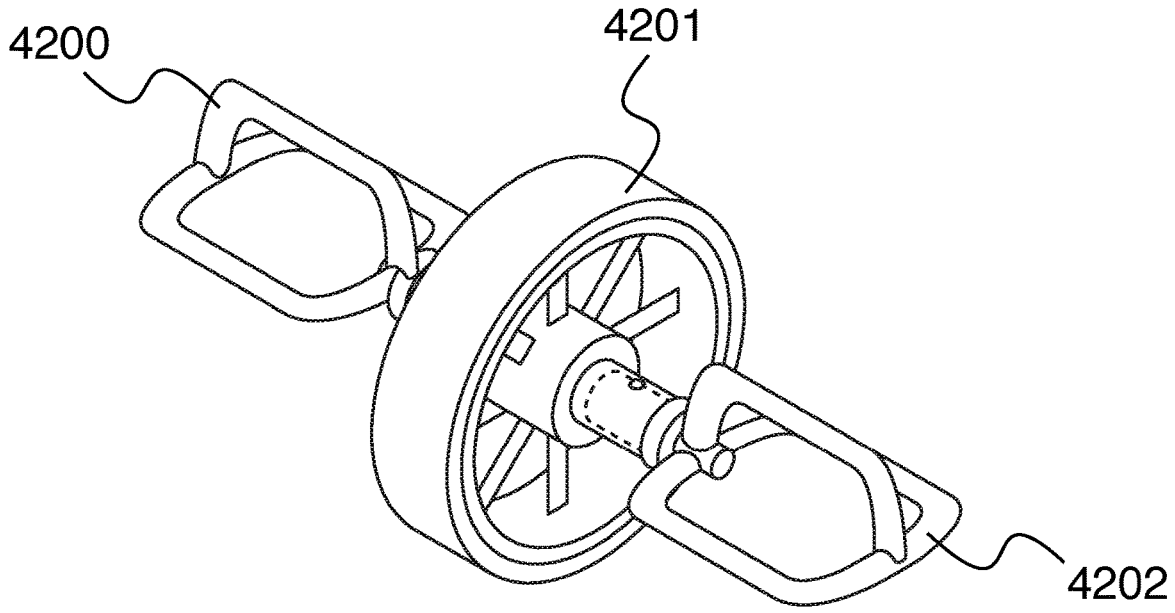
FIG. 42A is a drawing showing an assembled wheel with pedals, according to an embodiment.

In a further embodiment, a wheel can be formed and utilized with the apparatus for exercising. FIGS. 42-45 illustrate this embodiment;

FIG. 42A is a drawing showing an assembled wheel with pedals, according to an embodiment.

A wheel 4201 is connected to a first pedal 4200 and a second pedal 4202. The pedals 4200, 4202 turn the wheel 4201.

Figure 42B:
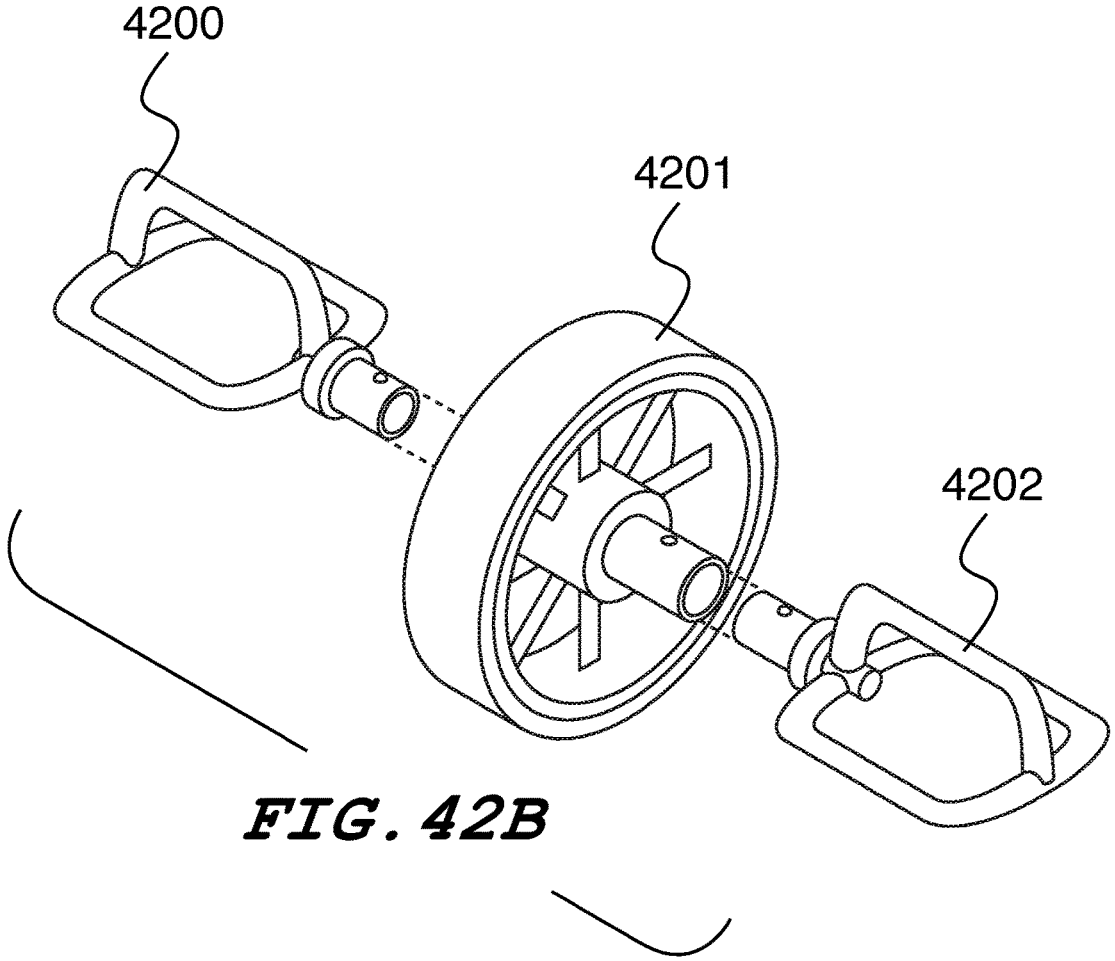
FIG. 42B is a drawing showing the assembly of the wheel with pedals, according to an embodiment.

FIG. 42B is a drawing showing the assembly of the wheel with pedals, according to an embodiment.

The first pedal 4200 attaches to the wheel and the second pedal 4202 attaches to the wheel. The attachments are made using a hole/button configuration, although any other attachment mechanism can be used.

Figure 43:
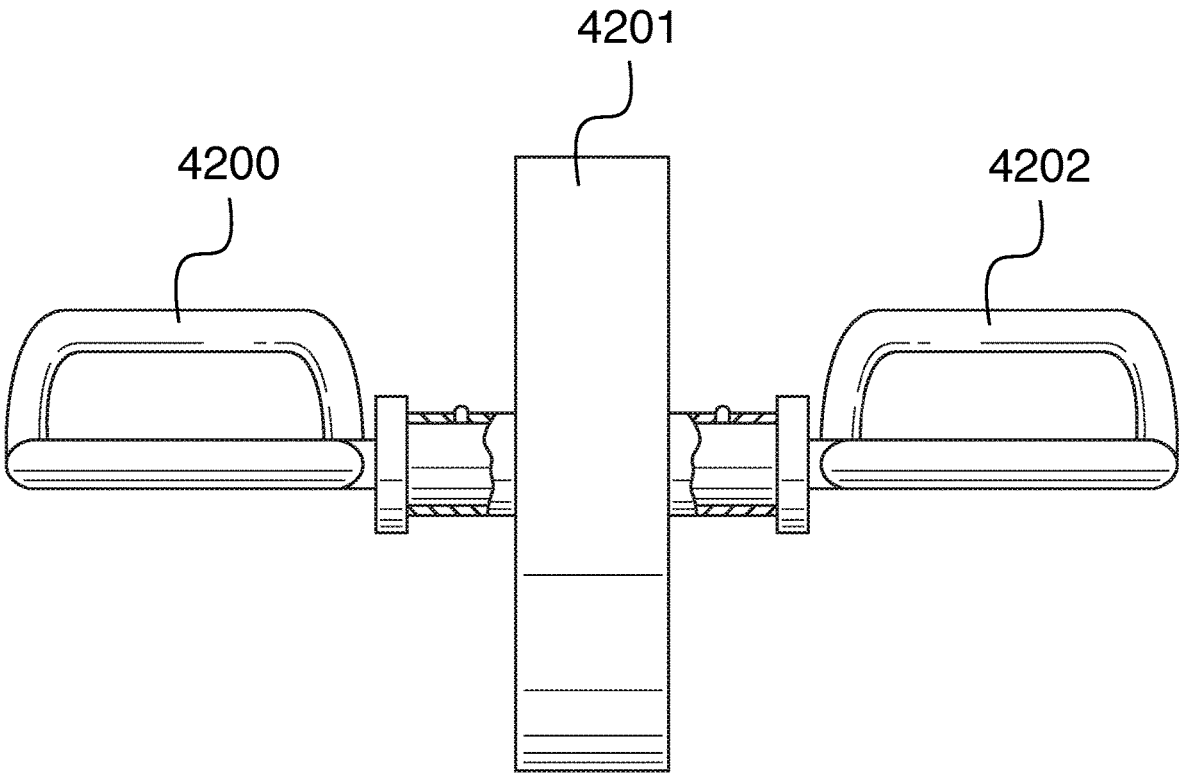
FIG. 43 is a front view of the wheel, according to an embodiment.

FIG. 43 is a front view of the wheel, according to an embodiment.

Figure 44:
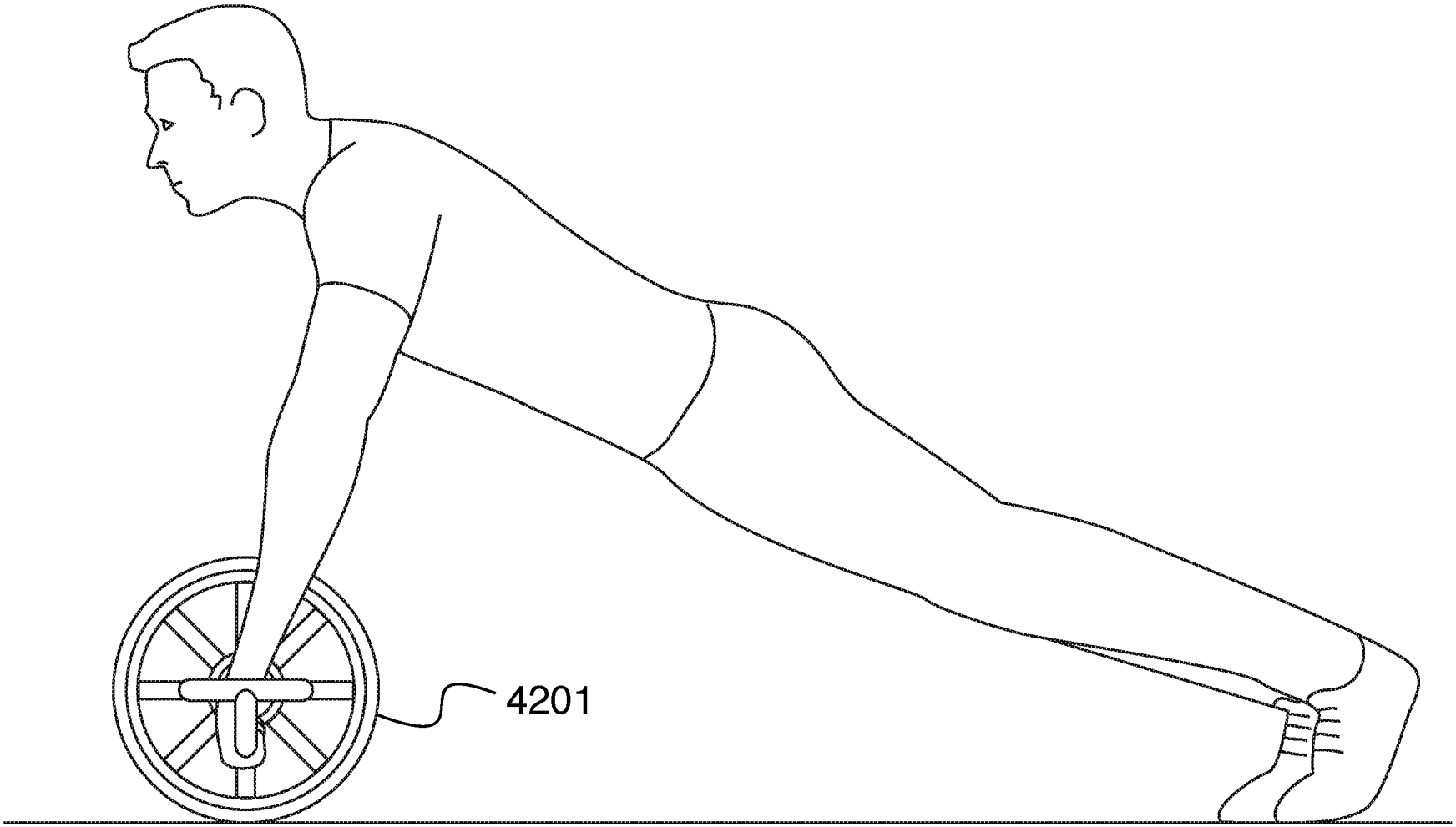
FIG. 44 shows a user exercising with the wheel, according to an embodiment.

FIG. 44 shows a user exercising with the wheel, according to an embodiment.

One exercise a user can do is place his/her left hand in the first pedal 4200 and place his/her right hand in the second pedal 4202 and pedal the wheel 4201 using his/her hands with his/her feet on the ground, as shown.

Figure 45:
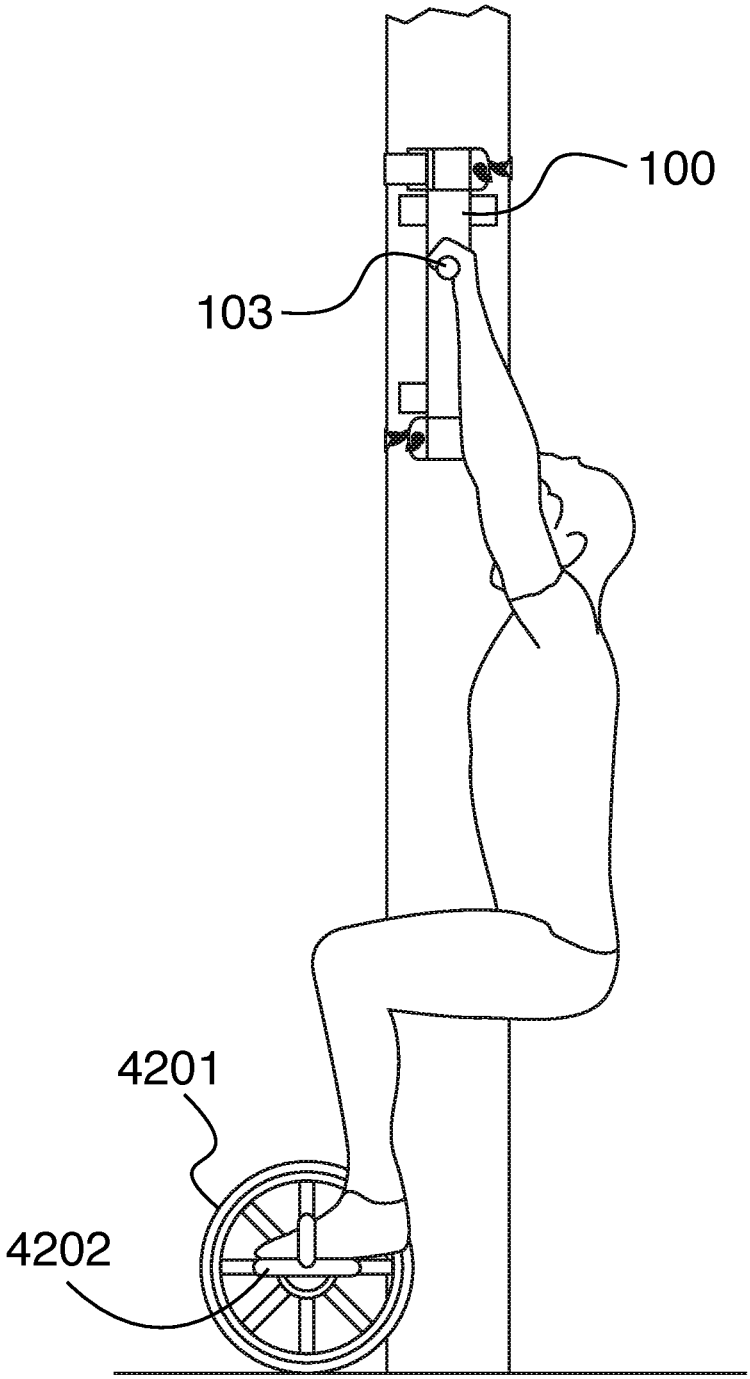
FIG. 45 shows a user exercising with the wheel while grabbing onto the integrated connector 103 (or middle connector 200 or end connector 201), according to an embodiment.

FIG. 45 shows a user exercising with the wheel while grabbing onto the integrated connector 103 (or middle connector 200 or end connector 201), according to an embodiment.

The user is grabbing onto the integrated connector 103 (although the user can be grabbing onto the middle connector 200 which is attached to the integrated connector 103, or the end connector 202 which is attached to the middle connector 200 which is attached to the integrated connector 103). The user's feet are in each of the pedals 4200, 4202, and the user can continuously pedal the wheel 4201 forward and backward for exercise while holding onto the integrated connector 103 (or middle connector 200 or end connector 201).

In a further embodiment, an indoor mount (on a wall) of the body/integrated connector/pulley plate, etc., is used so a user can utilize the apparatus indoors. This can allow the user to perform a variety of exercises and physical activity while being safely indoors. For example, the user can attach a bench to the integrated connector to perform exercises. The bench can also fold up and be stored in a convenient manner when not in use.

Figure 46:
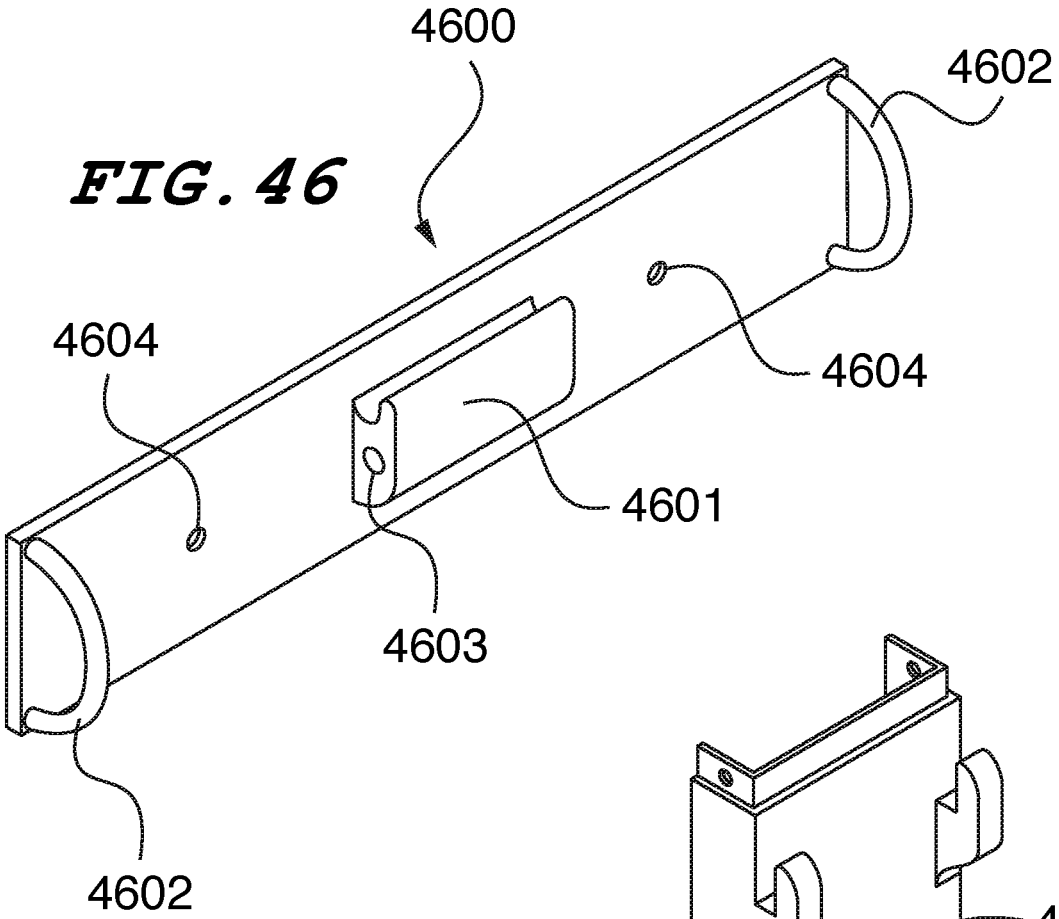
FIG. 46 is a drawing of a spine brace, according to an embodiment.

FIG. 46 is a drawing of a spine brace, according to an embodiment.

A spine brace 4600 mounts to a wall. Spine brace holes 4604 are used to nail the spine brace 4600 into the wall (preferably where the wall studs are). A plurality of such spine braces 4600 are mounted to the wall. A plurality of brace connectors 4602 can be used to receive a carabiner clip(s). Spine brace holes 4604 are used to drive a nail (or screw, etc.) therethrough into a wall.

Attached to the spine brace 4600 is a male adapter 4601 which has an adapter hole 4603 running through the entire length of the male adapter 4601 which is used to receive a spine cross pin.

Figure 47:
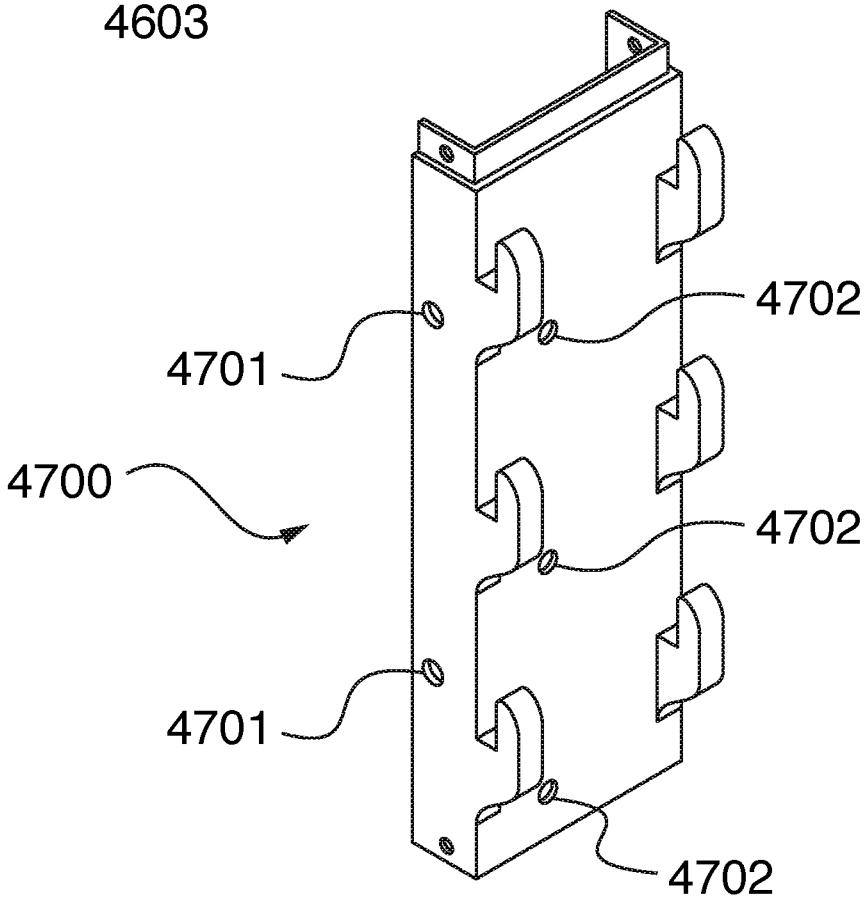
FIG. 47 is a drawing of a spine section, according to an embodiment.

FIG. 47 is a drawing of a spine section, according to an embodiment.

A spine section 4700 is used to form a spine and can be exactly or approximately 3 feet long. The spine section 4700 has spine section side holes 4701 and spine section front holes 4702.

Figure 48:
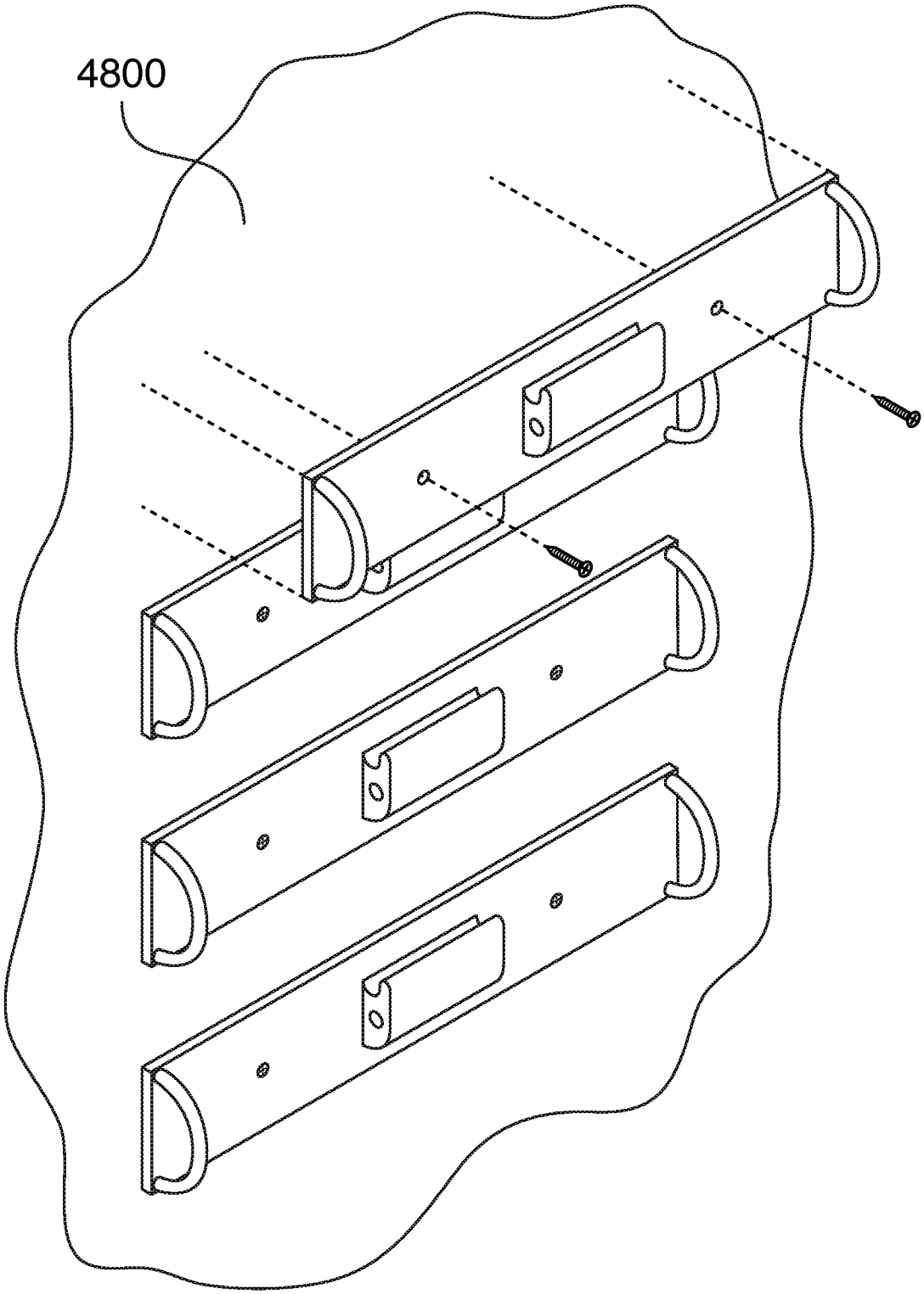
FIG. 48 is a drawing of a plurality of spine braces mounted on a wall, according to an embodiment.

FIG. 48 is a drawing of a plurality of spine braces mounted on a wall, according to an embodiment.

Four spine braces 4600 are mounted to a wall 4800 by hammering nails through each spine brace hole 4604. They should be aligned horizontally (as shown) and equally spaced vertically a predetermined distance apart from each other (e.g., 1 to 12 inches apart or other distance). The bottom brace could be a distance higher than the floor, for example, 1 to 3 feet or other distance).

Figure 49:
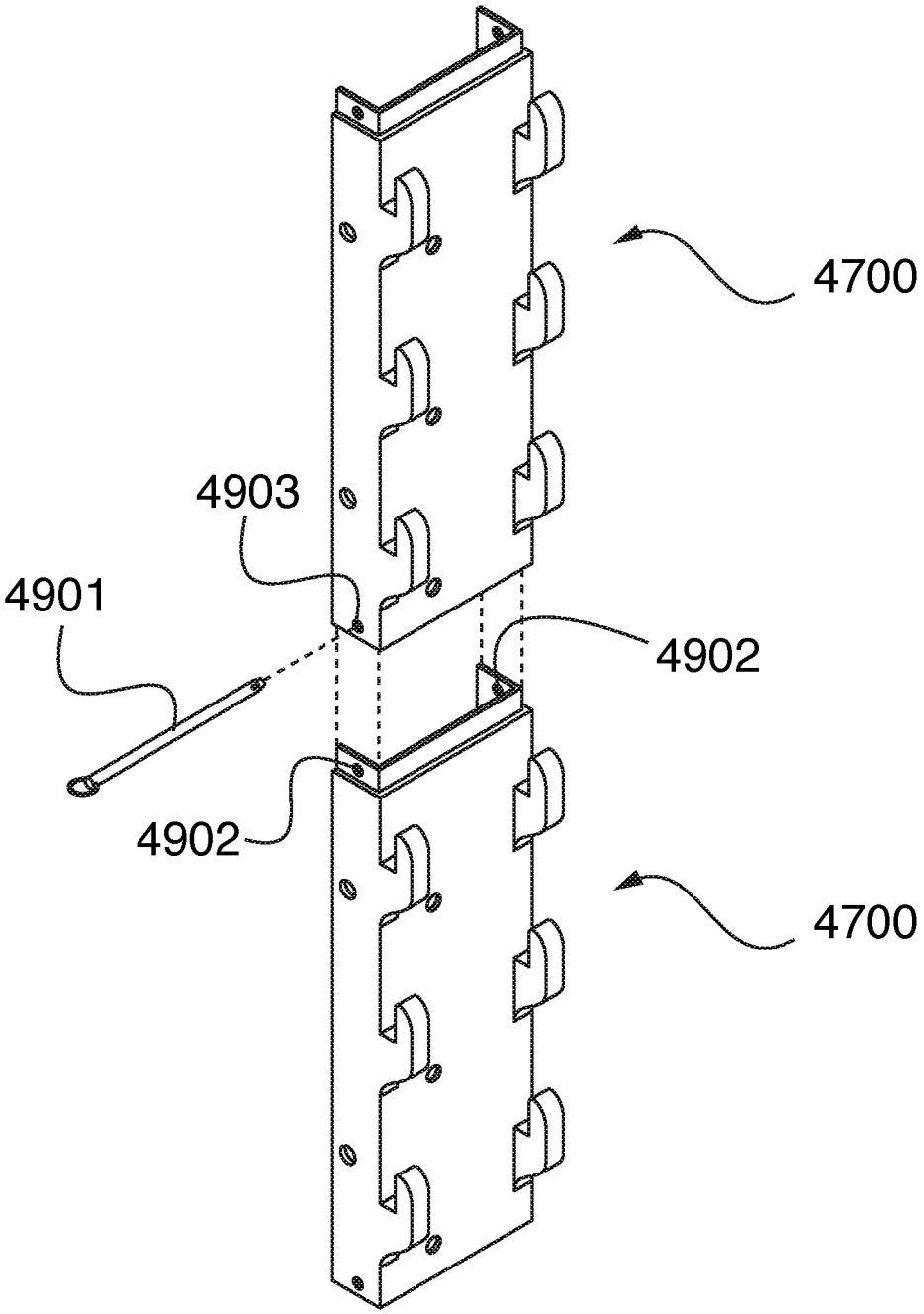
FIG. 49 is a drawing of two spine sections combined, according to an embodiment.

FIG. 49 is a drawing of two spine sections combined, according to an embodiment.

Each spine section 4700 is identical and has an aligned top pair of side holes 4902 and an aligned bottom pair of side holes 4903. One spine section 4700 is inserted into the other spine section 4700 as shown in FIG. 49 in order to create a spine (two spine sections 4700). When the spin sections 4700 are connected, the bottom pair of side holes 4903 is aligned with the top pair of side holes 4902. A spine joining pin 4901 is inserted through the bottom pair of side holes 4903 and the top pair of side holes 4902 (four holes all together) in order to securely connect both spine sections to each other. The spine joining pin 4901 would protrude out of the other (right side as shown in FIG. 49) side after being fully inserted (into the left side as shown in FIG. 49). Once assembled, the spine can also be easily disassembled by pulling out the spine joining pin 4901 and then separating the two spine sections.

Figure 50:
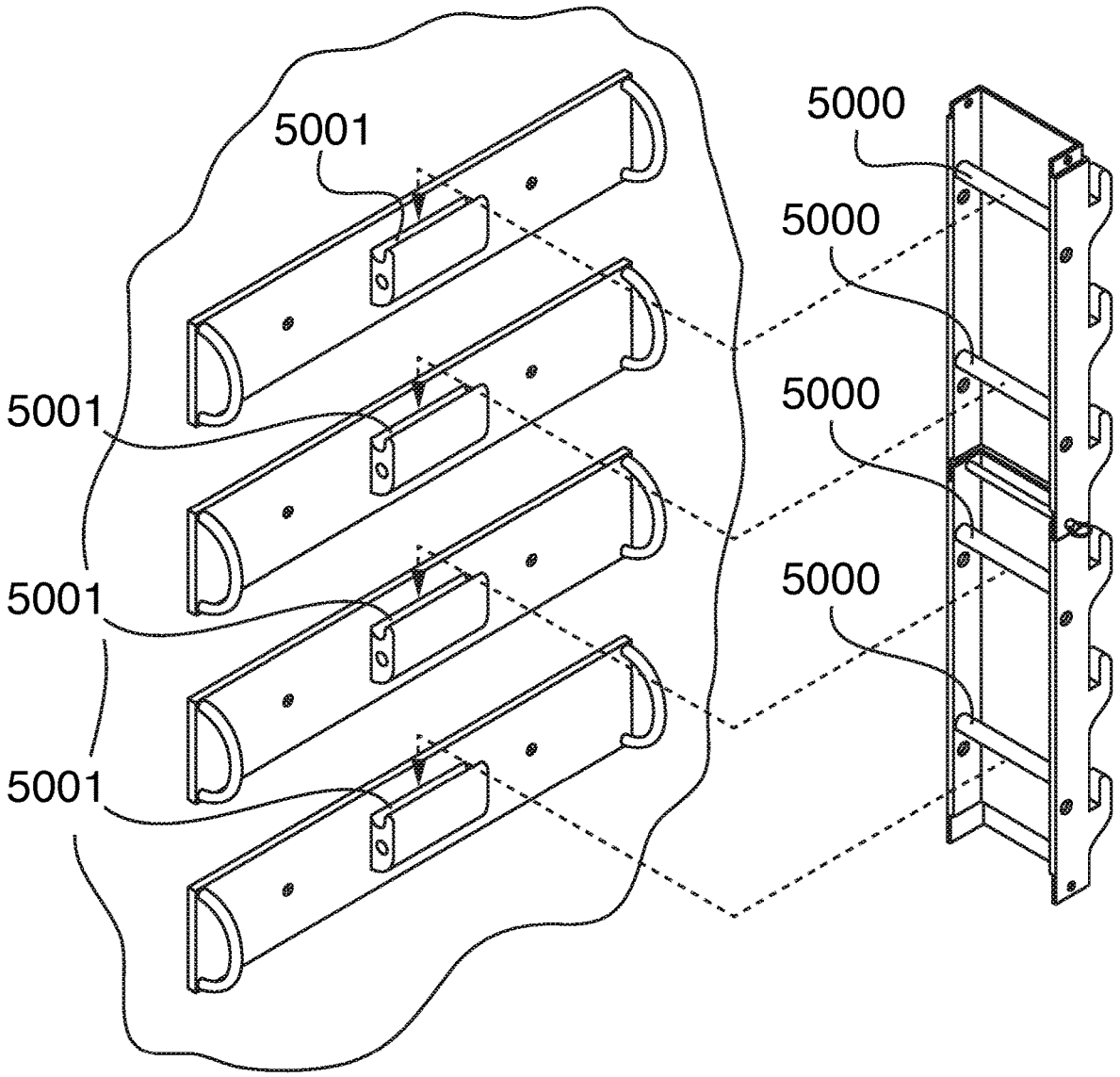
FIG. 50 is a drawing showing how a spine is mounted on four spine segments mounted on a wall, according to an embodiment.

FIG. 50 is a drawing showing how a spine is mounted on four spine segments mounted on a wall, according to an embodiment.

Each spine section 4700 has two dowels 5000 which each fit into a slot 5001 on each of the spine braces 4600.

Figure 51:
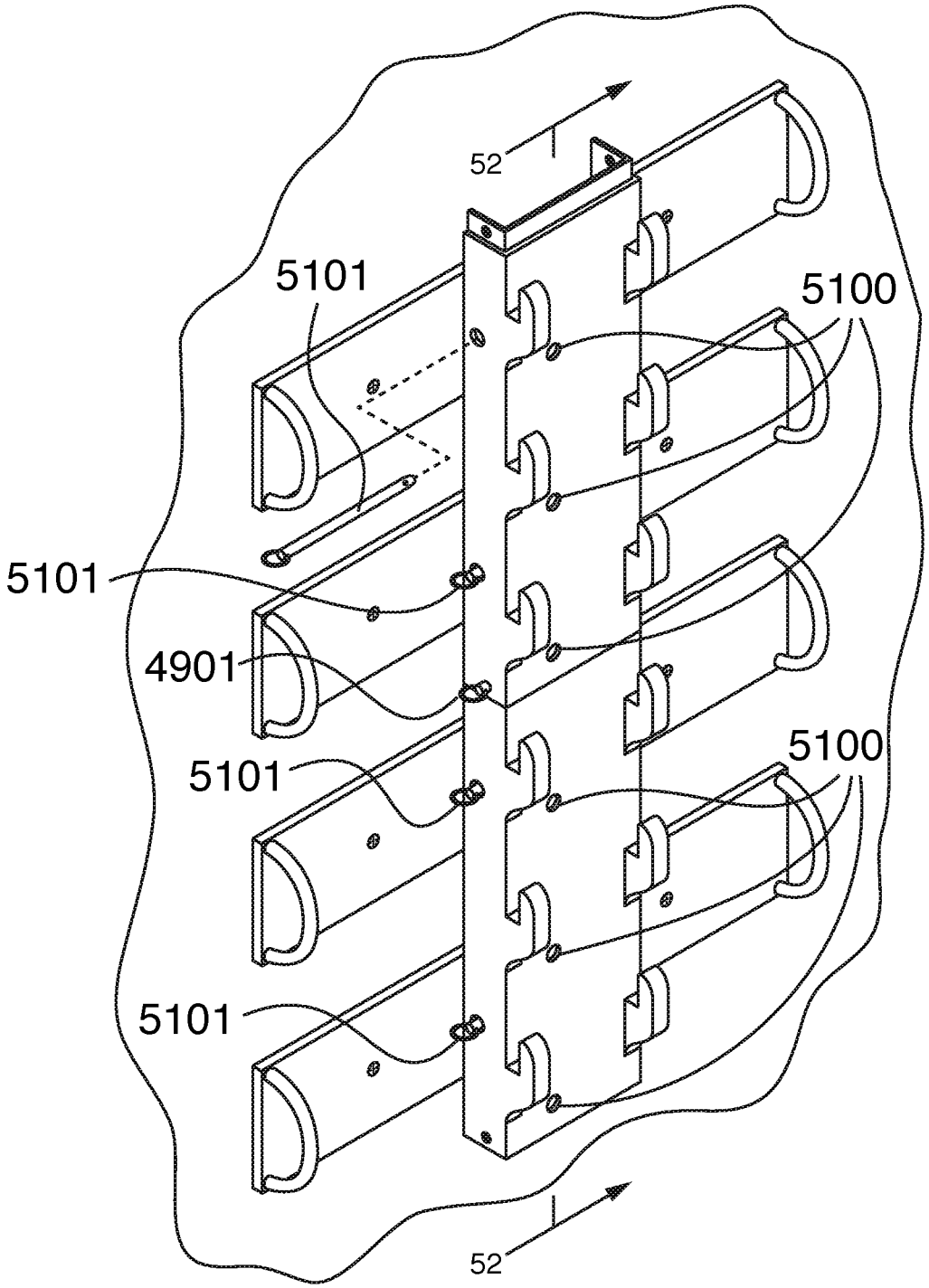
FIG. 51 is a drawing showing a spine mounted on the spine segments which is mounted on a wall, according to an embodiment.

FIG. 51 is a drawing showing a spine mounted on the spine segments which is mounted on a wall, according to an embodiment.

Figure 52:
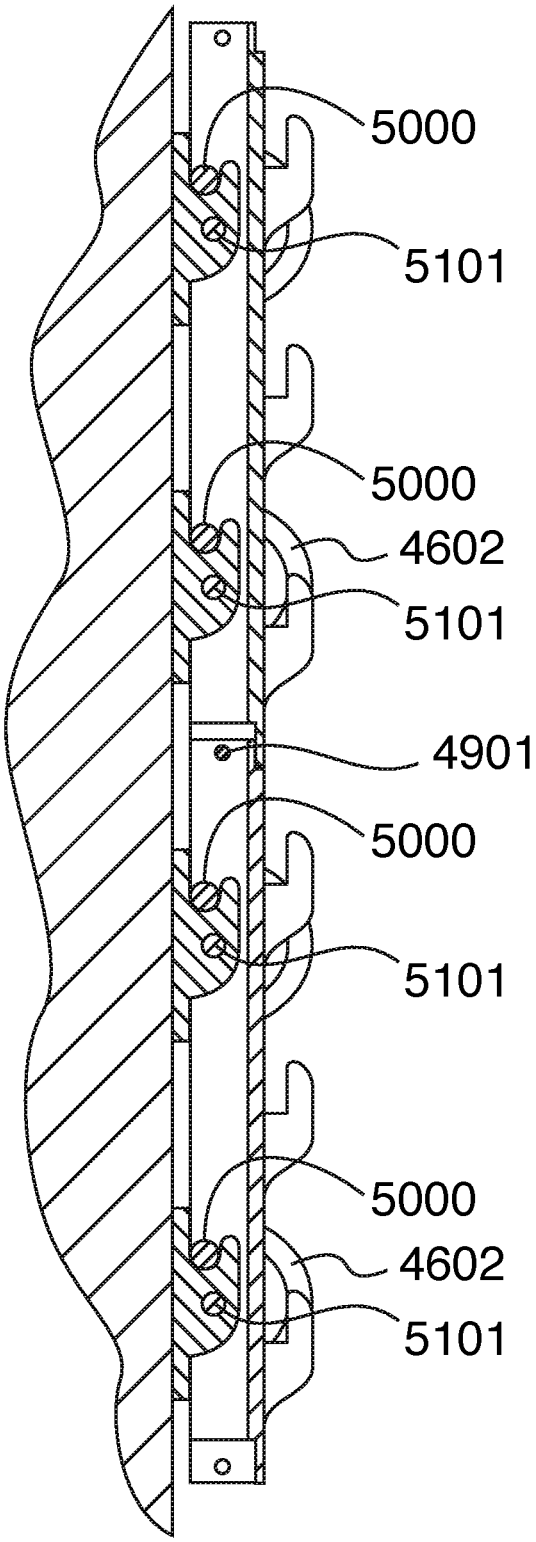
FIG. 52 is a cross section of the spine and spine mounts from the view being shown in FIG. 51, according to an embodiment.

A plurality of spine cross pins 5101 is inserted through a spine hole 4701, then through the adapter hole 4603 in the spine brace 4600 behind that portion of the spine and then out through another spine hole 4701 (see FIG. 52 which shows how the spine cross pins 5101 goes through a spine hole then through the adapter hole 4603 and then through another aligned spine hole 4701). The spine cross pin 5101 when fully inserted through a pair of spine holes 4701 and the adapter hole 4603 (between the pair of spine holes) maintains a stable connection between the spine and each spine brace 4600.

Thus, in FIG. 51, there are four spine cross pins 5101 each inserted through their respective spine section side holes 4701 with a respective adapter hole 4603 therebetween. Each spine section has three spine holes 5100 (used for attaching the body 100).

FIG. 52 is a cross section of the spine and spine mounts from the view being shown in FIG. 51, according to an embodiment.

Figure 53:
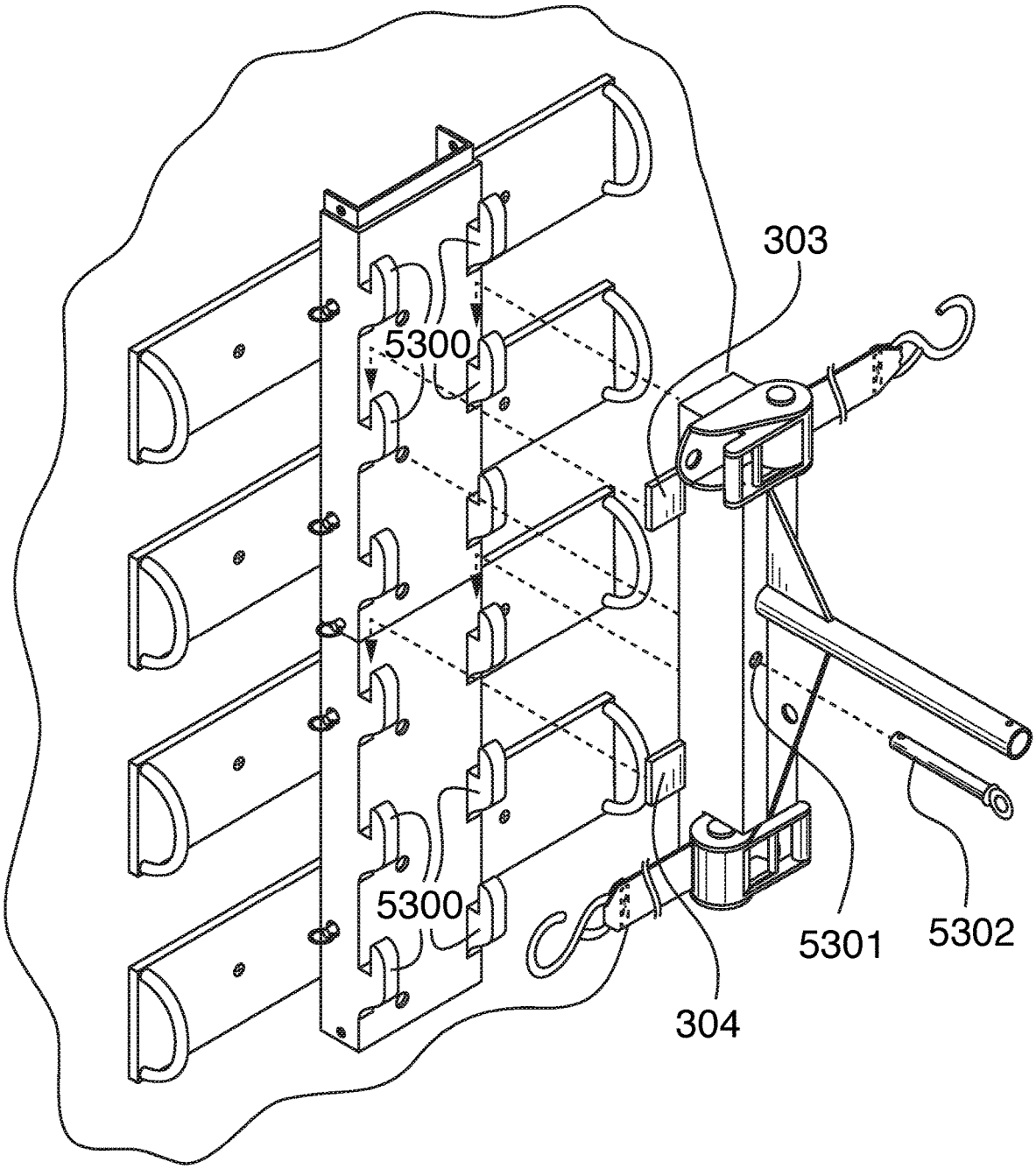
FIG. 53 is a drawing showing the body and integrated connector being mounted onto the spine, according to an embodiment.

FIG. 53 is a drawing showing the body and integrated connector being mounted onto the spine, according to an embodiment.

A body 100 connected to the integrated connector 103 and is attached to upper support 303 and lower support 304. The body 100 is mounted onto the spine by resting the upper support 103 and the lower support 104 onto respective hooks 5300 on the spine. Thus, there are two pairs of hooks that the body 100 is rested on, one pair of hooks for the upper support 303 and a lower pair of hooks for the lower support 104. A body hole 5301 is adapted to receive a spine mount pin 5302.

Note that in an embodiment, the body 100 does not need to have the ratchet assemblies and their straps, as the body 100 does not use the ratchet assemblies and their straps to attach to the spine.

Figure 54:
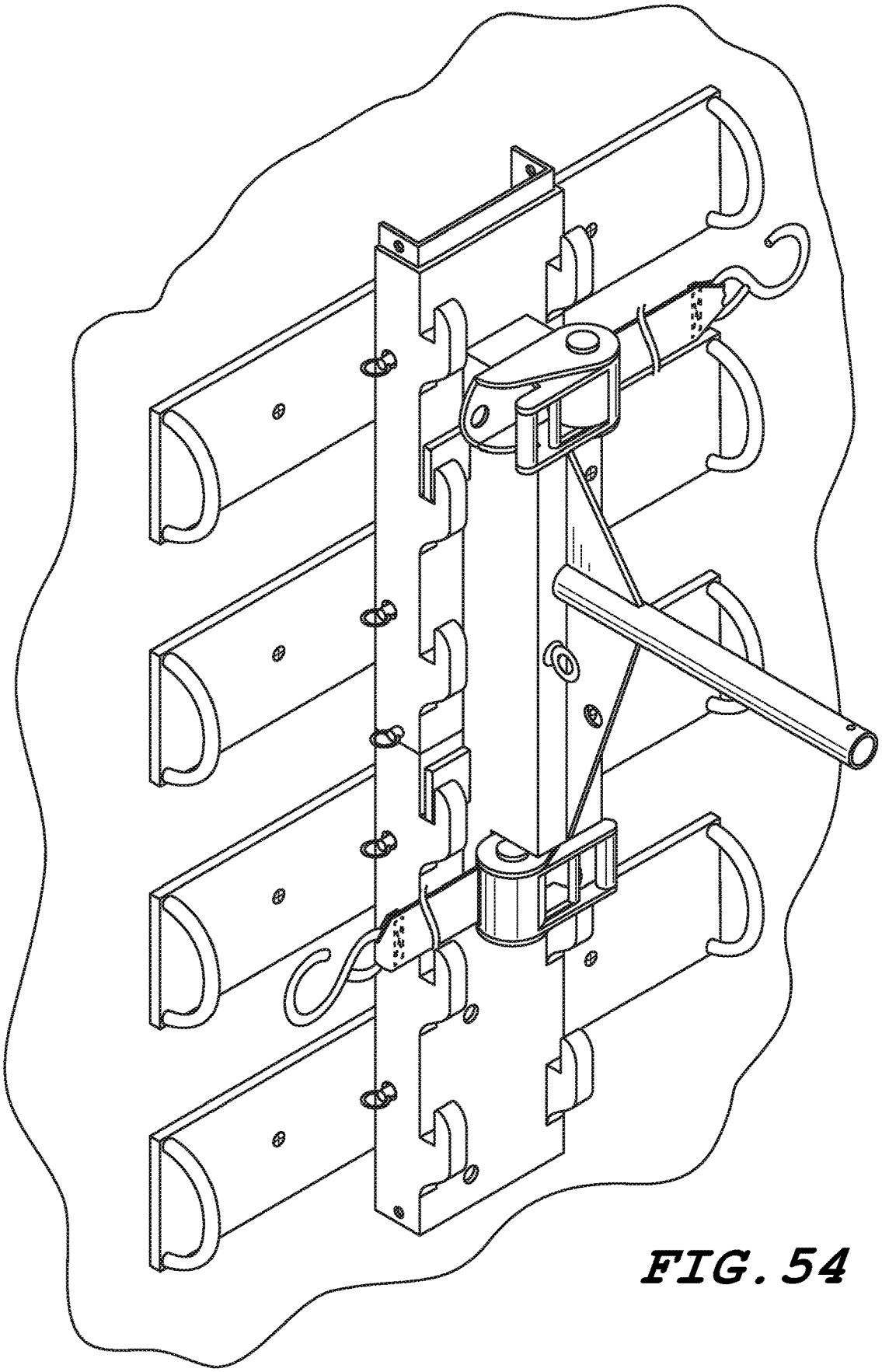
FIG. 54 is a drawing showing the body and integrated connector mounted onto the spine, according to an embodiment.

FIG. 54 is a drawing showing the body and integrated connector mounted onto the spine, according to an embodiment.

The spine mount pin 5302 is inserted into the body hole 5301 and through the respective spine hole 5100, thereby locking the body 100 to the spine. Note that the hooks 5300 receive the upper support 303 and the lower support 304 such that the body 100 cannot be pulled off the spine horizontally because the hooks 5300 will prevent such removal. If the user wishes to remove the body 100 from the spine, the user can remove (pull out) the spine mount pin 5302 and then lift the body 100 in an upward direction (off the hooks 5300) and then the body 100 can be removed from the spine.

Figure 55:
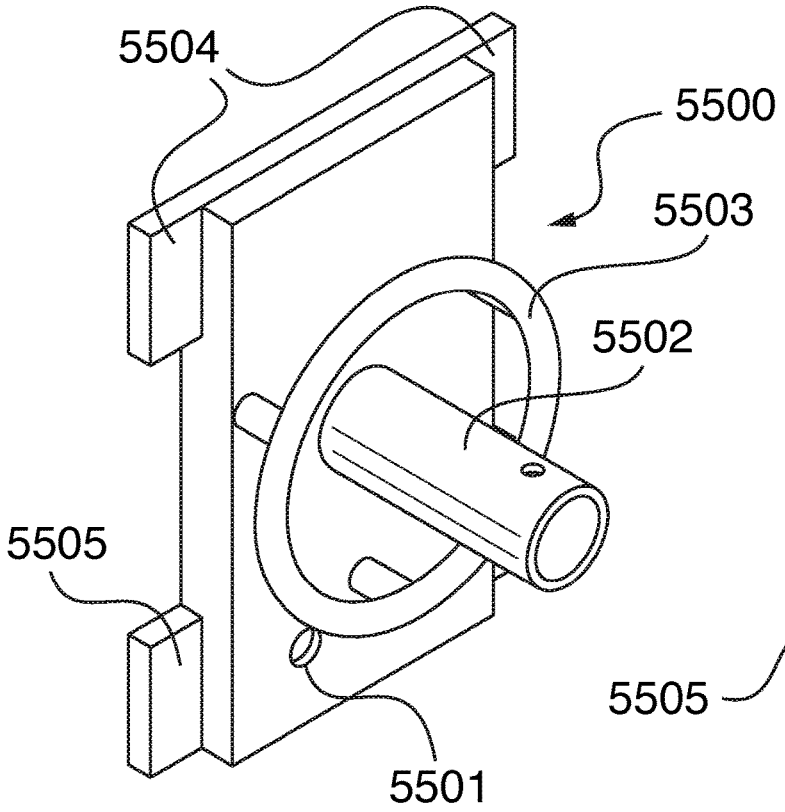
FIG. 55 is a drawing of a pulley plate, according to an embodiment.

FIG. 55 is a drawing of a pulley plate, according to an embodiment.

A pulley plate 5500 attaches to the spine in a same manner that the body 100 does. The pulley plate 5500 has a top support 5504 and a bottom support 5505 which serve to rest on the hooks 5300 to keep the pulley plate 530 secure on the spine (in the same manner that the upper support 303 and the lower support 304 serve to keep the body 100 secure on the spine). A pulley connector 5502 connects to the integrated connector 103 in a same manner as any other connector can connect to the integrated connector 103. A pulley hole 5501 can be used to insert a pulley pin 5800 therethrough. A pulley ring 5503 is used to clip a carabiner clip onto.

Figure 56:
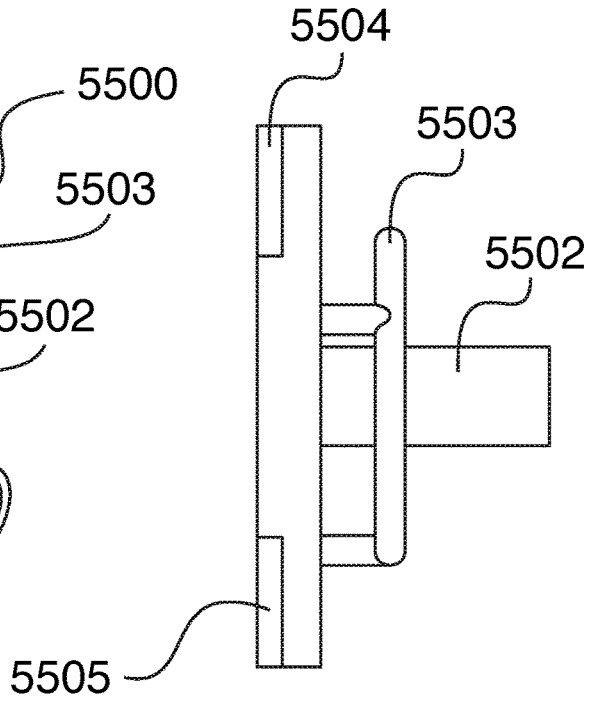
FIG. 56 is a drawing of a side view of the pulley plate, according to an embodiment.

FIG. 56 is a drawing of a side view of the pulley plate, according to an embodiment.

Figure 57:
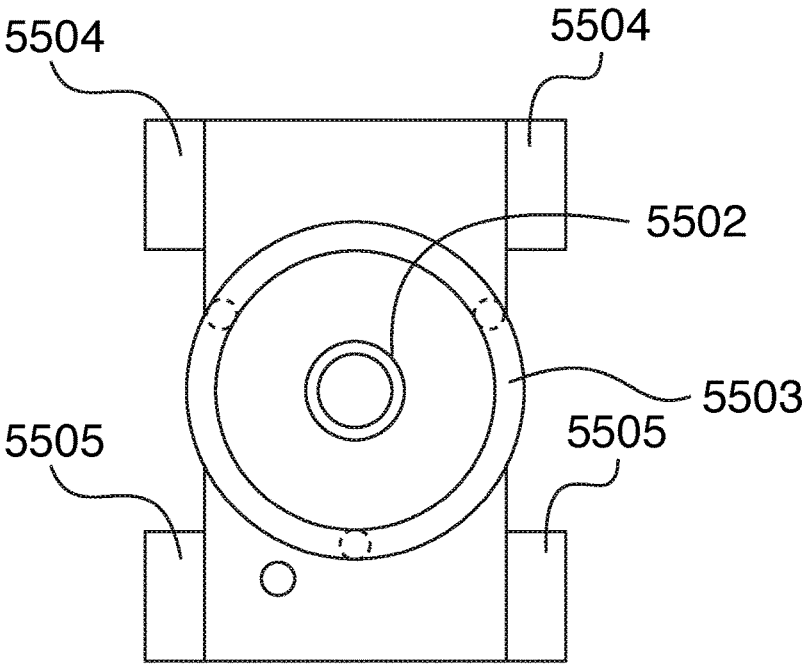
FIG. 57 is a drawing of a top view of the pulley plate, according to an embodiment.

FIG. 57 is a drawing of a top view of the pulley plate, according to an embodiment.

Figure 58:
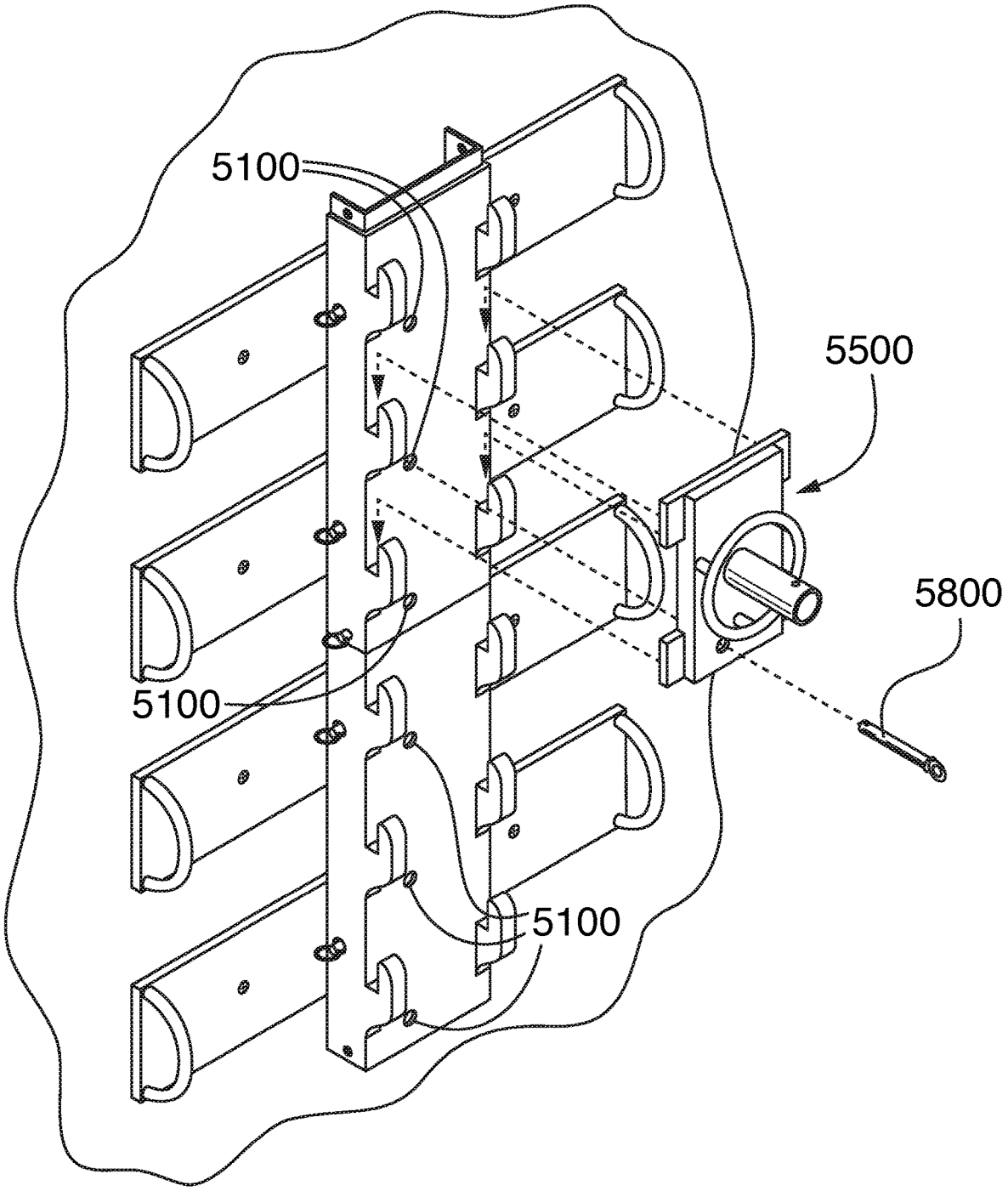
FIG. 58 is a drawing showing a pulley plate being mounted onto a spine, according to an embodiment.

FIG. 58 is a drawing showing a pulley plate being mounted onto a spine, according to an embodiment.

The pulley plate 5500 is being mounted onto the spine. The pulley pin 5800 is inserted through the pulley hole 5501 and into one of the spine holes 5100, thereby securing the pulley plate 5500 to the spine.

Figure 59:
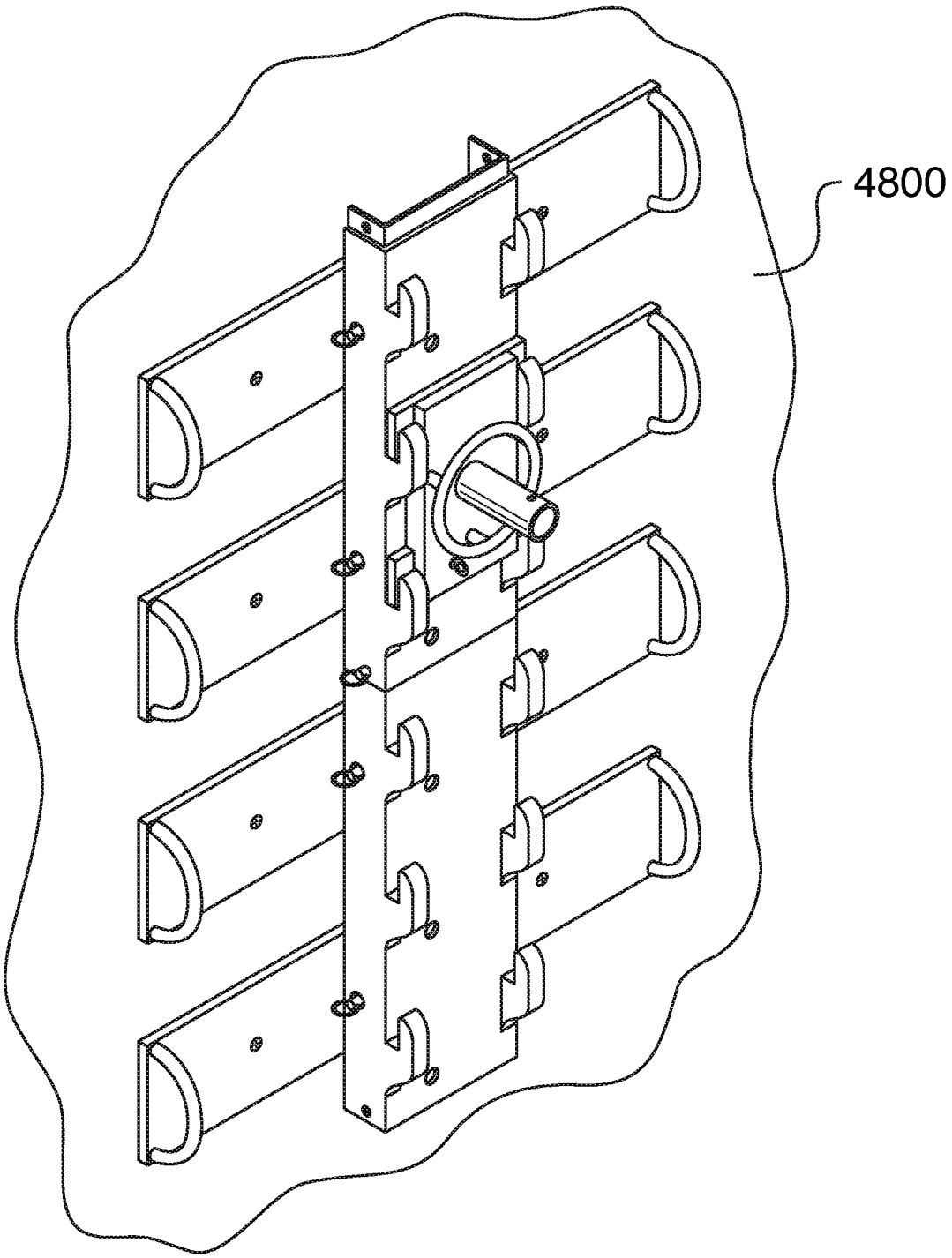
FIG. 59 is a drawing showing the pulley plate mounted onto the spine, according to an embodiment.

FIG. 59 is a drawing showing the pulley plate mounted onto the spine, according to an embodiment.

A carabiner clip can have a resistance cord (also known as a resistance strap or resistance band, etc.) connected to it. A resistance cord is a cord of an elastic material (e.g., rubber, bungee, nylon, etc.) which stretches but has resistance thereby enabling the user to pull on the resistance cord and exercise his/her muscles. The carabiner clip can clip onto the pulley ring 5503 or one of the brace connectors 4602. The pulley plate 5500 is securely mounted into the spin and thus when the carabiner clip is clipped onto the pulley plate, pulling hard on the resistance cord would not pull out the pulley plate 5500 (or the spine brace 4600 which is securely mounted to the wall).

Figure 60:
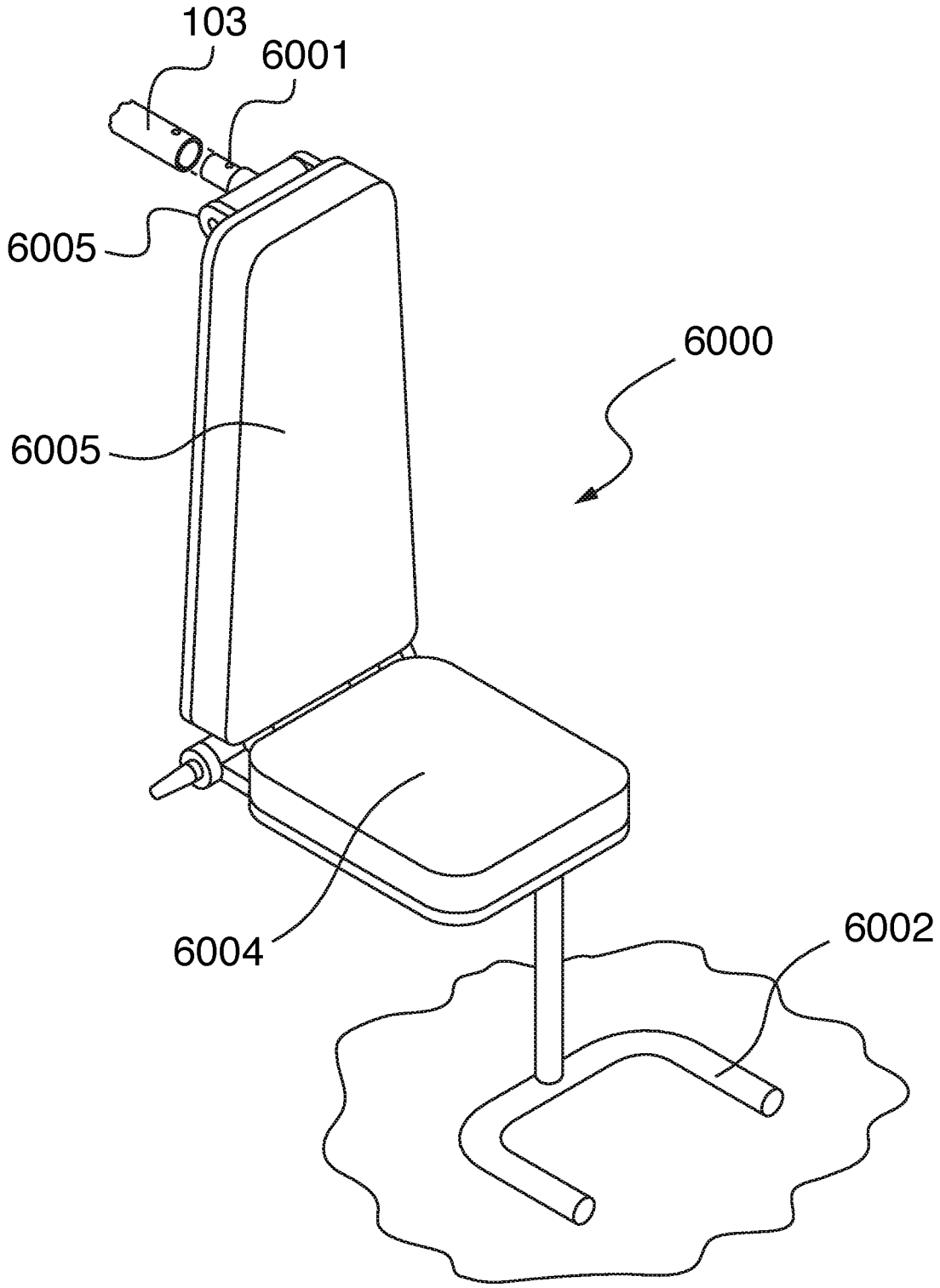
FIG. 60 is a drawing showing a bench being mounted to an integrated connector, according to an embodiment.

FIG. 60 is a drawing showing a bench being mounted to an integrated connector, according to an embodiment.

A bench 6000 is attached to a bench connector 6001 which can attach to the integrated connector 103 (using any connection method). The bench 6000 comprises a back 6003 and a connected seat 6004. A user can sit on the seat 6004 and perform exercises with the bench 6000 being securely attached to the integrated connector 103 (which is securely attached to the body 100 which is securely attached to the spine which is securely attached to the spine braces which are securely attached to the wall). Thus, the user is free to perform vigorous exercises and put pressure on the bench 6000 without the possibility of the bench 6000 falling down. Bench support 6002 is a structure which rests flat on the ground and is connected to the bench 6000. A bench pivot 6005 is connected between the back 6003 and the bench connector 6001 and enables pivoting of the angle of the bench connector 6001 and the back 6003.

Figure 61:
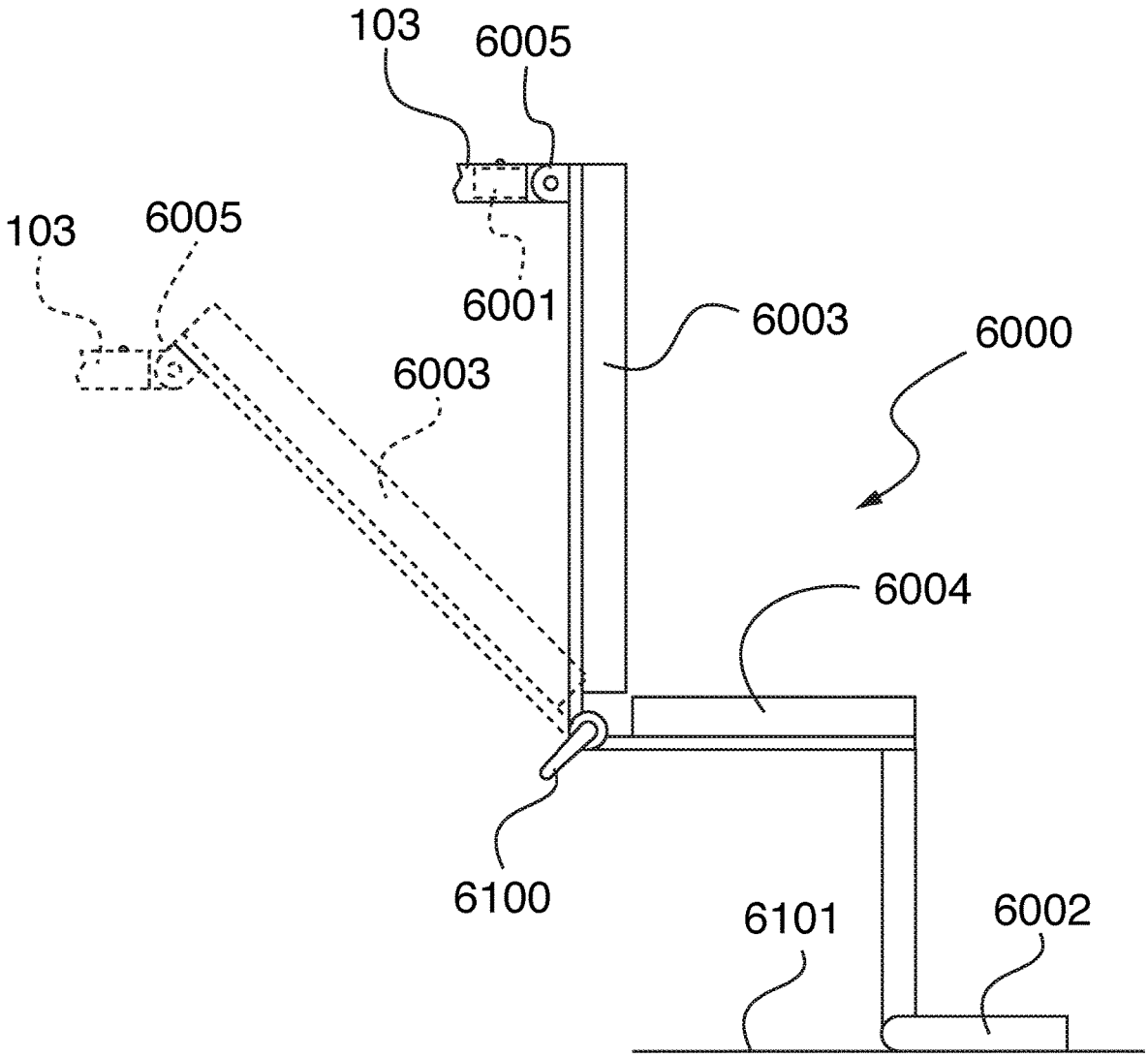
FIG. 61 is a drawing showing adjustment of the bench, according to an embodiment.

FIG. 61 is a drawing showing adjustment of the bench, according to an embodiment.

A crank 6100 on the bench 6000 adjusts the angle of the back 6003 relative to the seat 6004. When the angle is adjusted and the bench connector 6000 is attached to the integrated connector 103, the support 6002 would move along the floor 6101 when the angle is adjusted by the crank 6100. Note that the bench pivot 6005 pivots in order to enable the angle between the bench connector 6001 and the back 6003 to adjust in order for the angle between the back 6003 and the seat 6004 to be adjusted (by the crank 6100)

while allowing the bench connector 6001 to remain connected to the integrated connector 103.

FIG. 61 shows two possible positions of the back 6003 (a raised position (vertically straight) and a lowered position (diagonal). Note that the location of the integrated connector 103 would be lower on the spine in the lowered position than it would be in the raised position. The user is able to remove the body 100 from the spine and position it vertically on the spine in a preferred location and replace the body 100.

Figure 62:
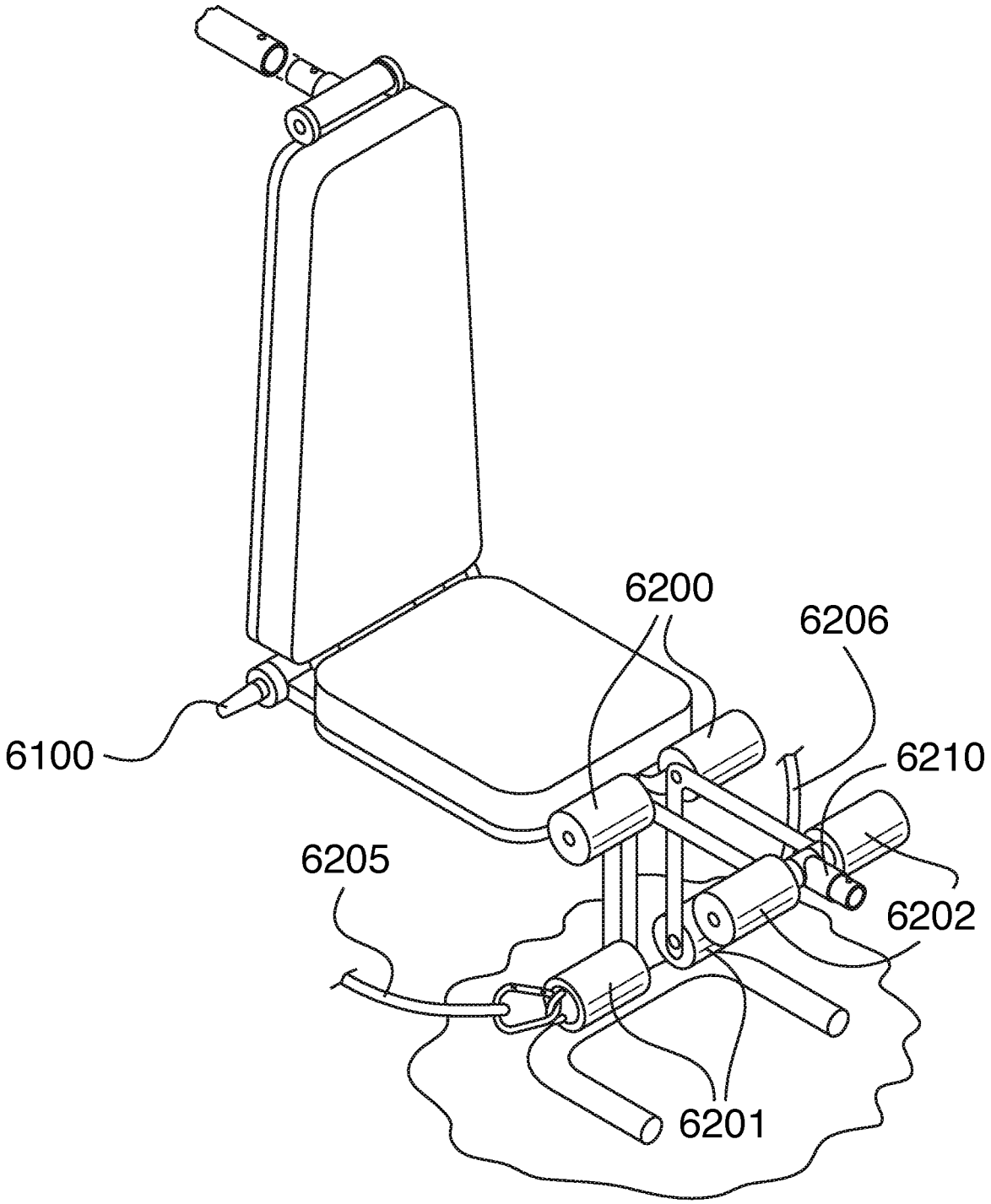
FIG. 62 is a drawing showing a bench with leg lifts being mounted to an integrated connector, according to an embodiment.

FIG. 62 is a drawing showing a bench with leg lifts being mounted to an integrated connector, according to an embodiment.

A leg pivot 6200 allows a pair of leg lifts 6201 and an additional pair of leg lifts 6202 to pivot (rotate) around the leg pivot 6200, thereby enabling a user to do leg exercises (by using his/her legs to lift/rotate the leg lefts 6201). A resistance cord 6205 is connected to each of the leg lifts 6201 (and to another part of the apparatus such as the pulley plate or other part) which provides resistance when the user lifts the leg lifts 6201 with his/her legs.

A seat connector 6210 is between the additional pair of leg lifts 6202 and can be used to connect the seat connector 6210 (and hence the seat 6004) to the integrated connector 103 and the pulley connector 5502.

Figure 63:
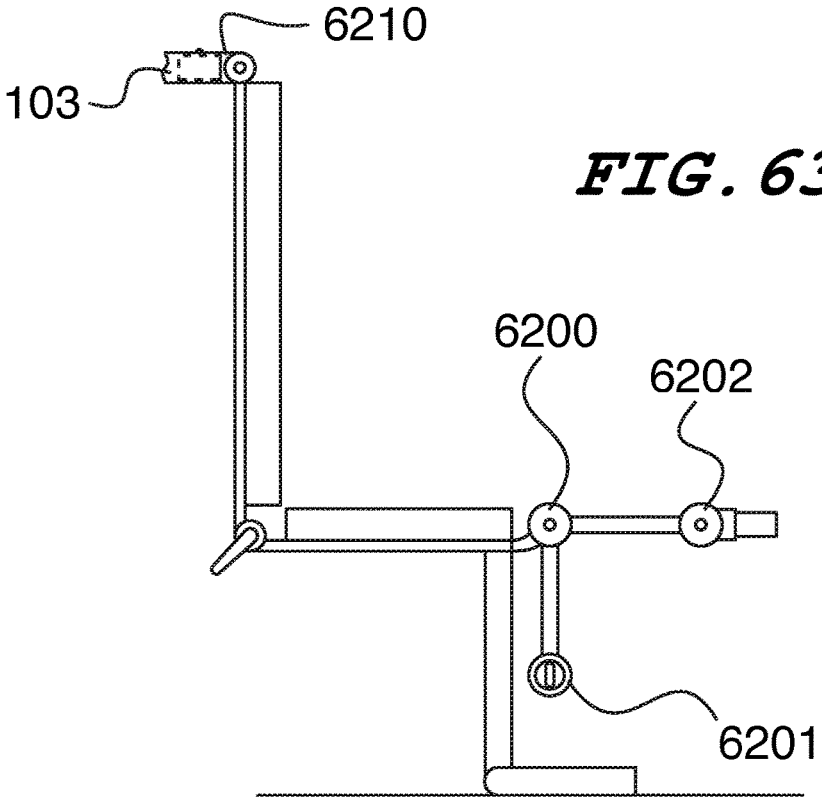
FIG. 63 is a drawing of a side view of the bench mounted to the integrated connector, according to an embodiment.

FIG. 63 is a drawing of a side view of the bench mounted to the integrated connector, according to an embodiment.

The bench is mounted to the integrated connector as shown in FIG. 62. The bench can also be mounted to the pulley connector or the extension pole (which can be connected to the pulley connector or the integrated connector).

Figure 64:
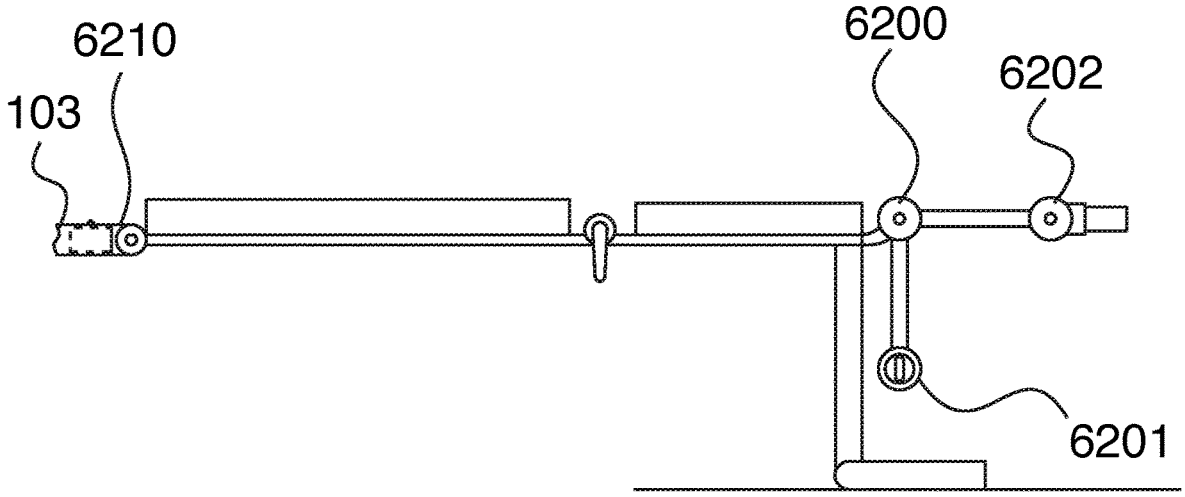
FIG. 64 is a drawing of side view of the bench in a horizontal position mounted to the integrated connected, according to an embodiment.

FIG. 64 is a drawing of side view of the bench in a horizontal position mounted to the integrated connector, according to an embodiment.

In FIG. 64, the bench and seat are horizontally aligned (flat).

In FIGS. 61-64, the bench (or more particularly the seat) is connected to the integrated connector 103 by way of the bench connector 6001 being connected to the integrated connector 103. Note that in all of these embodiments, the body 100 can be replaced with the pulley plate 5500 (meaning the pulley plate is attached to the spine in the same manner that the body 100 can be attached to the spin) such that the bench connector 6001 is attached to the pulley connector 5502.

Figure 65:
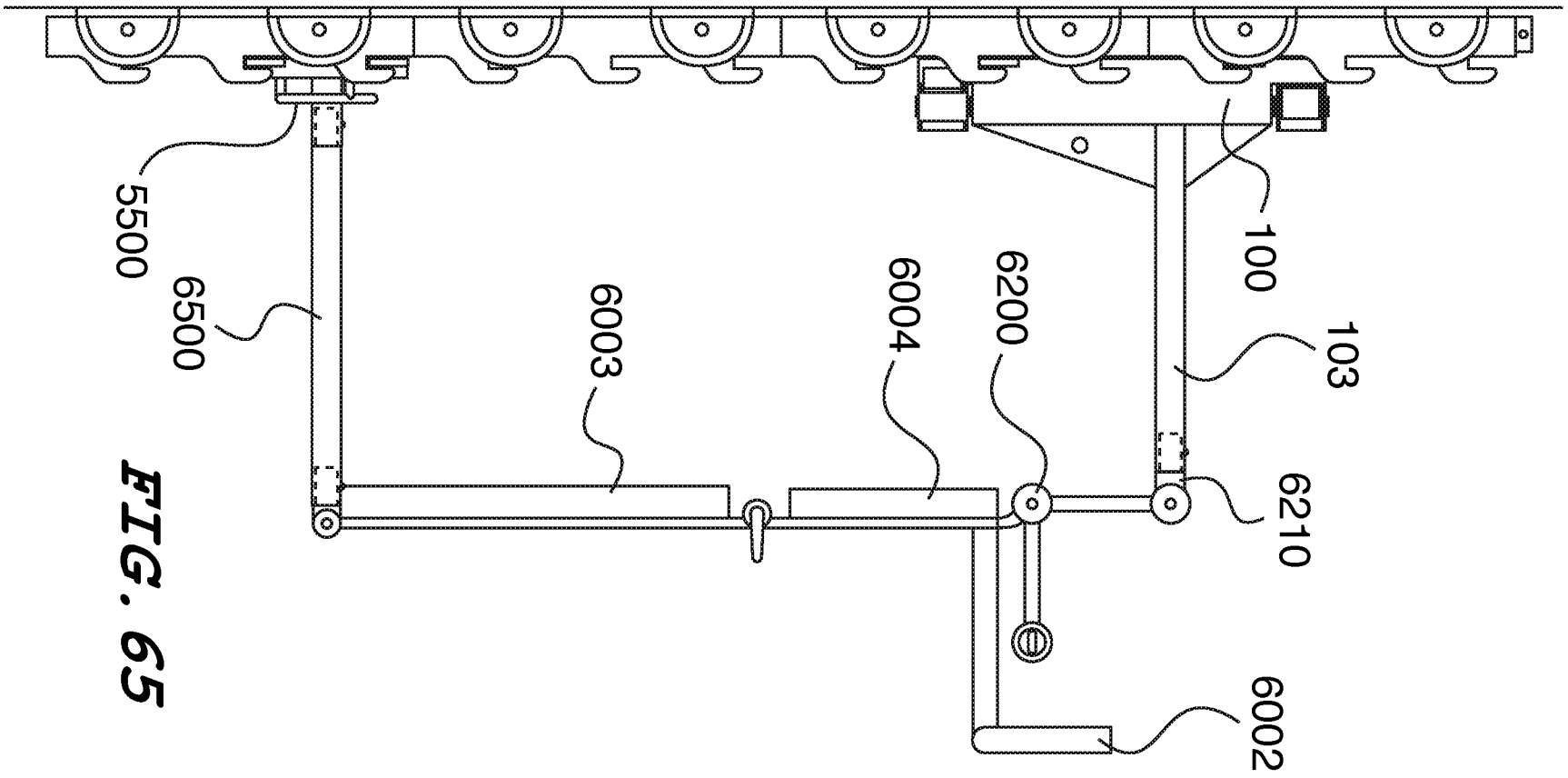
FIG. 65 is a drawing of the bench being stored vertically, according to an embodiment.

FIG. 65 is a drawing of the bench being stored vertically, according to an embodiment.

In order to store the apparatus (when not in use) such that it is conveniently out of the way, the parts can be vertically hung on the spine as illustrated in FIG. 65 as to not take up any floor space. An extension pole 6500 is used to connect the integrated connector 103 to the bench connector 6001. The extension pole 6500 is a pole with the appropriate connectors on each side so each side can connect to any other connector described herein. The seat connector 6210 connects to the integrated connector 103. The apparatus is not intended to be used in this position, but only stored.

When the user wants to take a break from using the equipment for exercising, the braces (which are mounted on the wall) can be used to create shelves.

Figure 66:
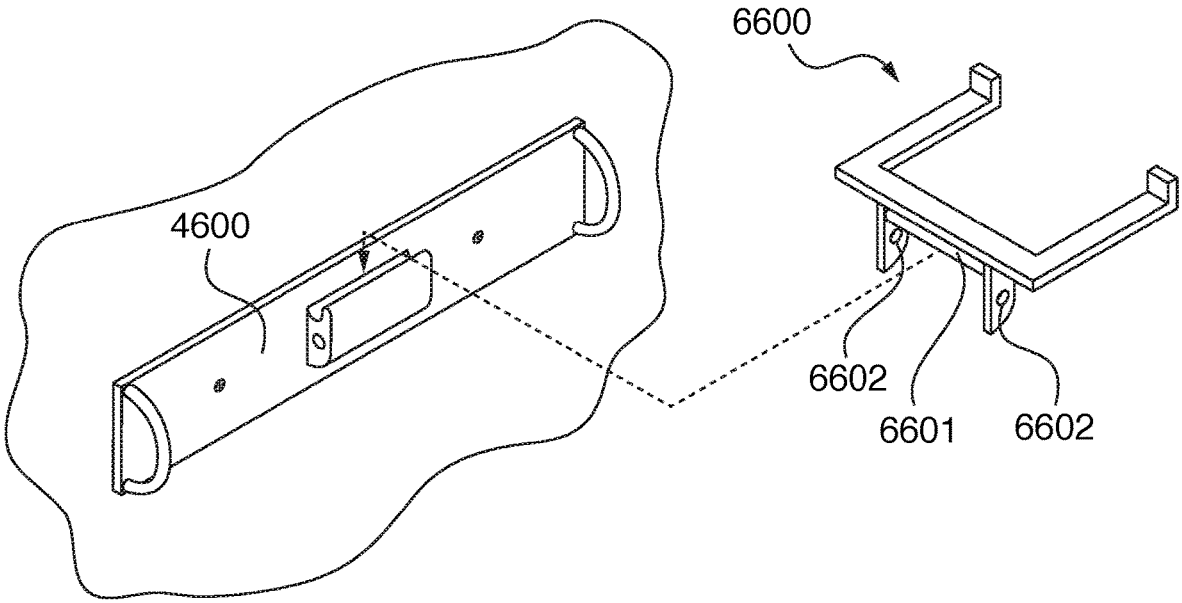
FIG. 66 is a drawing of a bracket being attached to a spine brace, according to an embodiment.

FIG. 66 is a drawing of a bracket being attached to a spine brace, according to an embodiment.

A bracket 660 has pair of bracket holes 6602 and a bracket dowel 6601. The bracket dowel 6601 fits onto the slot 5001 on the adapter on each of the braces 4600. The pair of bracket holes 6602 would be aligned with the adapter hole 4603.

FIG. 67 is a drawing showing a shelf being mounted onto the spine brace, according to an embodiment.

A bracket pin 6700 is inserted through a bracket hole 6602 and then through the adapter hole 4603 and then through the other bracket hole 6602 in order to secure the brace 4600 onto the brace 4600. A shelf 6800 can then be placed over the bracket 6600 as shown. Attaching the bracket 6600 to the brace 4600 is easy and removing it is also easy by pulling out the bracket pin 6700 and then the bracket 6600 can be easily removed from the brace 4600.

FIG. 68 is a drawing showing the shelf mounted onto the spine brace, according to an embodiment.

The assembled shelf can be used for a variety of purposes. It can be disassembled and the spine assembled and installed onto the braces 4600 (as described herein) when the user wishes to perform exercises again.

Figure 69:
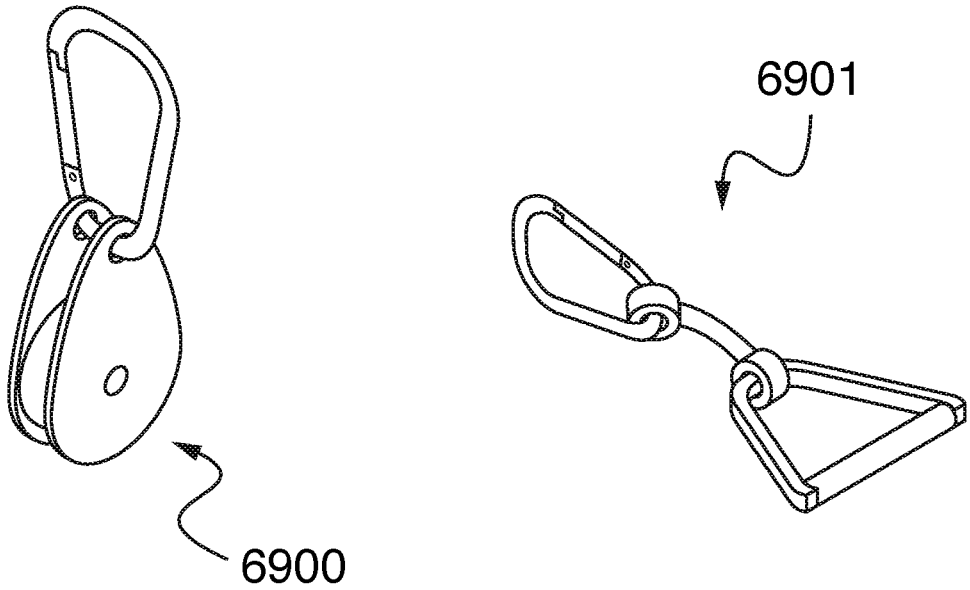
FIG. 69 is a drawing showing various parts used for exercising, according to an embodiment.
Figure 69:
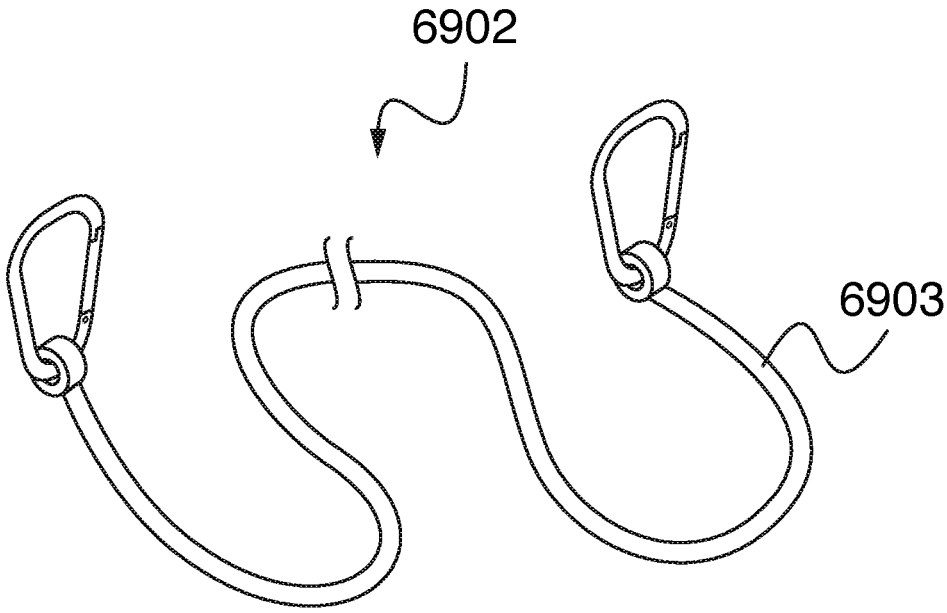

FIG. 69 is a drawing showing various parts used for exercising, according to an embodiment.

A pulley attached to a carabiner clip 6900 can be used to pass a resistance cord therethrough. A handle attached to a carabiner clip 6901 can be used by the user to grip the handle attached to the carabiner clip 6901 which would then be clipped to a resistance cord in order for a user to exercise using the resistance cord. A resistance cord 6903 has a carabiner clip on each end.

Figure 70:
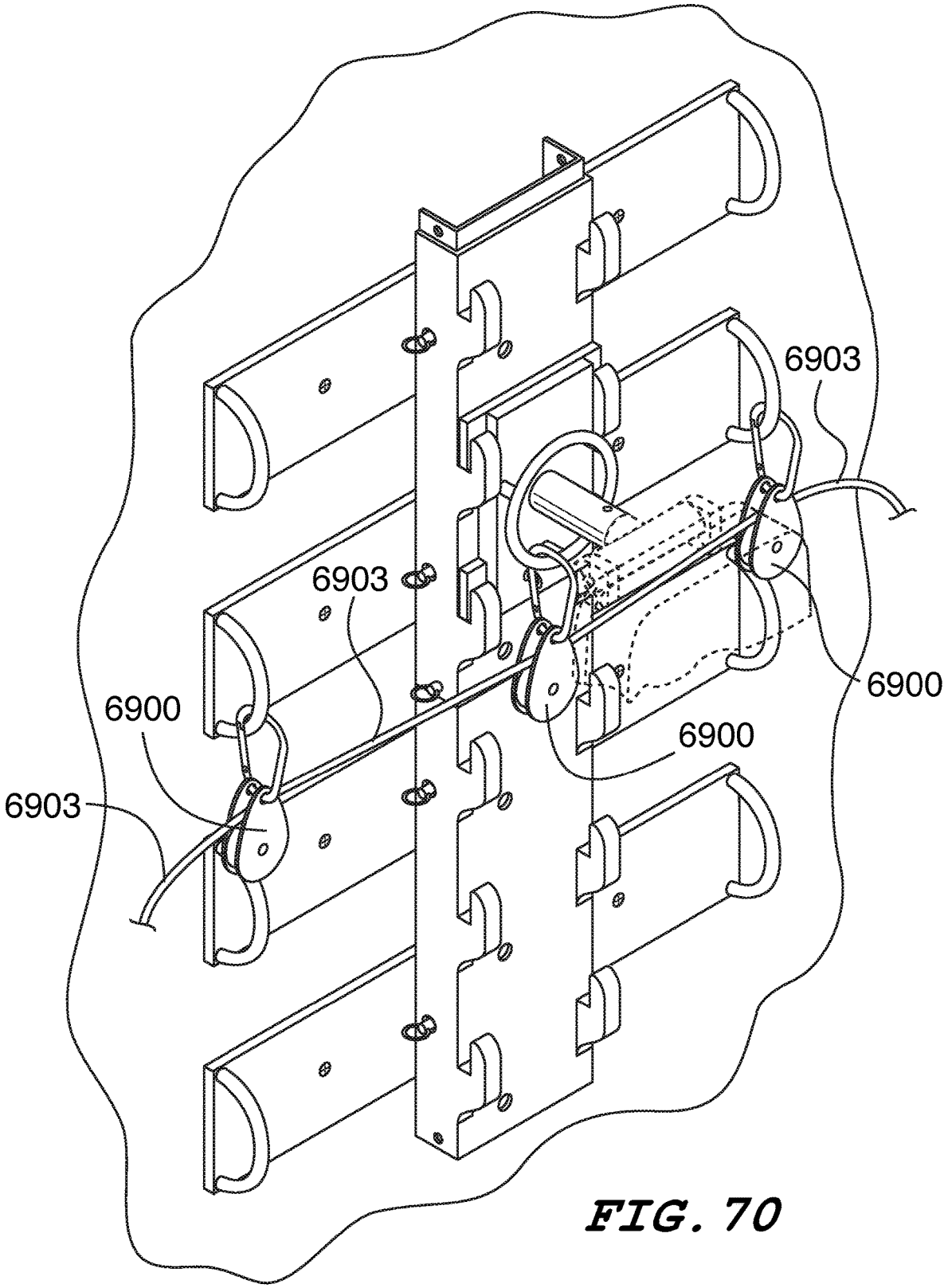
FIG. 70 is a drawing showing a configuration of the resistance cord, according to an embodiment.

FIG. 70 is a drawing showing a configuration of the resistance cord, according to an embodiment.

Four braces 4600 are mounted on a wall (using nails). A spine is constructed (by joining two spine sections together) and attached onto the four braces 4600. A pulley plate is inserted into a set of hooks on the spine. Three sets of pulleys attached to a carabiner clip 6900 are shown. The first pulley attached to a carabiner clip 6900 is attached to a brace connector, the second pulley attached to a carabiner clip is attached to the pulley ring 5503, and the third pulley attached to a carabiner clip is attached to another brace connector. A resistance cord 6903 runs through each of the three pulleys. Note that the pulley plate can be positioned along any of the pairs of hooks. In other words, there are five vertical positions (although the spine can be configured to have any other number) defined by the hooks in which the pulley plate (or the body) can be placed. Thus, there would be at least two possible vertical positions that the user could place the body/pulley plate into on the spine (in other words there would be at least three pairs of hooks with the body/pulley plate being placed onto two such pairs). The number of such positions could be 2-10 or more. The vertical position the user chooses to place the pulley plate and/or the body would depend on a number of factors, such as the types of exercises being performed and the preferred angle of the resistance cord to the user, the vertical height of whatever connector (e.g., the bench connector) is so that the pulley plate/body can match the same height, etc.

Figure 71:
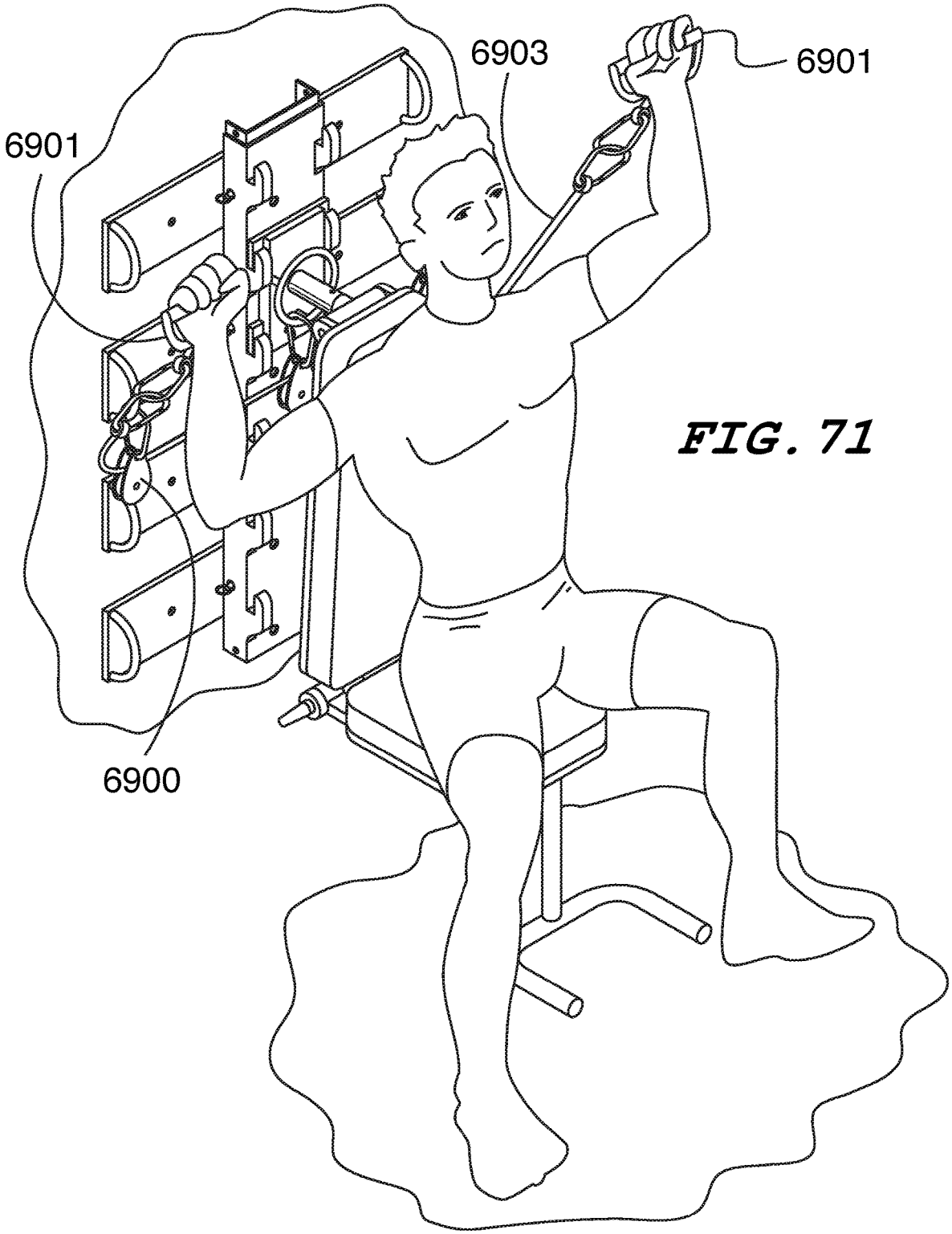
FIG. 71 is a drawing showing one example of a user using the apparatus to perform exercises, according to an embodiment.

FIG. 71 is a drawing showing one example of a user using the apparatus to perform exercises, according to an embodiment.

The resistance cord 6903 is attached to two handles (one for each of the user's hands). In this configuration, the user can perform a "shoulder press" exercise in which the user repeatedly pushes his arms out, and then in, etc. The resistance from the resistance cord 6903 provides tension which requires strength and energy to perform this exercise. Note that one or both ends of the resistance cord 6903 can each be clipped to a handle using a carabiner clip, or alternatively one or both ends of the resistance cord 6903 can be integrally attached to a handle. Note the length of the resistance cord 6903 can vary in order to provide the user the ideal length/amount of resistance for the user's desired exercises.

Note that instead of using the pulley plate in this configuration, the body can be used as well (each can be substituted for each other when connecting to the spine). If the user desires to have a longer distance between the bench connector and the pulley connector then the user can connect an extension pole 3500 (which can be any length) between the bench connector and the pulley connector. Note that both the body 100 and the pulley plate can be considered a "block" which is connected to a connector (integrated connector in the case of the body 100 and pulley connector in the case of the pulley). The term block can refer to either of the body or the pulley connector since they can be positioned on the spine interchangeably.

Note that all connectors which are on bars (e.g., bench connector, integrated connector, pulley connector, seat connector, extension pole ends, etc.) has a male or female status (in other words one connector would fit into the other and lock into place via a button, pin, etc.) It is noted that whether a piece is male or female, is not relevant and all pieces described herein can be configured with male or female connectors in any location. That is, all pieces herein can be configured to fit in with each other and form any configuration the user desires. As a further example, the extension pole can have one male end and one female end, or both male ends or both female ends. Each connector used herein (whether male or female) includes the possibility of using the opposite (e.g., female or male) connector in its place. Each connection made between parts is sturdy and can support a lot of weight but can also be removable (e.g., disconnected) easily (e.g., by pressing a button, removing a pin, etc.) to allow for easy disassembly and storage.

Shown is just one configuration, but it can be appreciated that the carabiner clips can be attached to any of the brace connectors, pulley ring, etc. The resistance cord can also be attached to handles or any other part of the apparatus, such as the leg lifts 6201. Thus, the user can device a large number of personalized exercises and configurations based on the user/s preferences, and can exercise his/her hands, legs, etc.

Note that all of the components described herein can be made from any suitable materials (for example but not limited to aluminum, steel, nylon, plastic, aluminum-steel alloy, wood, etc.) Any structural/sturdy part (e.g., connector, bar, pin, etc.) should typically be made from a hard material (e.g., aluminum, steel, aluminum-steel alloy, etc.) Wood or plastic can be used for parts as well, e.g., the braces, bench, etc. Note that resistance cord can be made of any suitable material for its intended purpose (a cord that stretches slightly when pulled to require energy to pull yet automatically retracts when released so it can be reused over and over again for exercise) such as nylon, bungee, rubber, plastic, etc. Any part described herein can be made from any material such part can be made from as known in the art. For example, the strap can be made from any suitable material, such as nylon, rope, etc. The other parts can all be made from any combination of suitable materials, such as steel, aluminum, plastic, aluminum-steel alloy, etc. Note that while the word "strap" is used herein to refer to a strap forming the top strap and the bottom strap, instead of a strap other similar types of material can be used such as cord, rope, string, chain, etc. Note that all parts that are connected/attached as described and/or illustrated herein can attach via any attachment mechanism, which includes button/hole, hole/button, pin/holes (pin with head pushed through aligned holes), etc. Note that the integrated connector can have a hole or a button for its attachment mechanism to other attachments, and the other attachments that attach to the integrated connector would have the corresponding attachment mechanism (e.g., if the integrated connector has a button then the other attachment that is attaching to the integrated connector would have a hole, if the integrated connector has a hole then the other attachment that is attaching to the integrated connector would have a button or another hole (for use with the pin embodiment)). Any connector attaching to its adjacent connectors would thus have the appropriate attachment mechanism in order to properly attach. It is also assumed that any attachment utilized herein would be attached to the integrated connector 103 while the body 100 is secured to a vertical structure such as a tree (typically high) as described herein, although one exception would be the stool attachment in which the body 100 rests on the ground. Also note, when attachments are made to the spine, this would be attached to a wall and may not necessary be very high. Note that in the figures, if any portion of any part is not visible (e.g., hidden from view) in the figures, it can be assumed that such portion(s) that are not visible would be consistent with the portions that are shown, in other words there would be no "surprises" in any obscured portion in the figures. In addition, all attachments/equipment described herein also includes the method of using that equipment, including installing/attachment all of the parts together and removing/detaching all of the parts when the user is done utilizing the equipment.

It is noted that all features, embodiments, structures, methods, etc., described and/or illustrated herein, can be combined with any other such features, embodiments, structures, methods, etc. described and/or illustrated herein. This disclosure includes any and all such combinations.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus, comprising:

a spine comprising at least three pairs of hooks and a plurality of dowels;

a plurality of braces, wherein each brace of the plurality of braces comprises a slot, wherein the plurality of dowels on the spine are configured to be attached to respective slots on the plurality of braces, wherein the plurality of braces is configured to be mounted on a wall, wherein the spine is configured to be removably mounted vertically on the plurality of braces, wherein the plurality of braces being parallel to each other with space between each of the plurality of braces;

a first connector attached to a block, the block adapted to fit into two pairs of the at least three pairs of hooks; and a bench connected to a bench connector, the bench connector configured to removably attach to the first connector.

2. The apparatus as recited in claim 1, wherein the block is a body.

3. The apparatus as recited in claim 1, wherein the block is a pulley plate.

4. The apparatus as recited in claim 3, wherein the pulley plate comprises a pulley ring.

5. The apparatus as recited in claim 1, further comprising a resistance cord adapted to attach to the block.

6. The apparatus as recited in claim 1, further comprising a resistance cord adapted to attach to the plurality of braces.

7. The apparatus as recited in claim 1, wherein the bench comprises leg lifts.

8. The apparatus as recited in claim 7, further comprising a resistance cord adapted to attach to the leg lifts.

9. The apparatus recited in claim 1 further comprising a resistance cord with two opposing ends, each end of the two opposing ends respectively coupled to a respective handle, the resistance cord passing through at least one pulley which is connected to the block.

10. The apparatus as recited in claim 1, wherein the block comprises an upper support adapted to fit onto one of the two pairs of the at least three pairs of hooks, and a lower support adapted to fit onto another one of the two pairs of the at least three pairs of hooks.

11. The apparatus as recited in claim 1, wherein a bench pivot is attached between the bench and the bench connector and configured to enable the bench connector to pivot about the bench.

* * * * *